US010953416B2

(12) United States Patent
Tan

(10) Patent No.: US 10,953,416 B2
(45) Date of Patent: Mar. 23, 2021

(54) LIQUID SAVING DEVICE

(71) Applicant: Yung-Chieh Tan, Foster City, CA (US)

(72) Inventor: Yung-Chieh Tan, Foster City, CA (US)

( * ) Notice: Subject to any disclaimer, the term of this patent is extended or adjusted under 35 U.S.C. 154(b) by 151 days.

(21) Appl. No.: 16/274,260

(22) Filed: Feb. 13, 2019

(65) Prior Publication Data

US 2019/0247870 A1 Aug. 15, 2019

Related U.S. Application Data

(60) Provisional application No. 62/682,182, filed on Jun. 8, 2018, provisional application No. 62/629,709, filed on Feb. 13, 2018.

(51) Int. Cl.

| | |
|---|---|
| ***B05B 1/00*** | (2006.01) |
| ***B05B 1/34*** | (2006.01) |
| ***B05B 1/30*** | (2006.01) |
| ***B05B 1/06*** | (2006.01) |

(52) U.S. Cl.

CPC ..... *B05B 1/3405* (2013.01); *B05B 1/06* (2013.01); *B05B 1/3073* (2013.01)

(58) Field of Classification Search

CPC ..... B05B 1/06; B05B 1/18; B05B 1/3405; B05B 1/3073; E03C 1/08; E03C 1/084; E03C 1/086; E01C 1/084

USPC ..... 239/428.5, 463, 466, 468

See application file for complete search history.

(56) References Cited

U.S. PATENT DOCUMENTS

| | | | | |
|---|---|---|---|---|
| 1,912,113 A * | 5/1933 | Aghnides | F04F 5/04 | 417/179 |
| 2,256,729 A * | 9/1941 | Thompson | B05B 1/14 | 239/553.3 |
| 2,395,621 A * | 2/1946 | Funke | B05B 1/12 | 239/590.3 |
| 2,787,452 A * | 4/1957 | Aghnides | E03C 1/084 | 239/428.5 |
| 2,832,577 A * | 4/1958 | Goodrie | E03C 1/084 | 239/427 |

(Continued)

FOREIGN PATENT DOCUMENTS

| | | |
|---|---|---|
| CN | 2279219 Y | 4/1998 |
| CN | 1371764 A | 10/2002 |

(Continued)

*Primary Examiner* — Viet Le

(74) *Attorney, Agent, or Firm* — Shannon Yi-Shin Yen; Profound Law LLP

(57) ABSTRACT

A liquid saving device includes a liquid guide and a vortex adaptor. The liquid guide includes a primary recess, an indentation, and a plurality of primary pores. The vortex adaptor includes at least one air inlet structure, a trench, a gap and a center through hole. The plurality of primary pores is coupled to the indentation for receiving a first liquid stream to generate a same plurality of second liquid streams at respective ends. At least part of the plurality of primary pores have different lengths. A primary pore has a shorter length if the first primary pore outputs its corresponding second liquid stream with a larger deflection, and vice versa. The trench receives both at least one secondary liquid stream and air to generate a first aerated vortex. An elevated flow of the first aerated vortex with a spray-form liquid stream to generate a second aerated vortex.

14 Claims, 65 Drawing Sheets

(56) References Cited

U.S. PATENT DOCUMENTS

| | | | | | |
|---|---|---|---|---|---|
| 2,858,120 | A | * | 10/1958 | Goodrie | E03C 1/084 239/428.5 |
| 2,962,225 | A | * | 11/1960 | Aghnides | E03C 1/084 239/428.5 |
| 2,971,701 | A | * | 2/1961 | Shames | F16L 27/073 239/587.4 |
| 2,989,249 | A | * | 6/1961 | Richter | E03C 1/084 239/427 |
| 2,990,122 | A | * | 6/1961 | Blumberg | E03C 1/084 239/441 |
| 2,998,930 | A | * | 9/1961 | Aghnides | E03C 1/084 239/428.5 |
| 4,052,002 | A | | 10/1977 | Stouffer et al. | |
| 4,122,845 | A | | 10/1978 | Stouffer et al. | |
| 4,669,665 | A | * | 6/1987 | Shay | B05B 7/0056 239/403 |
| 6,322,008 | B1 | | 11/2001 | Aker et al. | |
| 6,343,750 | B1 | | 2/2002 | Engel | |
| 6,715,699 | B1 | | 4/2004 | Greenberg et al. | |
| 7,252,248 | B2 | | 8/2007 | Cutler | |
| 7,374,112 | B1 | | 5/2008 | Bulan et al. | |
| 7,975,936 | B2 | | 7/2011 | Paoluccio | |
| 8,033,301 | B2 | | 10/2011 | Miwa | |
| 8,461,705 | B2 | | 6/2013 | Kuroishi et al. | |
| 9,504,968 | B2 | | 11/2016 | Takano | |
| 9,545,184 | B2 | | 1/2017 | Zhou et al. | |
| 9,566,593 | B2 | | 2/2017 | Marty et al. | |
| 9,623,423 | B2 | | 4/2017 | Erickson | |
| 9,943,863 | B2 | | 4/2018 | Huffington et al. | |
| 2003/0029935 | A1 | * | 2/2003 | Takeshi | B05B 7/005 239/428.5 |
| 2003/0080213 | A1 | * | 5/2003 | Clauss | A62C 31/02 239/428.5 |
| 2005/0001072 | A1 | | 1/2005 | Bolus et al. | |
| 2007/0246577 | A1 | | 10/2007 | Leber | |
| 2012/0024984 | A1 | | 2/2012 | Takano | |
| 2016/0082447 | A1 | | 3/2016 | Gong et al. | |
| 2017/0087569 | A1 | | 3/2017 | Nagata et al. | |
| 2018/0058050 | A1 | * | 3/2018 | Wu | G01F 15/06 |
| 2018/0087247 | A1 | * | 3/2018 | Blum | E03C 1/086 |
| 2018/0238032 | A1 | * | 8/2018 | Russell | F15B 15/20 |

FOREIGN PATENT DOCUMENTS

| | | | |
|---|---|---|---|
| CN | 201074700 | Y | 6/2008 |
| CN | 104512959 | A | 4/2015 |
| CN | 204254021 | U | 4/2015 |
| CN | 205938075 | U | 2/2017 |
| CN | 206784511 | U | 12/2017 |
| CN | 207170047 | U | 4/2018 |
| EP | 2345765 | A1 | 7/2011 |
| EP | 3330005 | A1 | 6/2018 |
| KP | 200459788 | Y1 | 4/2012 |
| KP | 20120102373 | A | 9/2012 |

* cited by examiner

SECTION A-A

SECTION B-B

SECTION A-A

SECTION B-B

SECTION G-G

SECTION F-F

SECTION E-E

SECTION A-A

SECTION D-D

SECTION H-H

SECTION E-E

SECTION F-F

SECTION G-G

LIQUID SAVING DEVICE

CROSS REFERENCE TO RELATED APPLICATION

The present application claims priority to U.S. Provisional Application Ser. No. 62/629,709 filed on Feb. 13, 2018 and U.S. Provisional Application Ser. No. 62/682,182 filed on Jun. 8, 2018, which are hereby incorporated by reference in its entirety.

FIELD

The present disclosure relates to a liquid guide, a vortex adaptor, and a liquid saving device incorporating both the liquid guide and the vortex adaptor, and more particularly, to a liquid guide capable of directing liquid to desired orientations, a vortex adaptor capable of introducing one or more vortexes for effectively mixing liquid and gas with the aid of the liquid guide, and a liquid saving device incorporating both the liquid guide and the vortex adaptor for precisely adjusting the flow rate of liquid passing through the liquid saving device.

BACKGROUND

A flow adapter is generally used to improve the efficiency and usage of fluid dispensed from a source. For example, a flow adapter fitted over the end of a faucet can reduce the flow rate and boost the velocity of a fluid stream from the adapter, thereby increasing the efficiency of a washing process. In another example, a flow adapter can fit over a pressurized air source to modulate the velocity of the output air jet. In yet another example, flow adapter is used to modulate the output of fuels for combustions. The present invention is aimed to modulate flow output for these applications.

SUMMARY

For solving the conventional water wasting issue, the present disclosure discloses a liquid guide, a vortex adaptor, and a liquid saving device incorporating both the disclosed liquid guide and the disclosed vortex adaptor.

In one embodiment, the liquid guide includes a primary recess, an indentation, and a plurality of primary pores. The primary recess receives a first liquid stream. The indentation is disposed within the primary recess. The plurality of primary pores are coupled to the indentation for receiving the first liquid stream to generate a plurality of second liquid streams at respective ends of the primary pores. Each of the plurality of primary pores ends at a bottom of the liquid guide. In some implementations, the plurality of primary pores may have the same length. In some implementations, at least part of the plurality of primary pores may have different lengths. For example, a first primary pore among the plurality of primary pores may have a shorter length if the first primary pore is designed to output its corresponding second liquid stream with a larger deflection. For example, a second primary pore among the plurality of primary pores may have a longer length if the second primary pore is designed to output its corresponding second liquid stream with a smaller deflection.

In one embodiment, the vortex adaptor includes at least one air inlet structure, a is trench, a gap, and a center through hole. The at least one air inlet structure is disposed at a lateral side of a top of the vortex adaptor. The at least one air inlet structure draws air into the vortex adaptor. The trench is disposed inside the vortex adaptor and coupled to the at least one air inlet structure. The trench receives both at least one secondary liquid stream (generated for example by liquid passing through one or more pores) and the air drawn by the at least one air inlet structure to generate a first aerated vortex. The gap is disposed at the top of the vortex adaptor for receiving a spray-form liquid stream. Moreover, the gap is coupled to the trench for receiving an elevated flow of the first aerated vortex. Inside the gap the elevated flow of the first aerated vortex can mix with other similar vortex and or spray-form liquid stream to generate a fused aerated vortex. The center through hole is coupled to the gap. The center through hole outputs an aerated stream out of the second aerated vortex.

In one embodiment, the liquid saving device includes a liquid guide and a vortex adaptor. The liquid guide includes a primary recess, an indentation, a plurality of primary pores, a secondary recess and a plurality of straight pores. The primary recess receives a first liquid stream. The indentation is disposed within the primary recess. The plurality of primary pores are coupled to the indentation for receiving the first liquid stream to generate a same plurality of second liquid streams at respective ends. The plurality of second liquid streams are spray-form. Each of the plurality of primary pores ends at a bottom of the liquid guide. The secondary recess is disposed above the primary recess for receiving the first liquid stream. The plurality of straight pores is disposed on the bottom of the secondary recess. The plurality of straight pores inlet the first liquid stream to interact and form a plurality of third liquid streams at the bottom of the liquid guide. In some implementations, the plurality of primary pores have the same length. In some implementations, at least part of the plurality of primary pores have different lengths. For example, a first primary pore among the plurality of primary pores has a shorter length if the first primary pore is designed to output its corresponding second liquid stream with a larger deflection. For example, a second primary pore among the plurality of primary pores has a longer length if the second primary pore is designed to output its corresponding second liquid stream with a smaller deflection. The vortex adaptor has a top coupled to the bottom of the liquid guide. The vortex adaptor includes at least one air inlet structure, a trench, a gap and a center through hole. The at least one air inlet structure is disposed at a lateral intersection between the bottom of the liquid guide and the top of the vortex adaptor. Also, the at least one air inlet structure draws air at a lateral side of the liquid saving device. The trench is disposed inside the vortex adaptor. The trench is also coupled to the at least one air inlet structure and the plurality of straight pores at an intersection between the liquid guide and the vortex adaptor. In addition, the trench receives both the plurality of second liquid streams and the air drawn by the at least one air inlet structure to generate a first aerated vortex. The gap is disposed at the top of the vortex adaptor for receiving the plurality of second liquid streams. The gap is also coupled to the trench for receiving an elevated flow of the first aerated vortex. Mixing of one or more vortex and or spray streams can occur in the gap region to generate a second vortex. The center through hole is coupled to the gap. Moreover, the center through hole outputs an aerated stream out of the second aerated vortex.

BRIEF DESCRIPTION OF THE DRAWINGS

One or more embodiments are illustrated by way of example, and not by limitation, in the figures of the accompanying drawings, wherein elements having the same reference numeral designations represent like elements throughout. The drawings are not to scale, unless otherwise disclosed.

Figure 1:
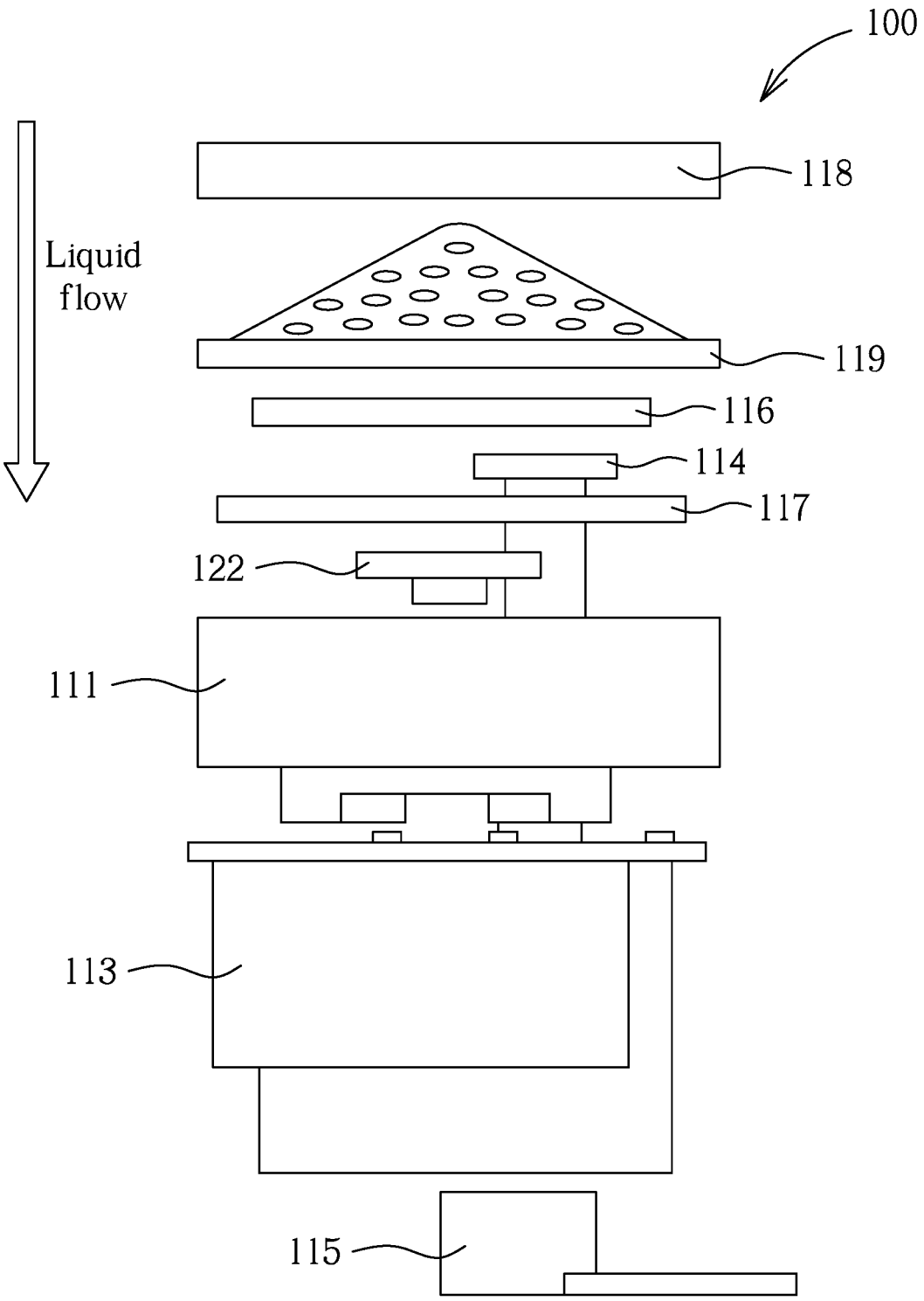
FIG. 1 illustrates an exploded view of a liquid saving device according to one embodiment of the present disclosure.

The drawings are only schematic and are non-limiting. In the drawings, the size of some of the elements may be exaggerated and not drawn on scale for illustrative purposes. The dimensions and the relative dimensions do not necessarily correspond to actual reductions to practice of the invention. Any reference signs in the claims shall not be construed as limiting the scope. Like reference symbols in the various drawings indicate like elements.

DETAILED DESCRIPTION OF THE DISCLOSURE

The making and using of the embodiments of the disclosure are discussed in detail below. It should be appreciated, however, that the embodiments provide many applicable inventive concepts that can be embodied in a wide variety of specific contexts. The specific embodiments discussed are merely illustrative of specific ways to make and use the embodiments, and do not limit the scope of the disclosure.

Throughout the various views and illustrative embodiments, like reference numerals are used to designate like or similar elements throughout the various views, and illustrative embodiments of the present disclosure are shown and described. Reference will now be made in detail to exemplary embodiments illustrated in the accompanying drawings. Wherever possible, the same reference numbers are used in the drawings and the description to refer to the same or like parts. In the drawings, the shape and thickness may be exaggerated for clarity and convenience. This description will be directed in particular to elements forming part of, or cooperating more directly with, an apparatus in accordance with the present disclosure. It is to be understood that elements not specifically shown or described may take various forms. Reference throughout this specification to "one embodiment" or "an embodiment" means that a particular feature, structure, or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments. It should be appreciated that the following figures are not drawn to scale; rather, these figures are merely intended for illustration, and in some instances the drawings have been exaggerated and/or simplified in places for illustrative purposes. One of ordinary skill in the art will appreciate the many possible applications and variations of the present disclosure based on the following illustrative embodiments of the present disclosure.

It will be understood that when an element is referred to as being "on" another element, it can be directly on the other element or intervening elements may be present. In contrast, when an element is referred to as being "directly on" another element, there are no intervening elements present.

It will be understood that singular forms "a", "an" and "the" are intended to include the plural forms as well, unless the context clearly indicates otherwise. Furthermore, relative terms, such as "bottom" and "top," may be used herein to describe one element's relationship to other elements as illustrated in the Figures.

It will be understood that elements described as "under" or "below" other elements would then be oriented "over" or "above" the other elements. The exemplary terms "under" or "below" can, therefore, encompass both an orientation of over and under.

Unless otherwise defined, all terms (including technical and scientific terms) used herein have the same meaning as commonly understood by one of ordinary skill in the art to which this disclosure belongs. It will be further understood that terms; such as those defined in commonly used dictionaries, should be interpreted as having a meaning that is consistent with their meaning in the context of the relevant art and the present disclosure, and will not be interpreted in an idealized or overly formal sense unless expressly so defined herein.

FIG. 1 illustrates a liquid saving device 100 according to one embodiment of the present disclosure. The liquid saving device 100 includes at least a liquid guide 111 and a vortex adaptor 113. Also, in one example, the liquid saving device 100 may include a switch 114 and a corresponding switch handle 115 to adjust its output flow rate. In another example, the liquid saving device 100 may also include a rubber gasket 118 (e.g., a first rubber gasket), a filter 119, a cover piece 116, and a rubber gasket 117 (e.g., a second rubber gasket). In some examples, either of the rubber gaskets 117 and 118 may be made of using a flexible material besides rubber. While the liquid saving device 100 is operated, liquid from a liquid source, e.g., water, flows from its top side and falls through rubber gasket 118 FIG. 1. The liquid saving device 100 may have several different types of outputs. For example, the liquid saving device 100 may output an aerated spinning stream, a liquid spray, or any combination thereof. The details are described in the following figure descriptions.

The rubber gasket 118 is a circumferential structure that includes a bore in its center and forms a lateral seal, which substantially limits liquid from spreading laterally. The filter 119 prevents large solid particles from getting trapped into the liquid saving device 100. The cover piece 116 assists with the switch 114 in adjusting the liquid flow rate and/or type of output of the liquid saving device 100. Details of the interaction between the cover piece 116 and the switch 114 will be described later. The rubber gasket 117 is sandwiched between the switch 114 and the liquid guide 111. In addition, the rubber gasket 117 prevents leakage of liquid flowing through a hole on the liquid guide 111 that receives a switching rod of the switch 114. The liquid guide 111 and the vortex adaptor 113 form a primary chamber body that generates desired vortex flows. The switch handle 115 is inserted through a central through hole of the switch 114.

In some examples, the liquid saving device 100 further includes an outer casing 110. The outer casing 110 is capable of holding the elements shown in FIG. 1, e.g., any of the liquid guide 111, the vortex adaptor 113, the switch 114, and any combination thereof.

Figure 2:
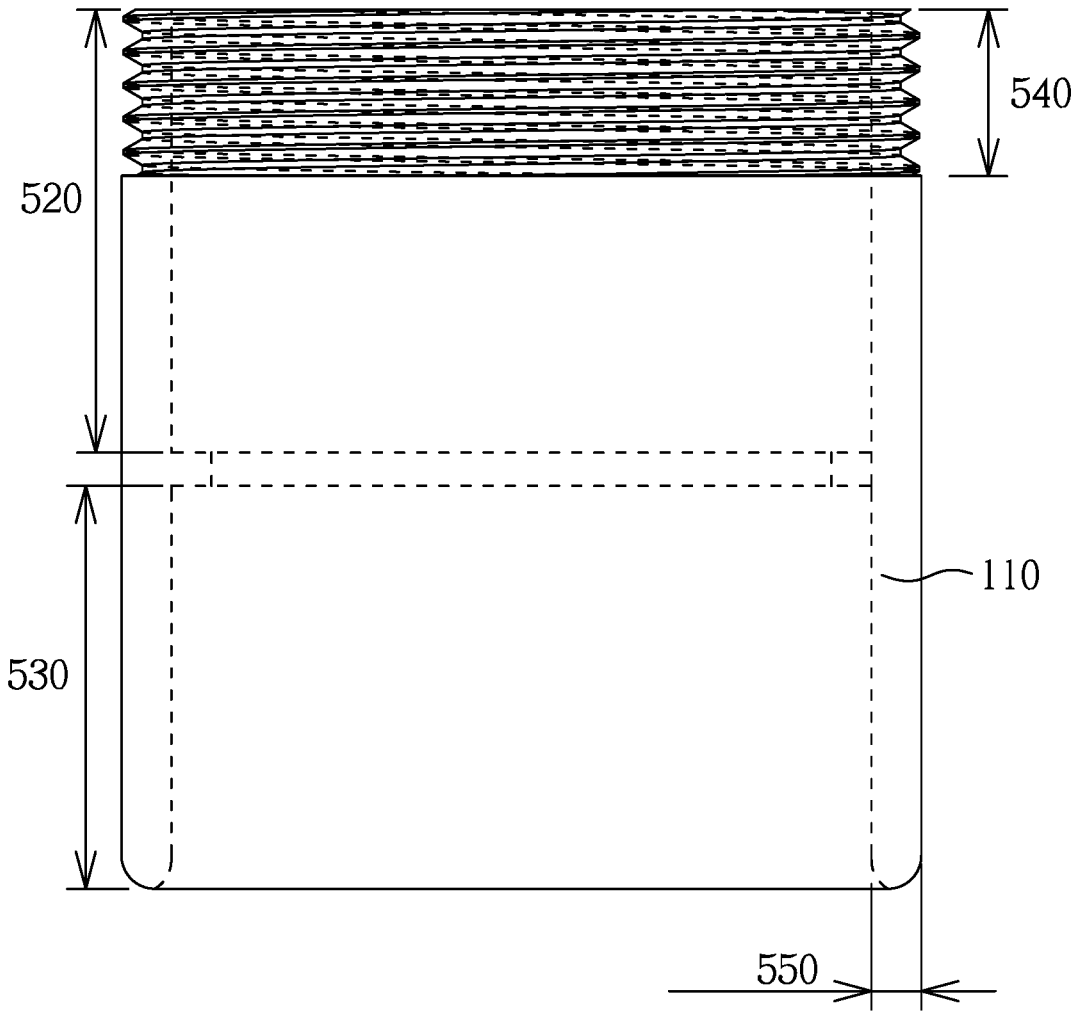
FIG. 2 illustrates a lateral view of the outer casing of the liquid saving device shown in FIG. 1 according to one example of the present disclosure.

FIG. 2 illustrates a lateral view of the outer casing 110 according to one example of the present disclosure. The outer casing 110 has inner and/or outer threads 540 that locks onto a faucet or other types of water sources. The outer casing 110 has an upper body 520 and a lower body 530. The upper body 520 and the lower body 530 are separated by a divider (not shown) that has a smaller diameter than that of the liquid guide 111. A portion of the outer casing 110, which has an extended width 550, is used to hold the edge of the vortex adaptor 113 for supporting the whole assembly of the liquid saving device 100 in place. In some examples, the upper body 520 may cover the liquid guide 111, and even the upper portion of the switch 114. The lower body 530 may cover the vortex adaptor 113. The bulk width of the vortex adaptor 113 is smaller than a top portion of the vortex adaptor 113, such that a gap is formed inside the outer casing 110 and between the vortex adaptor 113 and the outer casing 110. This gap allows air to travel from the bottom upward and into a mixing chamber of the vortex adaptor 113. The outer casing 110 may also have a thread 540 on its outer surface for detachably installing the liquid saving device 100 on other structures, such as a threaded wall or a threaded ceiling.

In the following paragraphs, respective detailed features and functionalities of the primary components of the liquid saving device 100, which includes any of the liquid guide 111, the vortex adaptor 113, and/or the switch 114, and any combination thereof will be respectively described.

Liquid Guide

Figure 3:
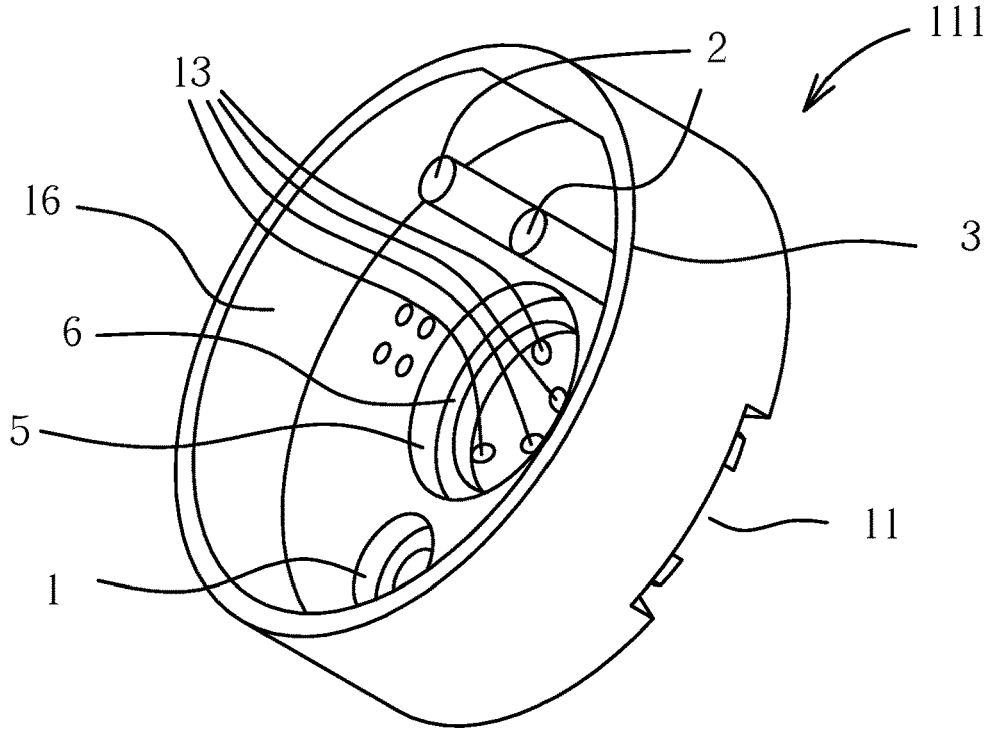
FIG. 3 illustrates a stereogram that shows mostly an upper side of the liquid guide.
Figure 4:
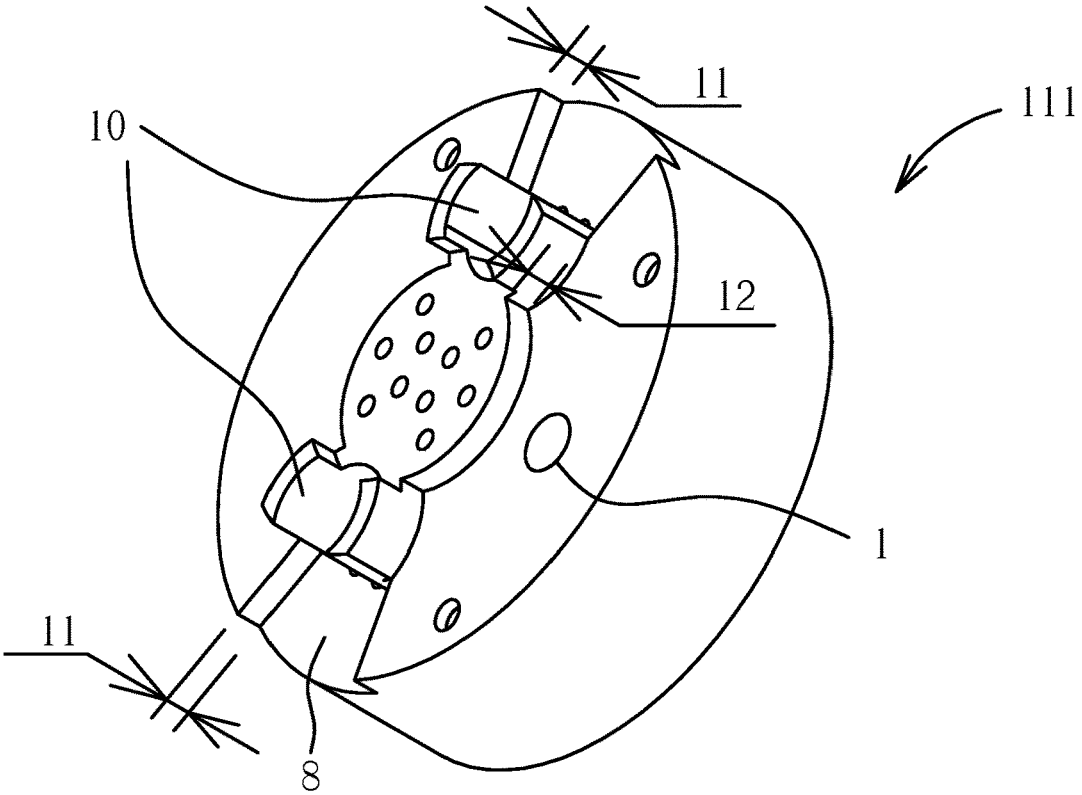
FIG. 4 illustrates a stereogram that shows mostly a lower side of the liquid guide.
Figure 5:
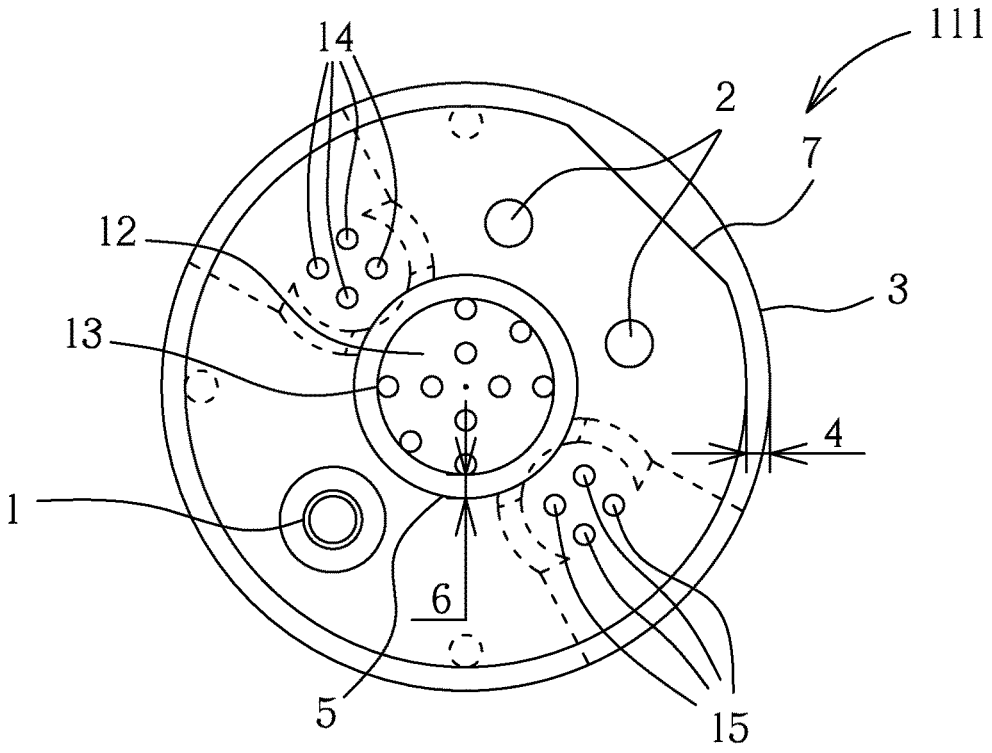
FIG. 5 illustrates a top view of the liquid guide.
Figure 6:
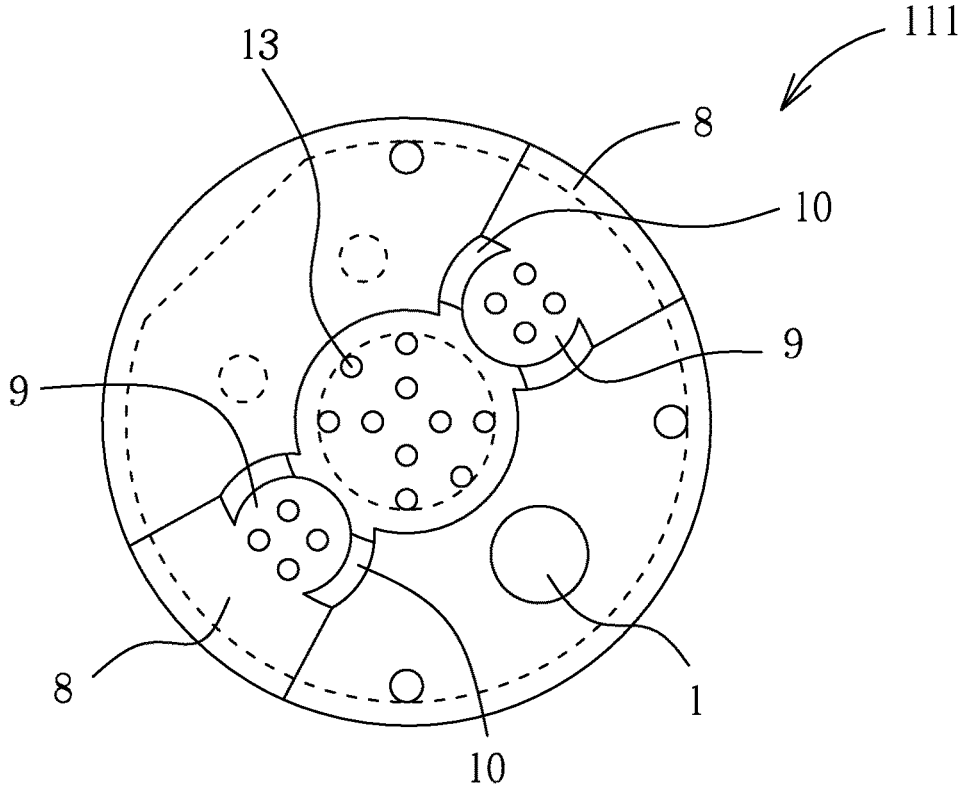
FIG. 6 illustrates a bottom view of the liquid guide.

FIGS. 3-6 illustrates more details of the liquid guide 111 according to one example of the present disclosure. More specifically, FIG. 3 illustrates a stereogram that shows mostly an upper side of the liquid guide 111. FIG. 4 illustrates a stereogram that shows mostly a lower side of the liquid guide 111. FIG. 5 illustrates a top view the liquid guide 111. And FIG. 6 illustrates a bottom view the liquid guide 111.

The liquid guide 111 includes, for example, a hole 1, at least one restrictor 2, an outer sidewall 3, a ring 4, a recess 5, an indentation 6, an alignment surface 7, at least one air inlet hole 8, and at least one secondary liquid inlet hole 14 and 15. The liquid guide 111 may also include an internal recess 16 for holding and fitting the rubber gasket 117.

Via the hole 1, the switch 114 can be inserted into the liquid guide 111.

The at least one restrictor 2 limits the cover piece 116's motion for controlling the liquid saving device 100's liquid flow rate and type of output while the liquid passes through the liquid saving device 100. In one example, the at least one restrictor 2 includes multiple vertical structures, as shown in FIG. 3. In some examples, the shape of the at least one restrictor 2 can fit a variety of different geometries as long as the at least one restrictor 2 is capable of restricting the cover piece 116's lateral motion. In this way, the cover piece 116 restricts the liquid flow no matter which geometric shape that the at least one restrictor 2 applies. In some example, the diameter of the at least one restrictor 2 is approximately 1 centimeter (cm). For faucet applications of the liquid saving device 100, the at least one restrictor 2's diameter is approximately between 19 millimeters (mm) to 21 mm. In some examples, the at least one restrictor 2's outer diameter is well designed to fit a connector that connects the at least one restrictor.

The ring 4 is disposed under the rubber gasket 117 for supporting the rubber gasket 117 to prevent fluid leakage. In some examples, the ring 4's dimension is greater than 0.8 mm.

The recess 5 is disposed within the liquid guide 111. In some examples, the recess 5's diameter is approximately between 3 mm and 12 mm.

The indentation 6 is located at the bottom of the recess 5. Also, the indentation 6 has at least one pore 13 at its bottom for inletting liquids. In some examples, the indentation 6 holds a resistive plate 122 shown in FIG. 1 for limiting a flow rate of liquids flowing through the at least one pore 13. In some examples, the at least one pore 13 is arranged in at least one array for adjusting different flow rates of the liquids.

The alignment surface 7 is disposed within the internal recess 16. In some examples, the alignment surface 7 aligns with at least one external structure that intends to fit within the internal recess 16. In this way, the liquid guide 111 may function with the alignment surface 7.

The at least one air inlet hole 8 is disposed on the bottom side of the liquid guide 111, but also shaded by the ring 4, as shown in FIG. 6. In some examples, the at least one air inlet hole 8 is shaped to be a slit. In examples of the present disclosure, a number of the utilized at least one air inlet hole 8 can be adjusted, as long as the liquid guide 100 can achieve desired aeration level. In some examples, the at least one air inlet hole 8 is shown as indentations on the liquid guide 111. However, in some other examples, when the at least one air inlet hole 8 is assembled together with the vortex adaptor 113, the top surface of the vortex adaptor 113 seals the bottom of the at least one air inlet hole 8 and then forms slits, as illustrated for example in reference to FIGS. 20 and 21, discussed further below.

The at least one secondary liquid inlet hole 14 includes at least one corresponding pit 9 on its bottom side. In some examples, at least one pit 9 has different heights, which are ranged approximately between 1 mm and 15 mm. The at least one pit 9 allows enough room for the injected liquid to spin and mix with air without been splashed out through the at least one air inlet hole 8.

In some examples, the liquid guide 111 has at least one guiding structure 10, which focuses the liquid jet that flows out of the at least one secondary liquid inlet hole 14 and 15. The guiding structure 10 is optional if the jet streams are straight and does not affected by other streams going in different directions. The at least one air inlet hole 8 has a depth 11. The depth 11 is large enough to allow the air to flow into the liquid guider 111 and then the vortex adaptor 113. In some examples, but the depth 11 is approximately between 0.5 mm and 2 mm.

The liquid guide 111 includes a mid-extended structure 12 that protrudes in its back side, as shown in FIG. 4. Also, the mid-extended structure 12 has at least one pore 13 that inlets liquids. The mid-extended structure 12's shape is important because it affects how the jet streams generated through the at least one pore 13 interact with the vortex adaptor 113. The thickness of the mid-extended structure 12 at different regions also affect how the mid-extended structure 12, which is also a flexible membrane element, deflects under pressure. Thinner regions of the mid-extended structure 12 deflects more than thicker regions of that, and therefore generates jet streams of various directions in a controlled manner. In some examples, the at least one pore 13 may shape into a pattern. The shaped pattern of the at least one pore 13 together with the depth variation of the mid-extended structure 12 generates a desired micro-stream output flow at the at least one pore 13's output terminal.

In some examples, the shaped pattern of the at least one pore 13 may be a cone spray that expands outward in the liquids' direction of travel. The spray may include of streams of droplets generated due to the joining of "deflected" and the "straight" streams. Deflected stream and straight streams are general terms that refers to the relative direction of the streams. The at least one secondary liquid inlet holes 14 and 15 generate the jet stream that makes up the vortex stream. In some examples, the at least one secondary liquid inlet hole 14 and 15 includes pores with sizes approximately between 0.1 mm and 1 mm, however, the actual sizes can be adjusted depending on a desired flow rate of the liquid saving device 100. Also, the at least one secondary liquid inlet hole 14 and 15 may include multiple holes that functions with just one hole or more. The spacing between the at least one secondary liquid inlet hole 14 and 15 is helps to prevent streams from immediately merging with other streams when the jets are generated. In some examples, the spacing between the at least one secondary liquid inlet hole 14 and 15 gives enough separation such that when the fluids hits cavities within the vortex adaptor 113, the air capable of flowing in-between can gets churned into aerated streams.

The internal recess 16 is also the spacing between the rubbery gasket 117 and the top surface of the at least one secondary liquid inlet hole 14 and 15. The internal recess 16 provides enough spacing to allow a stacked assembly formed by the cover piece 116, the rubbery gasket 117 and the switch 114. In this way, the internal recess 16 also provides enough clearance to allow vertical movements of the cover piece 116.

Figure 7:
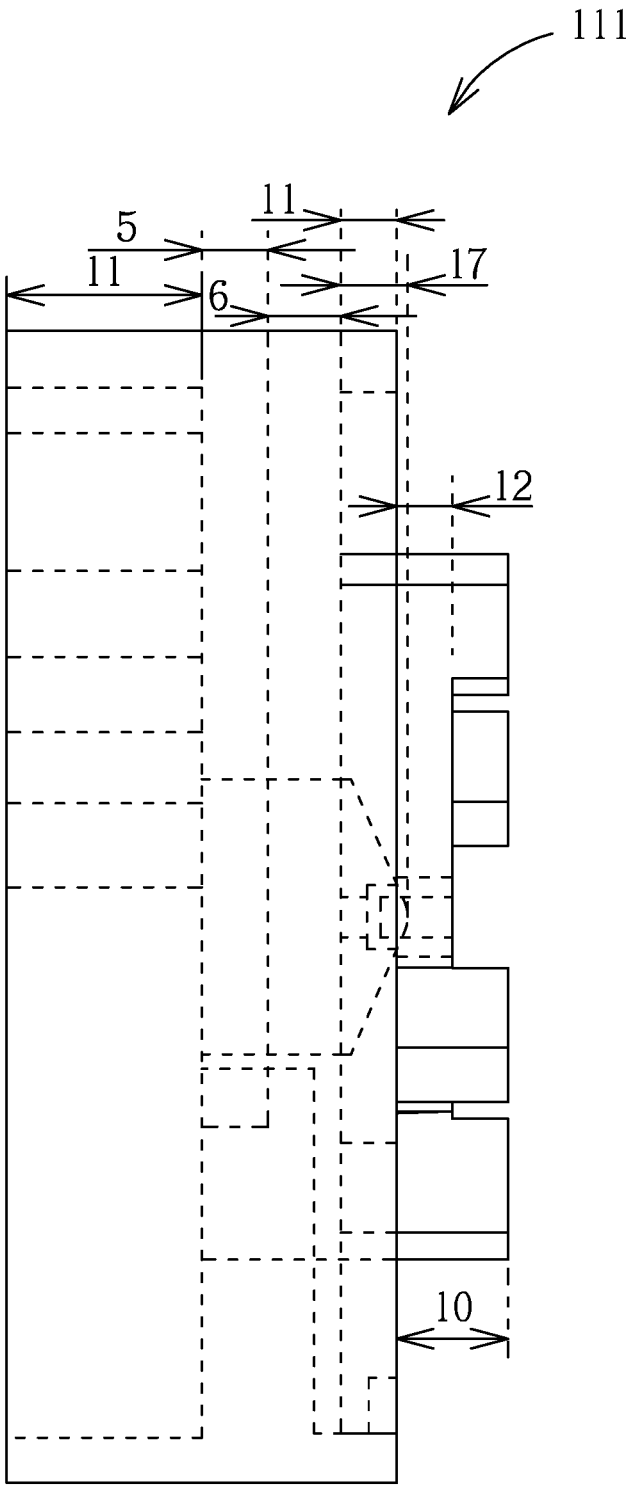
FIG. 7 illustrates a lateral view of the liquid guide to show sizes of its primary components.

FIG. 7 illustrates a lateral view of the liquid guide 111 to show sizes of its primary elements according to one example of the present disclosure. The liquid guide 111 may include a sloped structure 17 disposed between the highest point of the at least one pore 13 to the top of the lowest position of the at least one pore 13. In some examples, the sloped structure 17's shape may include a slope structure, a stair like structure, a round structure and other shape as long as such shape provides a difference in the depth of the at least one pore 13. Such depth difference allows certain part of the liquid guide 111 to bend more than others when under pressure. The bending changes the direction so the streams that when synchronized achieves the desired droplet spray output. In some examples, the sloped structure 17 can extend downward from the bottom of the at least one pore 13 to create an inverted sloped structure, an inverted stair like structure, and other shape as long as such shape provides a difference in the depth of the at least one pore 13.

Figure 8:
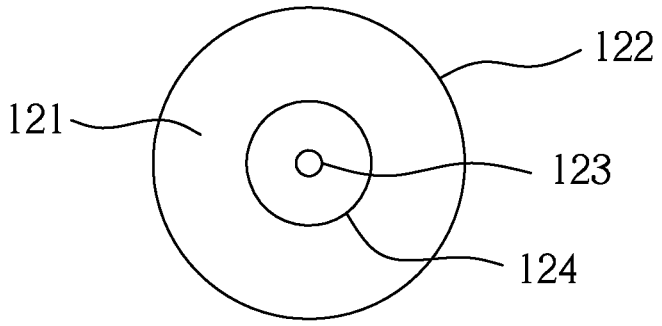
FIG. 8 illustrates a top view of a plug.
Figure 9:
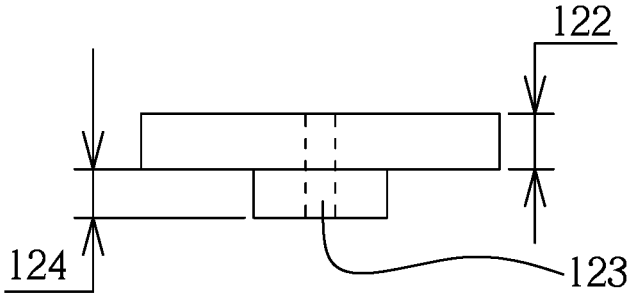
FIG. 9 illustrates a lateral view of a plug.
Figure 10:
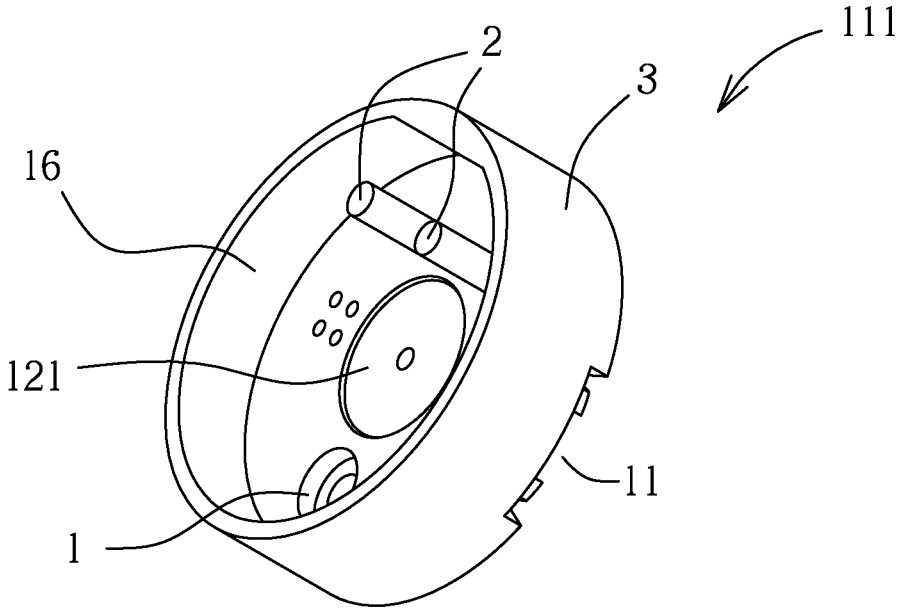
FIG. 10 illustrates how the plug is held by the liquid guide for limiting liquid flow through the at least one pore.

As shown in FIG. 1, the liquid guide 111 may further include a plug 121, which serves to better limit the liquid flow through the at least one pore 13, i.e., limiting the liquids' flow rate. FIGS. 8-10 show details about the plug 121 according to one example of the present disclosure. More particularly, FIG. 8 illustrates a top view of the plug 121. FIG. 9 illustrates a lateral view of the plug 121. And FIG. 10 illustrates how the plug 121 is held by the liquid guide 111 for limiting liquid flow through the at least one pore 13.

The plug 121 includes a body 122, an inlet through hole 123, and an extended portion 124. When the plug 121 is fully assembled, e.g., inserted, to the liquid guide 111 as shown in FIG. 10, the body 122 sits on the indentation 6 with its circular edge. In some examples, the inlet through hole 123's diameter is approximately between 0.5 mm and 1.5 mm, and its depth ranges approximately from 1 mm to 3 mm. With the aid of the plug 121, the liquid guide 111 may form at least one micro stream at the inlet through hole 123's bottom since the plug 121 additionally limits the inlet liquids' flow rate.

Figure 11:
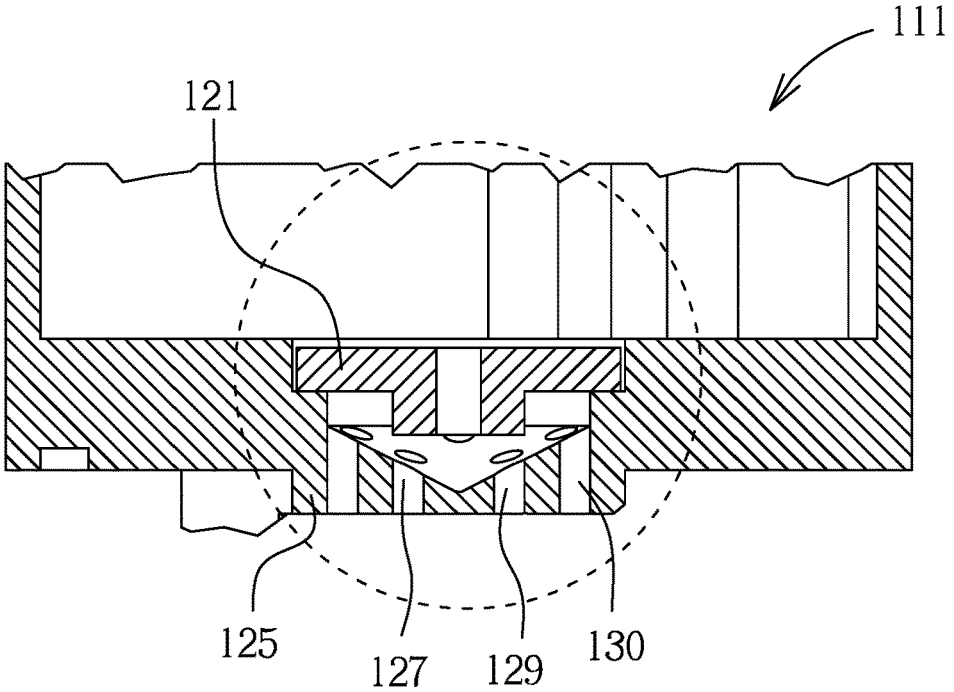
FIG. 11 shows an exemplary distribution of the at least one pore while being covered by the plug according to one example of the present disclosure.

FIG. 11 shows an exemplary distribution of the at least one pore 13 while being covered by the plug 121 according to one example of the present disclosure. The plug 121 and the liquid guide 111 generate a droplet spray output pattern at the bottom of the liquid guide 111. The droplet spray is produced by controlled interaction of individual streams from the liquid guide 111. Normally the streams through straight pores will travel in a straight line. However, the designated streams of the liquid guide 111 that holds the plug 121 will change direction when under pressure. The shift in stream direction will force the designated streams to interact with the straight streams. The interaction of the streams will generate a pulsed droplet streams that expands outwards while traveling downwards.

Figure 12:
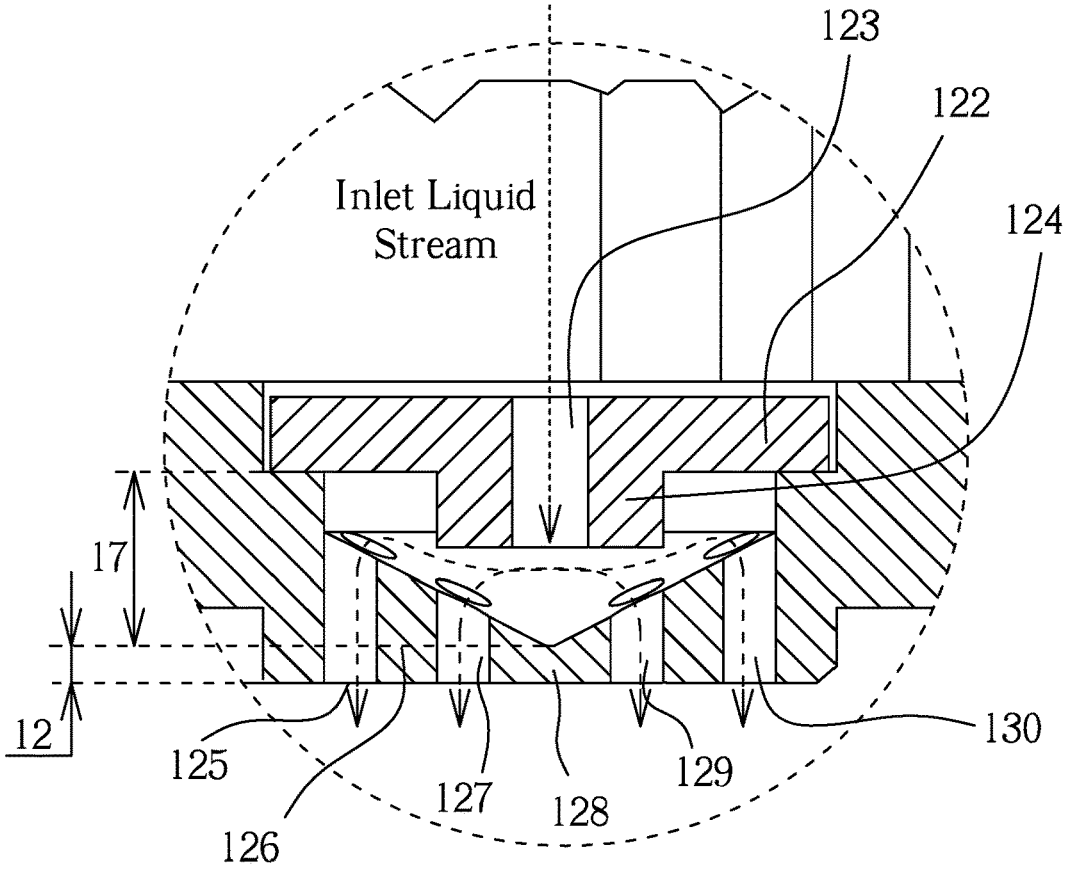
FIG. 12 illustrates an exemplary diagram showing how an under-pressure inlet liquid stream changes its direction in the liquid guide according to one example of the present disclosure.

FIG. 12 illustrates an exemplary diagram showing how an under-pressure inlet liquid stream changes its direction in the liquid guide 111 according to one example of the present disclosure. The at least one pore 13 may include multiple pores 125, 127, 129 and 130. As illustrated in FIG. 12, the pore 125 is deeper and has a greater length than the pore 127, such that an output stream from the pore 127 will change direction more than another output stream from the pore 125 when the inlet liquid stream is under pressure. In this way, the output stream from the pore 127 travels towards the output stream from the pore 125, and interaction of both the output liquid streams produces a spray output. Assume that the pores 125 and 127 are separated by a block 126, whose width is approximately between 0.5 mm to 2 mm in some examples. Similarly, assume a block 128 forms a gap between the edges of ring that contains the pores 127 and 129, where the block 128 has a width of approximately between 0.5 mm to 10 mm in some examples. Also, the pores 125, 127, 129 and 130 may share a size of approximately between 0.5 mm and 1.5 mm in some examples. A size of the inlet through hole 123 is approximately between 1 mm and 3 mm in some examples. In addition, the mid-extended structure 12 has a material thickness that controls the bending of the pores 125, 127, 129 and 130. In some examples, a depth of the mid-extended structure 12 is approximately between 0.3 mm and 1.5 mm. In some examples, the depth of the sloped structure 17 is approximately between 0.5 mm and 1.5 mm. The abovementioned dimensions related to FIG. 12 can be adjusted according to requirements of the size of the liquid saving device 100, a desired flow rate, and a desired output stream style in some examples.

In some examples, the pores 125, 127, 129 and 130 may respectively indicate a collection of pores that is represented by the relative location to each other with respect to FIG. 11. In one example, the pore 125 may be replaced by a ring of eight pores that are closer to the edge of the indentation 6 than the ring 4 of four pores represented by the bores 127 and 129. In some examples, the sloped structure 17 is a wedge-shape cavity. Also, the sloped structure 17 can be of other shapes as long as the sloped structure 17 forms a difference in different regions on the flexible mid-extended structure 12's thickness, therefore facilitates the bending of the flexible mid-extended structure 12, then creates a change in direction of the output streams, and at last forms the desired spray output.

Figure 13:
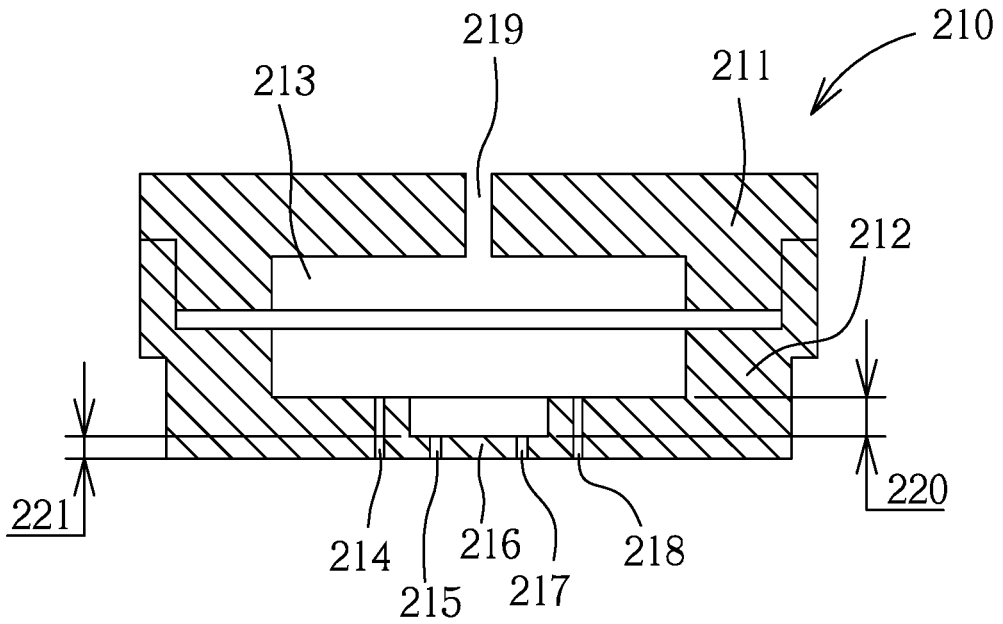
FIG. 13 shows a lateral view of a liquid guide that has one spray generation mechanism present.
Figure 14:
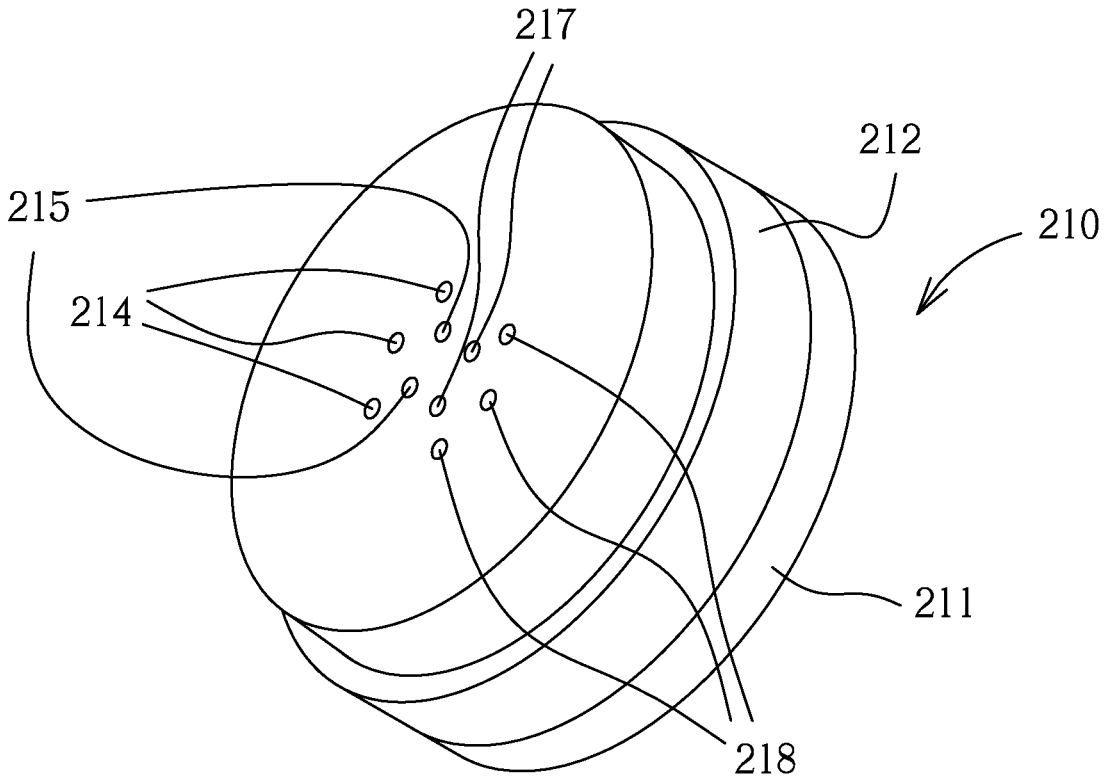
FIG. 14 shows a stereogram of the liquid guide from FIG. 13 in a backside view.

FIGS. 13-14 shows a micro-spray design of a liquid guide 210 that represents another example of the liquid guide 111 according to one example of the present disclosure. More particularly, FIG. 13 shows a lateral view of the liquid guide 210. And FIG. 14 shows a stereogram of the liquid guide 210 in a backside view.

The liquid guide 210 includes an upper piece 211 and a bottom piece 212. The upper piece 211 and the bottom piece 212 together encloses a cavity 213. The upper piece 211 includes an inlet pore 219 for controlling an input flow rate of the liquid guide 210. The bottom piece 212 includes at least one output pores 214, 215, 217 and 218. The bottom piece 212 also includes a center ring block 216 that separates the bores 215 and 217. A depth of the inlet bore 219 indicates the shortest pore depth among the output pores 214, 215, 217 and 218. Also, a depth 220 indicates an extra pore length among the output pores 214, 215, 217 and 218. A depth difference between the depths 219 and 220 allows the output pores 214, 215, 217 and 218 to change corresponding output stream directions differently when the inlet liquid stream through the inlet pore 219 exerts pressure onto the bottom piece 212. It is noted that the output bores 214 and 218 are representative of the outer pore ring centered at the center ring block 216. And the output pores 215 and 217 are representative of the inner pore ring, i.e., the center ring block 216. In comparison to the combination of the liquid guide 210 and the plug 121, the liquid guide 210 has a ladder-shape cavity 213 instead of a wedge, and such disposition introduces smoother output streams.

Figure 15:
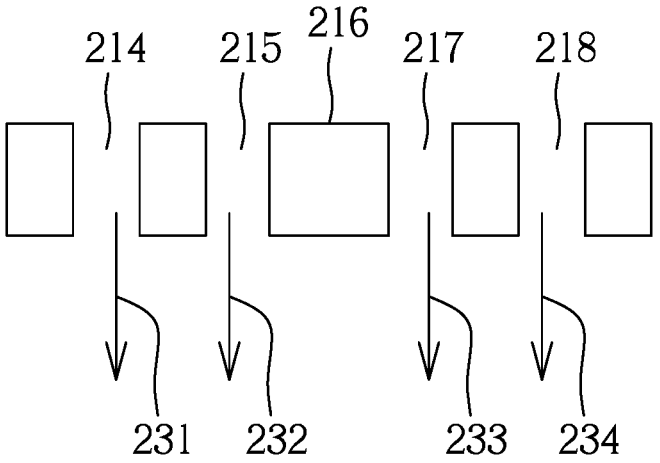
FIG. 15 shows how output streams interact before the center block is under pressure of the inlet liquid stream.
Figure 16:
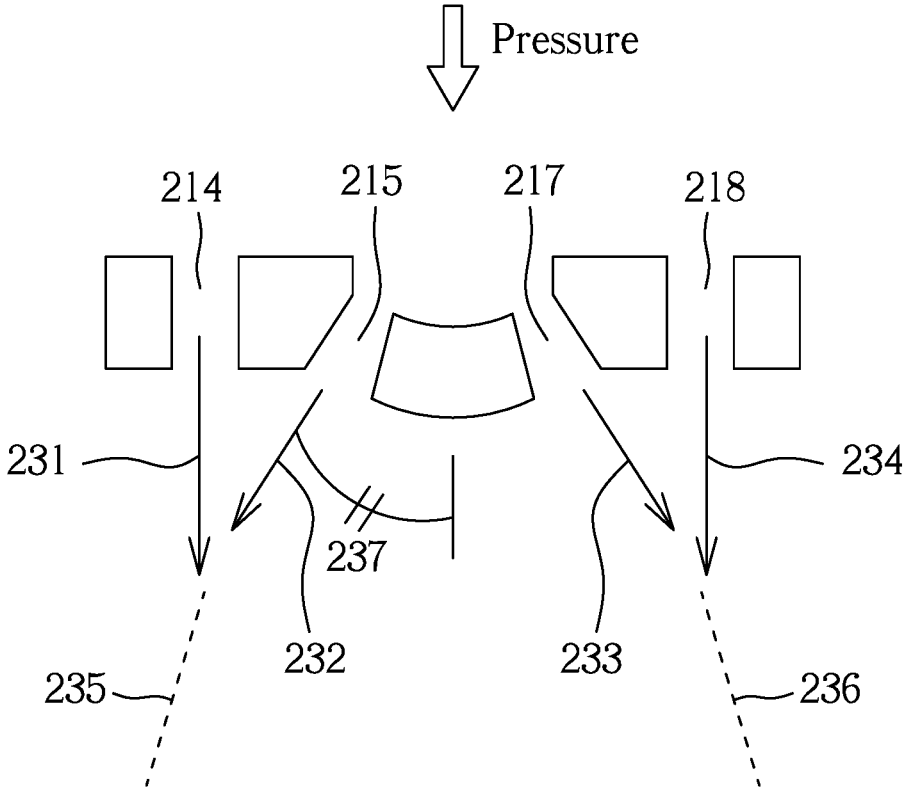
FIG. 16 shows how output streams interact after the center block is under pressure of the inlet liquid stream according to one embodiment of the present disclosure.

FIGS. 15-16 illustrates the difference of how output streams of the liquid guide 210 interact with each other under different circumstances according to one example of the present disclosure. More particularly, FIG. 15 shows how output streams interact before the center block 216 is under pressure of the inlet liquid stream, and FIG. 16 shows how output streams interact after the center block 216 is under pressure of the inlet liquid stream.

The pores 214 and 218 correspondingly generate output streams 231 and 234 at an outer ring. The pores 215 and 217 correspondingly generate output streams 232 and 233 at an inner ring. When driven under pressure from the inlet liquid stream, the pores 215 and 217 are pushed to point outward. Such that the output stream 232 changes its direction (e.g., by a deflection angle 237 from its original orientation) and shoots toward the output stream 231, and similarly, the output stream 233 changes its direction and shoots toward the output stream 234. The interaction of the output streams 232 and 231 generates a droplet stream 235. Similarly, the interaction of the output streams 233 and 234 generates a droplet stream 236. Both the droplet streams 235 and 236 are smoother than respectively corresponding output streams and even the inlet liquid stream in flow rate.

Vortex Adaptor

Figure 17:
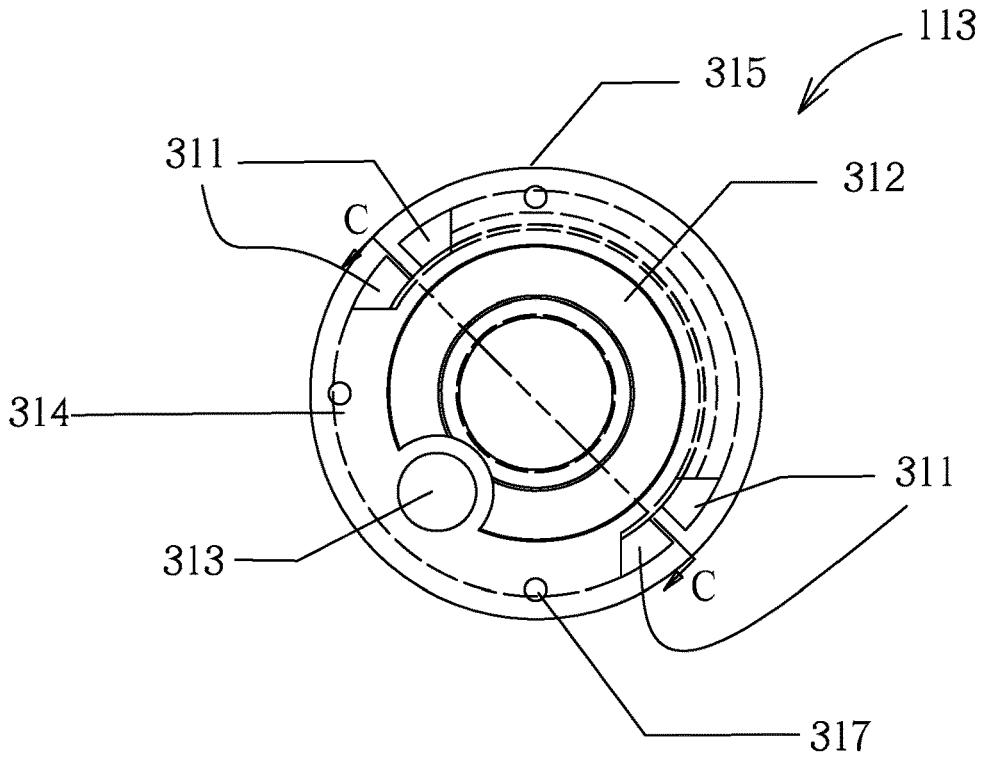
FIG. 17 illustrates a top view of the vortex adaptor.
Figure 18:
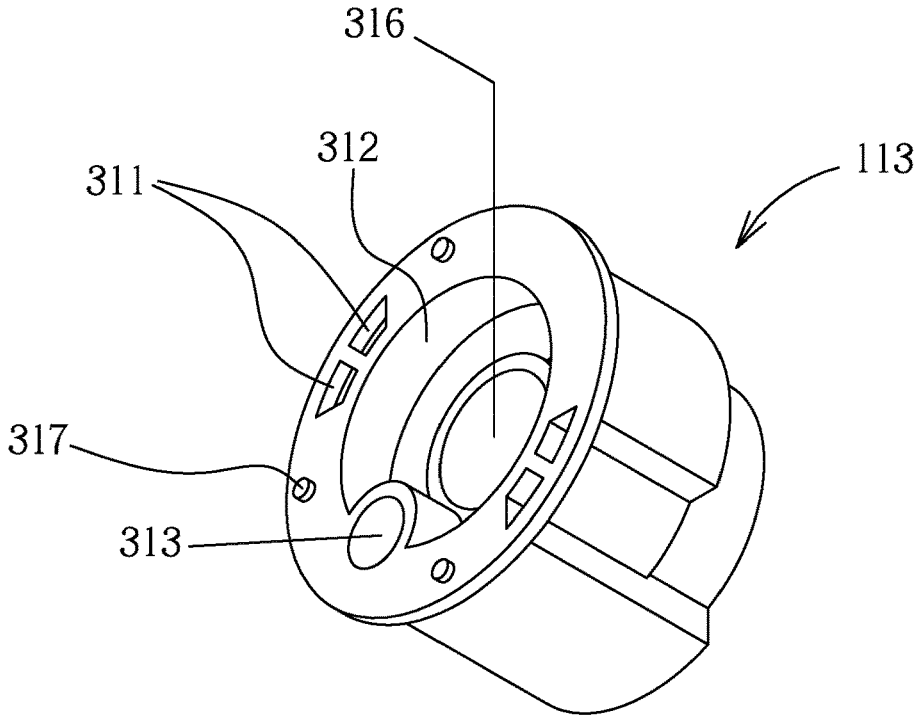
FIG. 18 illustrates a stereogram of the vortex adaptor in a topside view.
Figure 19:
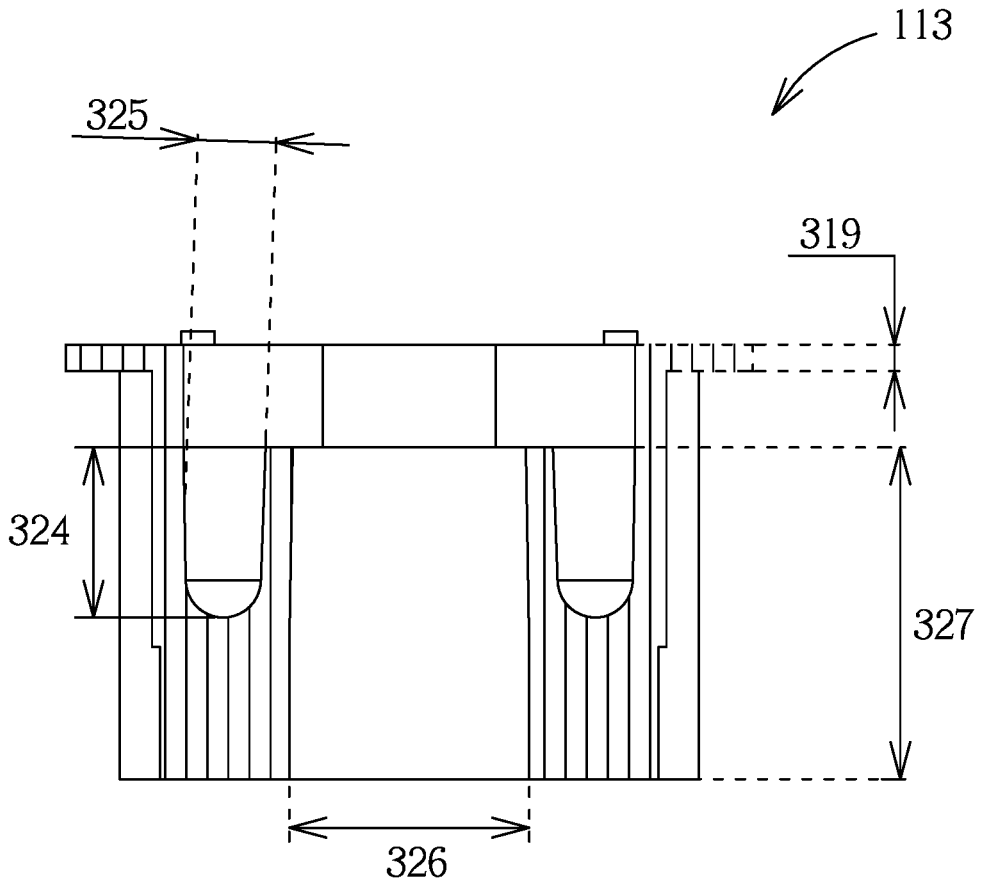
FIG. 19 illustrates a lateral view of the vortex adaptor along a section line shown in FIG. 17.

FIGS. 17-19 shows details of the vortex adaptor 113 according to one example of the present disclosure. More particularly, FIG. 17 illustrates a top view of the vortex adaptor 113. FIG. 18 illustrates a stereogram of the vortex adaptor 113 in a topside view. FIG. 19 illustrates a lateral and perspective view of the vortex adaptor 113 along a section line C-C shown in FIG. 17.

The vortex adaptor 113 may include at least one air inlet hole 311, a trench 312, a switch receiving hole 313, a center through hole 314, an outer ring 315, a gap 316, and an alignment structure 317.

Figure 20:
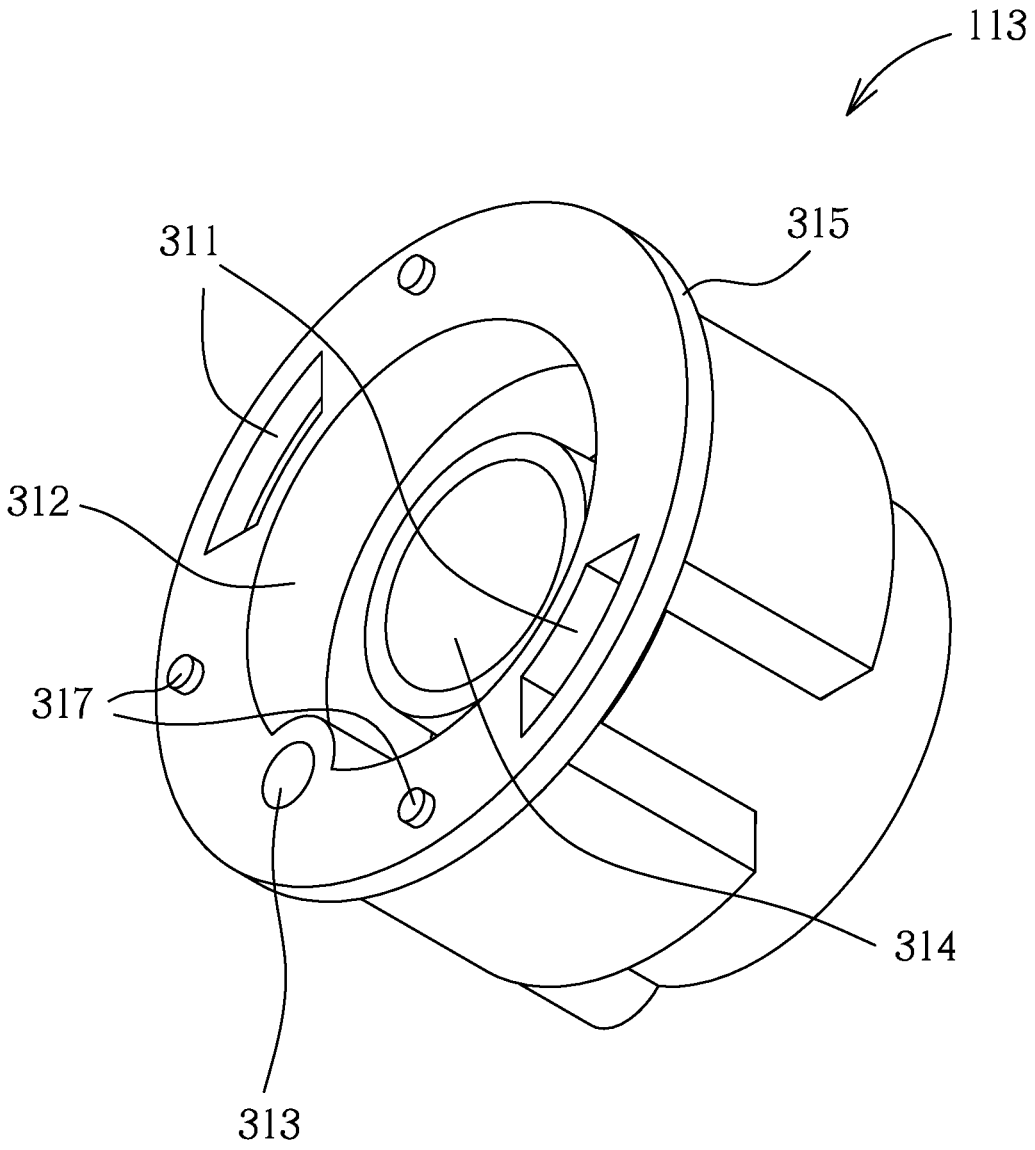
FIG. 20 illustrates an exemplary diagram that the vortex adaptor applies a single air inlet hole on the two sides of the vortex adaptor.
Figure 21:
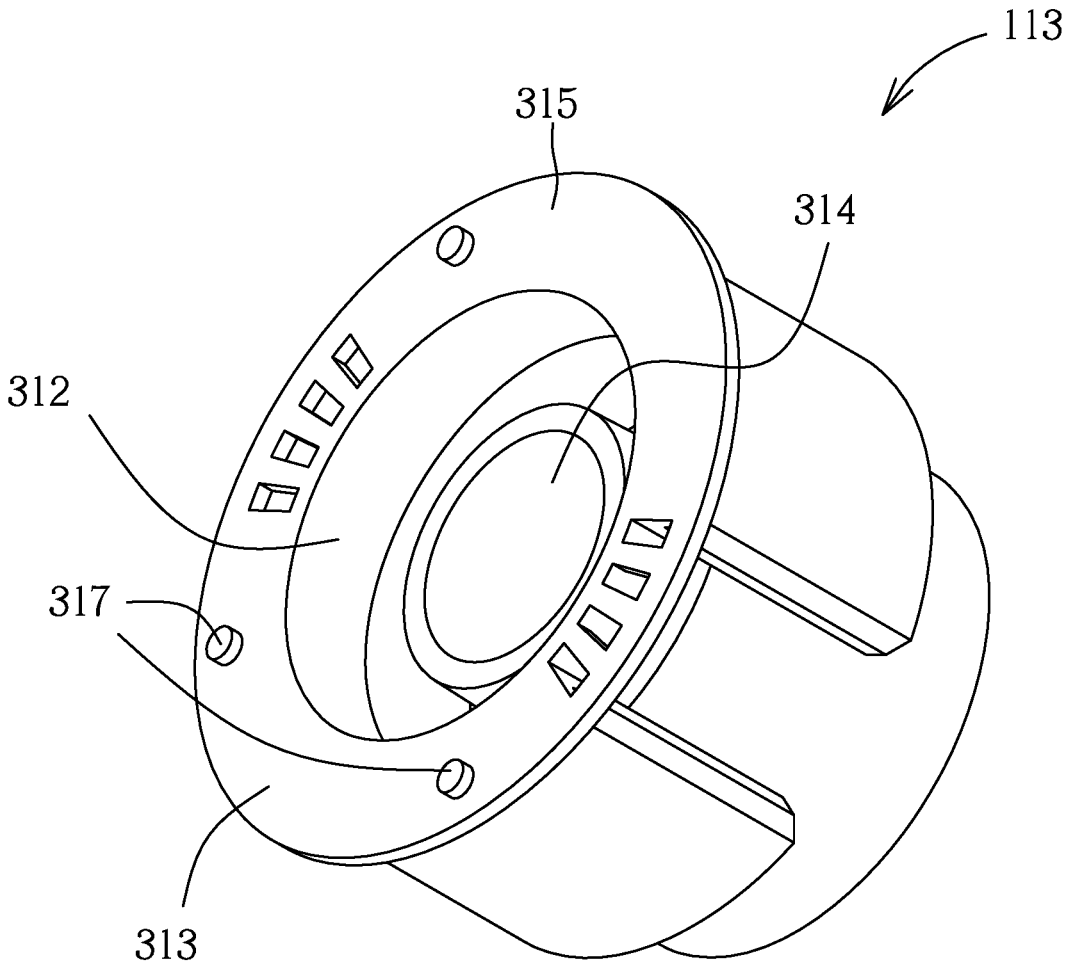
FIG. 21 illustrates an exemplary diagram that the vortex adaptor applies four air inlet holes on the two sides of the vortex adaptor.

The at least one air inlet hole 311 allows air stream to interact with output liquid streams from the liquid guide 111 (or the liquid guide 210). In some examples, a number of the air inlet holes 311 can be adjusted. Also, in some examples, the at least one air inlet hole 311 is positioned symmetrically or asymmetrically to each other. For example, FIG. 20 illustrates an exemplary diagram that the vortex adaptor 113 applies single air inlet hole 311, And FIG. 21 illustrates an exemplary diagram that the vortex adaptor 113 applies four air inlet holes 311.

The trench 312 has a curved cross-section. Also, the trench 312 allows the output liquid stream from the liquid guide 111 to spin and mix with air from the at least one air inlet hole 311, and therefore forms a primary vortex stream that will be described later (e.g. FIG. 21). In some examples, two ends of the trench 312 can be connected or disconnected (as shown in FIG. 17) to form a ring or not. Assume a depth of the trench 312 is a depth 324, and assume a width of the trench 312 is a width 325, as shown in FIG. 19.

The switch receiving hole 313 allows insertion of a switching rod of the switch 114.

The center through hole 314 allows the air-mixed streams from the trench 312 to form at least one secondary vortices. Assume that the center through hole 314's diameter is a diameter 326, and that the center through hole 314's length is a length 327.

Figure 22:
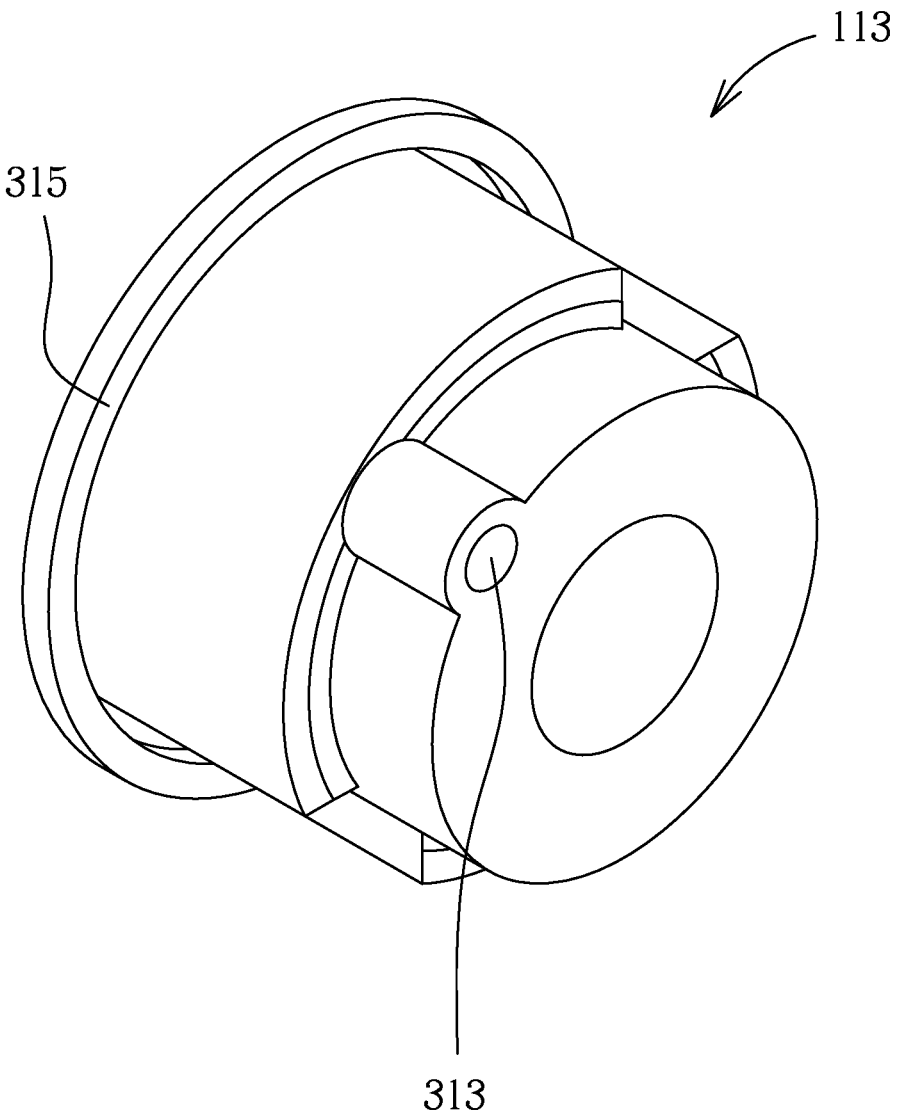
FIG. 22 shows a stereogram of the vortex adaptor in its backside view.

The outer ring 315 fits within the outer casing 110 for faucet applications. In some examples, the outer ring 315's diameter is approximately between 10 mm and 30 mm. Assume a thickness of the outer ring 315 is a thickness 319. For clearer illustration, FIG. 22 further shows a stereogram of the vortex adaptor 113 in its backside view. Also, the center through hole 314 penetrates outward the vortex adaptor 113's backside for outputting an aerated flow or spray.

The alignment structure 317 orients the liquid guide part 111 with the vortex adaptor 113.

The gap 316 is formed within the center through hole 314. Also, the gap 316 provides enough room for the primary vortex to travel from the trench 312 toward the center through hole 314 without suppressing the primary vortex's flow. When the flow is suppressed by the gap 316 of a smaller size, a resulting bubble becomes smaller. In some examples, the gap 316's size is approximately between 0.5 mm and 3 mm.

As shown in FIG. 19, the depth 324 of the trench 312 is required to be long enough to allow liquid streams to spins forming a primary vortex within the trench 312 and to allow the air to get mixed into the primary vortex within the trench 312. In some examples, the depth 324 is approximately greater than 1 mm. In some examples, the width 325 of the trench 312 is approximately greater than 1 mm.

The thickness 319 of the outer ring 315 is required to provide enough material strength to allow the vortex adaptor 113 to hang inside the outer casing 110.

The length 327 of the trench 312 controls properties of the output vortex spins of the vortex adaptor 113. A shorter length 327 results in a spinning droplet spray output of the vortex adaptor 113, whereas a longer length 327 stabilizes the output stream into a vortex stream.

In some examples, the diameter 326 of the center through hole 314 is approximately between 5 mm to 15 mm. In some examples, the shape of the outlet corresponding to current diameter 326 is not a circular bore but a rectangle, a triangle, or an ellipsoid, the vortex output can become a droplet spray if the outlet is sufficiently stretched in one dimension to form a rectangle.

How Aerated Vortex is Created

Figure 23:
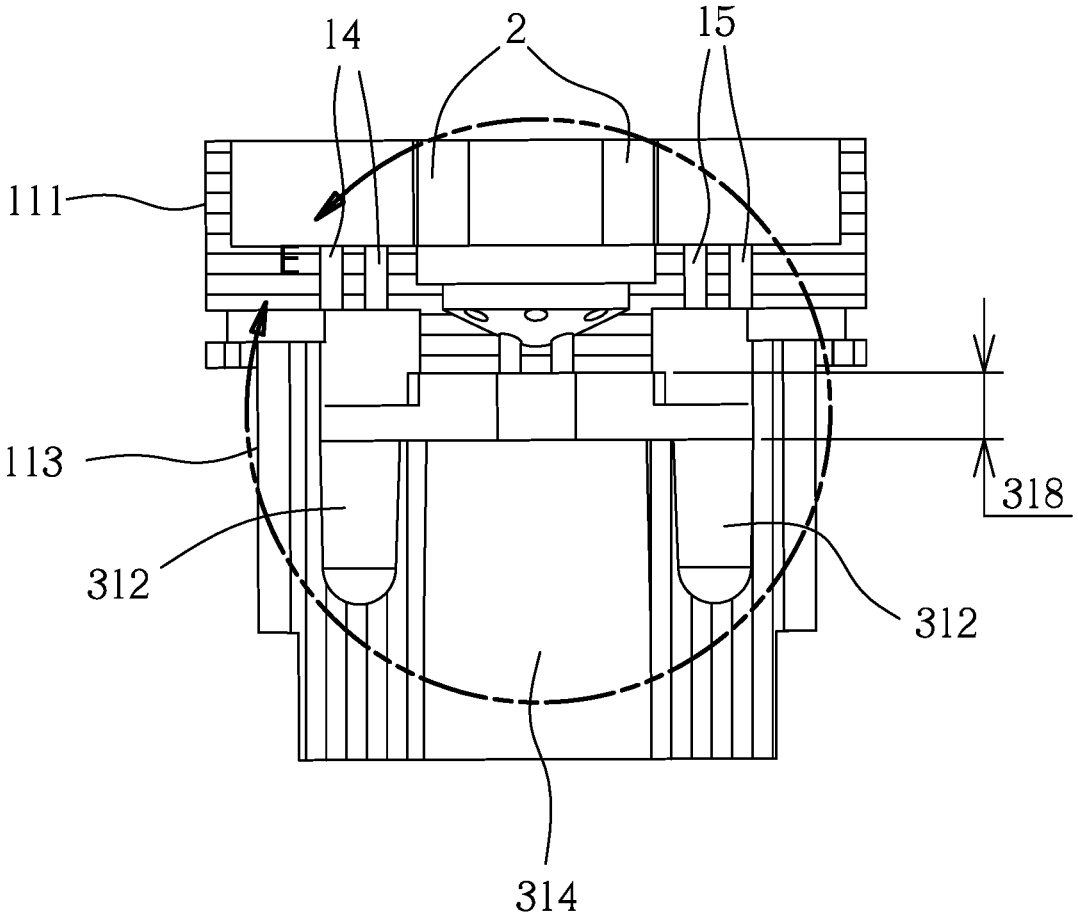
FIG. 23 illustrates the liquid saving device's elements that are involved in creation of aerated vortex and sprays according to one example of the present disclosure.
Figure 24:
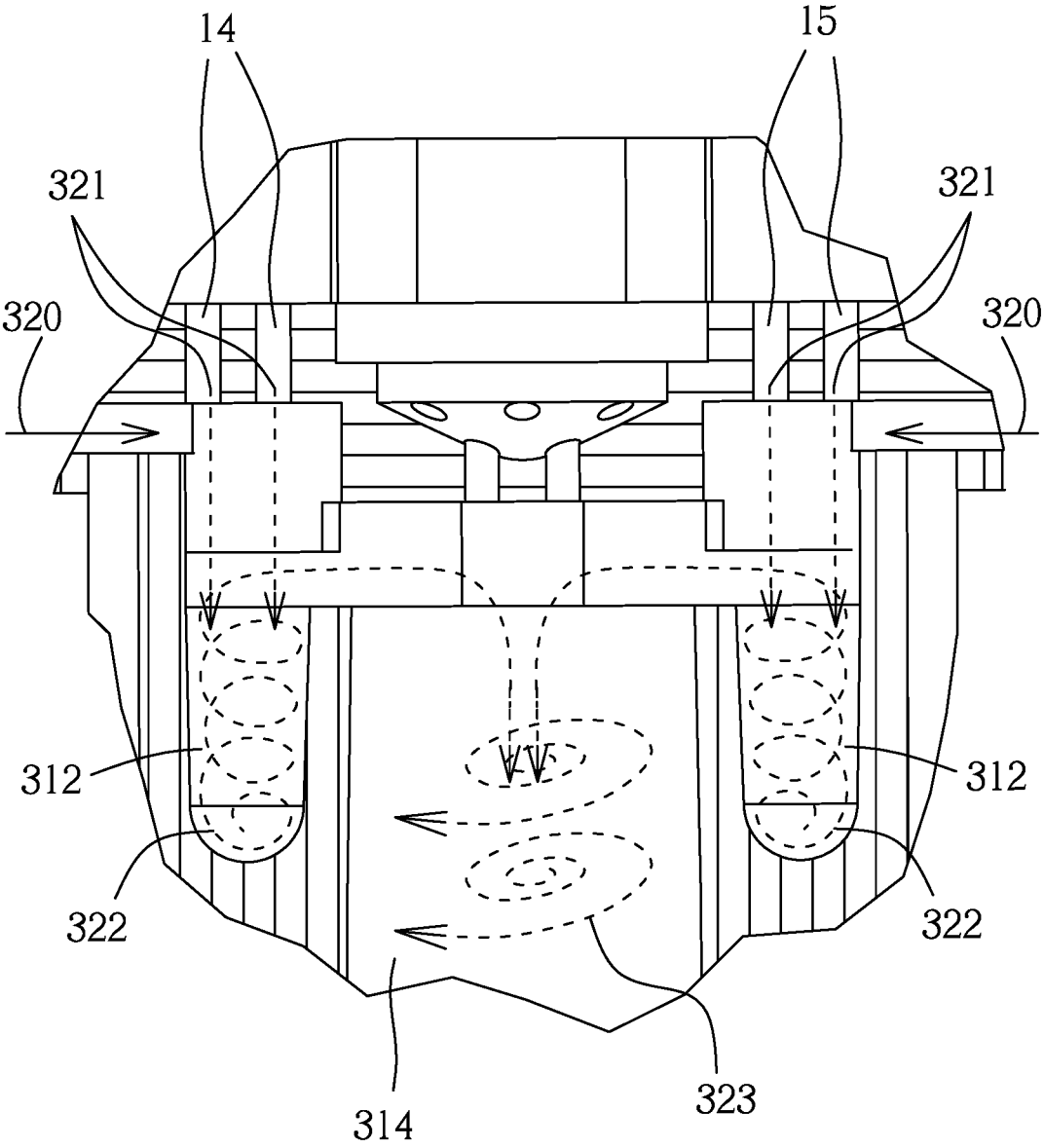
FIG. 24 illustrates generated vortexes inside the liquid saving device and aerated flows in between according to one example of the present disclosure.

FIG. 23 illustrates the liquid saving device 100's components that create an aerated vortex according to one example of the present disclosure. FIG. 24 illustrates generated vortexes inside the liquid saving device 100 and aerated flows in between according to one example of the present disclosure.

The liquid guide 111's center end point and the center through hole 314's top edge together form a spacing 318. The spacing 318 allows aerated liquid to flow and spin while moving out of the center through hole 314. The secondary liquid inlet holes 14 and 15 generate liquid jet streams 321 that travel toward the bottom of the trench 312, forms a primary vortex 322 within the trench 312, and then traps and mixes air within the primary vortex 322. The primary vortex 322 then moves upward, passes through the spacing 318, and joins other vortex streams to form at least one secondary vortex 323 while traveling through the center through hole 314.

Figure 25:
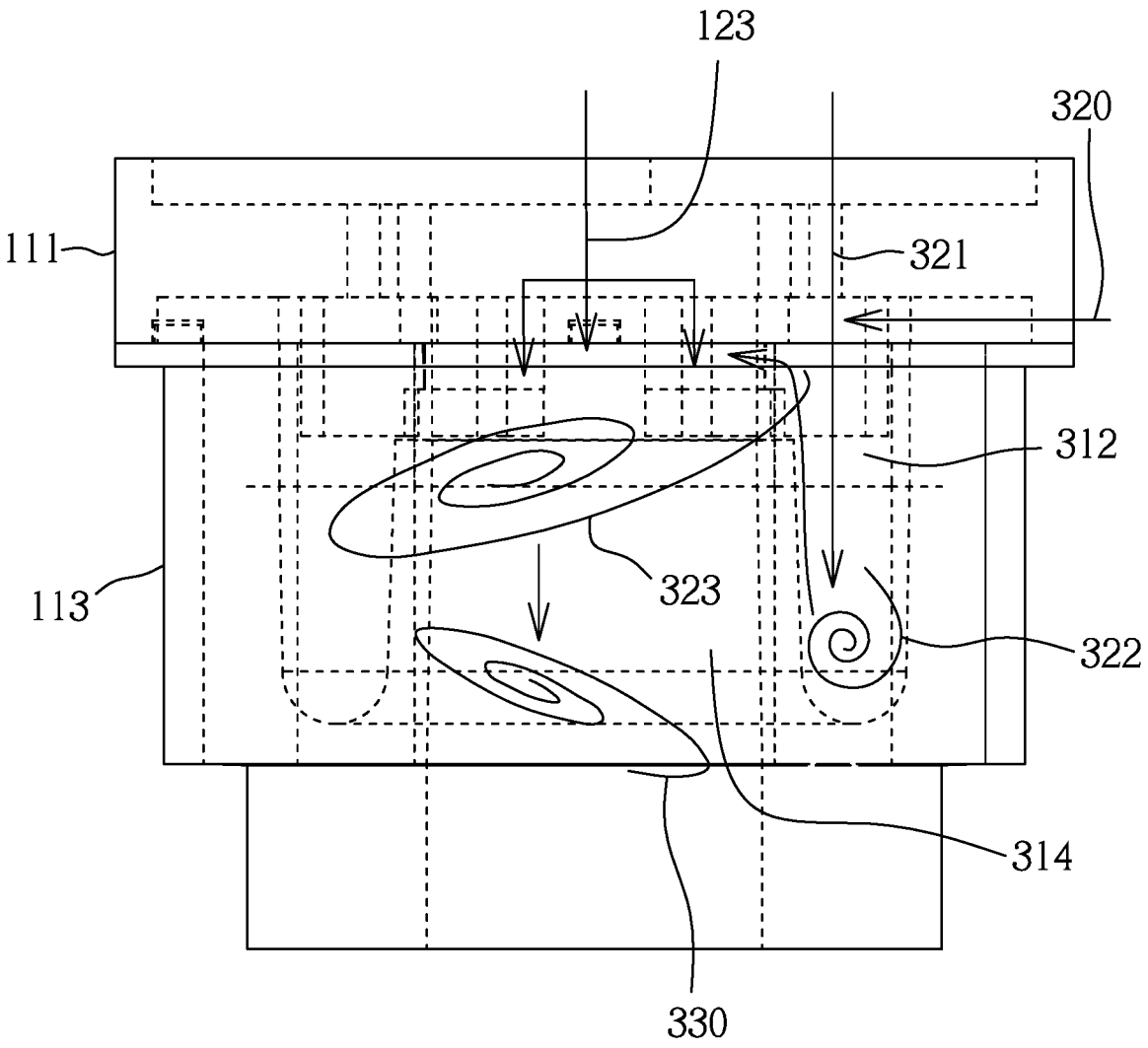
FIG. 25 illustrates a schematic flow path diagram based on FIGS. 11-12 and FIGS. 23-24 according to one example of the present disclosure.

For clearer explanation of how the vortex adaptor 113 generates the aerated vortex, FIG. 25 illustrates a schematic flow path diagram based on FIGS. 11-12 and FIGS. 23-24 according to one example of the present disclosure. First, the liquid guide 111 outputs at least one liquid stream, which includes at least one primary stream into the inlet through hole 123 and at least one secondary stream, i.e., the liquid jet stream 321 that is farer away from the vortex adaptor 113's center than the primary stream is. The liquid jet stream 321 then enters the trench 312 and mixes with air 320 to form the primary vortex 322. Note that the air 320 may be drawn by the downward-traveling liquid jet stream 321 and therefore flow into the at least one air inlet hole 8 between the liquid guide 111 and the vortex adaptor 113. A flow of the primary vortex 322 then crawls up along a vertical axis and/or a sidewall of the trench 312 and then moves towards the liquid guide 111's output stream. In this way, the flow from the primary vortex 322 mixes with the liquid guide 111's output stream and therefore forms at least one secondary vortex 323. A flow from the at least one secondary vortex 323 then moves downward and along the center through hole 314 to merge with each other and to therefore form a bigger output vortex 330 at the bottom of the center through hole 314, i.e., at the backside of the vortex adaptor 113 as shown in FIG. 25.

In some examples, a flow pattern of the output flow 330 may include a single stream, multi-stream, or a stream that immediately breaks off into multiple smaller droplets. In some examples, the output flow 330 may self-spin into droplets and allow the droplets to fly into a circular spray pattern. Such flow pattern and its corresponding flow rate can be appropriately designed by adjusting, for example, at least one width of the at least one air inlet hole 8, sizes (e.g. diameter and/or depth) of the trench 312, and/or a diameter and/or a depth of the center through hole 314. With the aid of the generation of output flow 330, injected liquid stream can be utilized in a more efficient manner without being significantly wasted.

Figure 26:
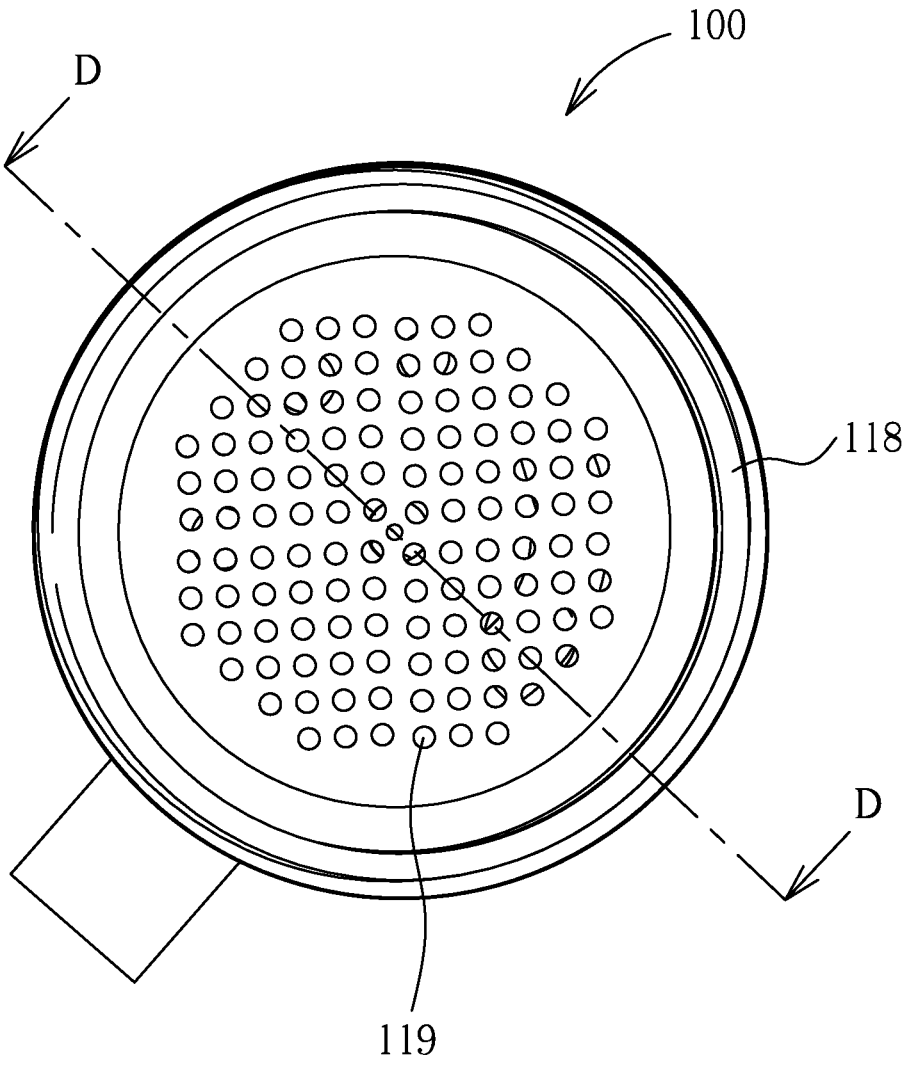
FIG. 26-29 illustrates the assembled liquid saving device capable of switching between spray output and vortex output according to one example of the present disclosure.
Figure 27:
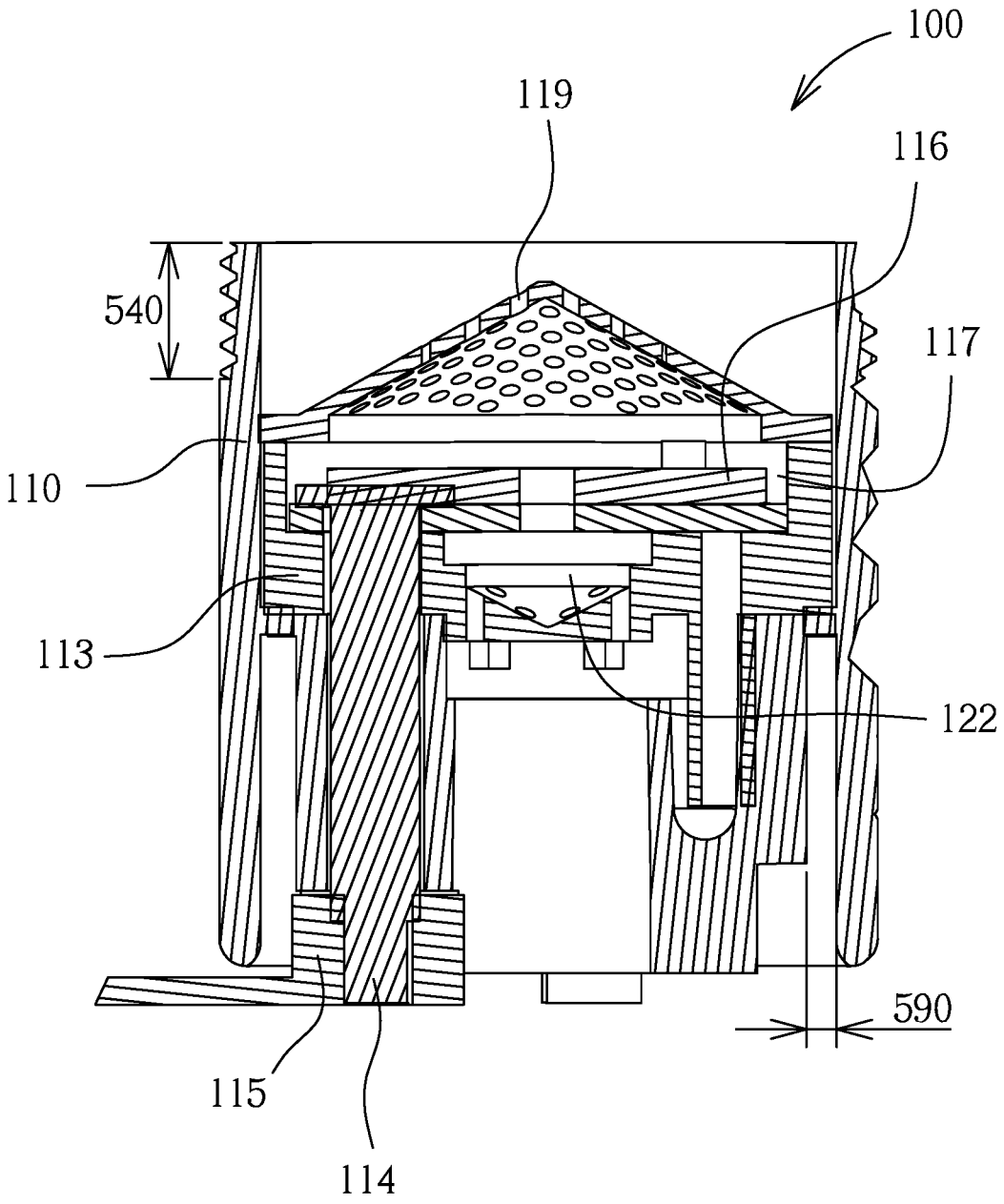
Figure 28:
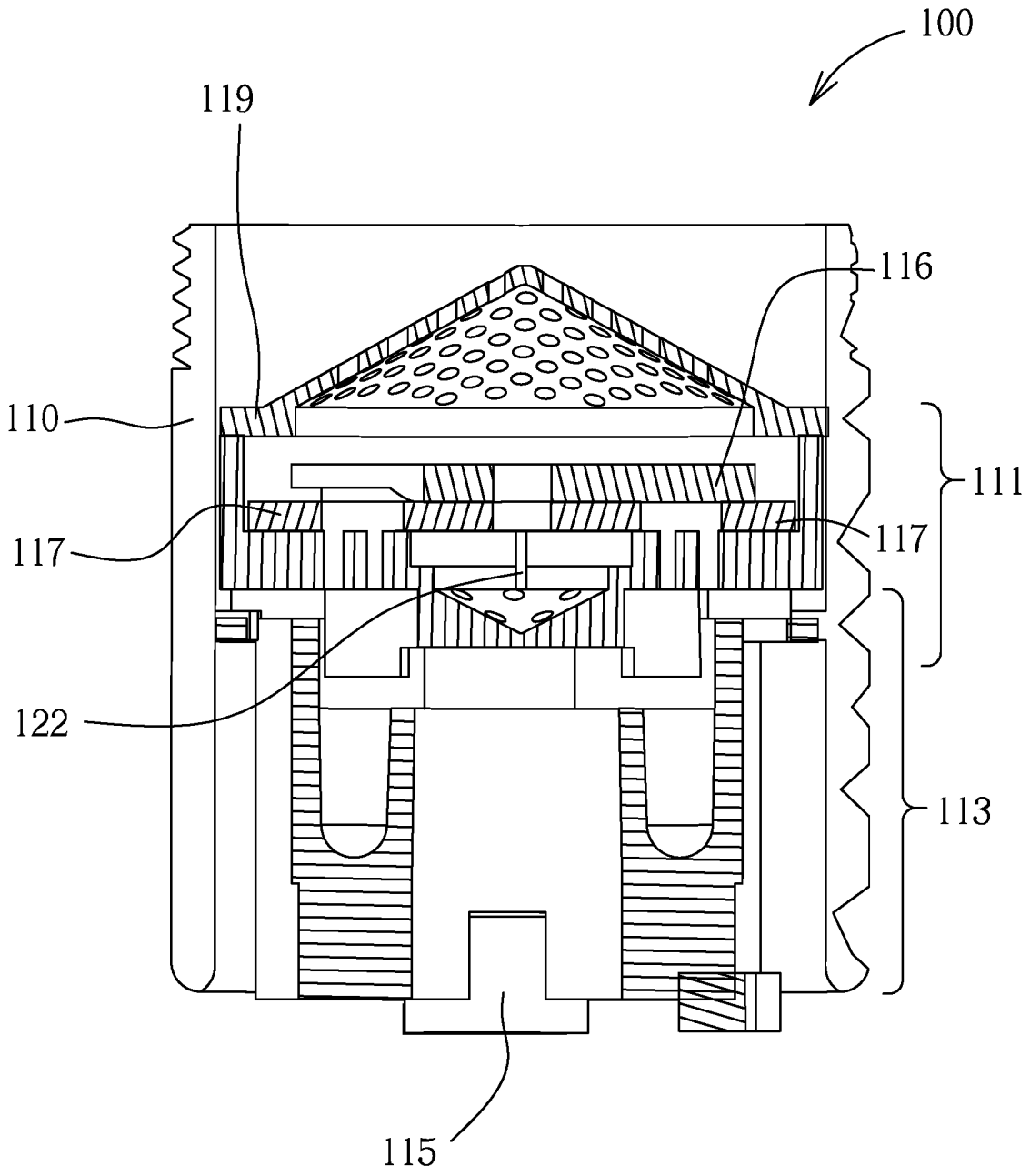
Figure 29:
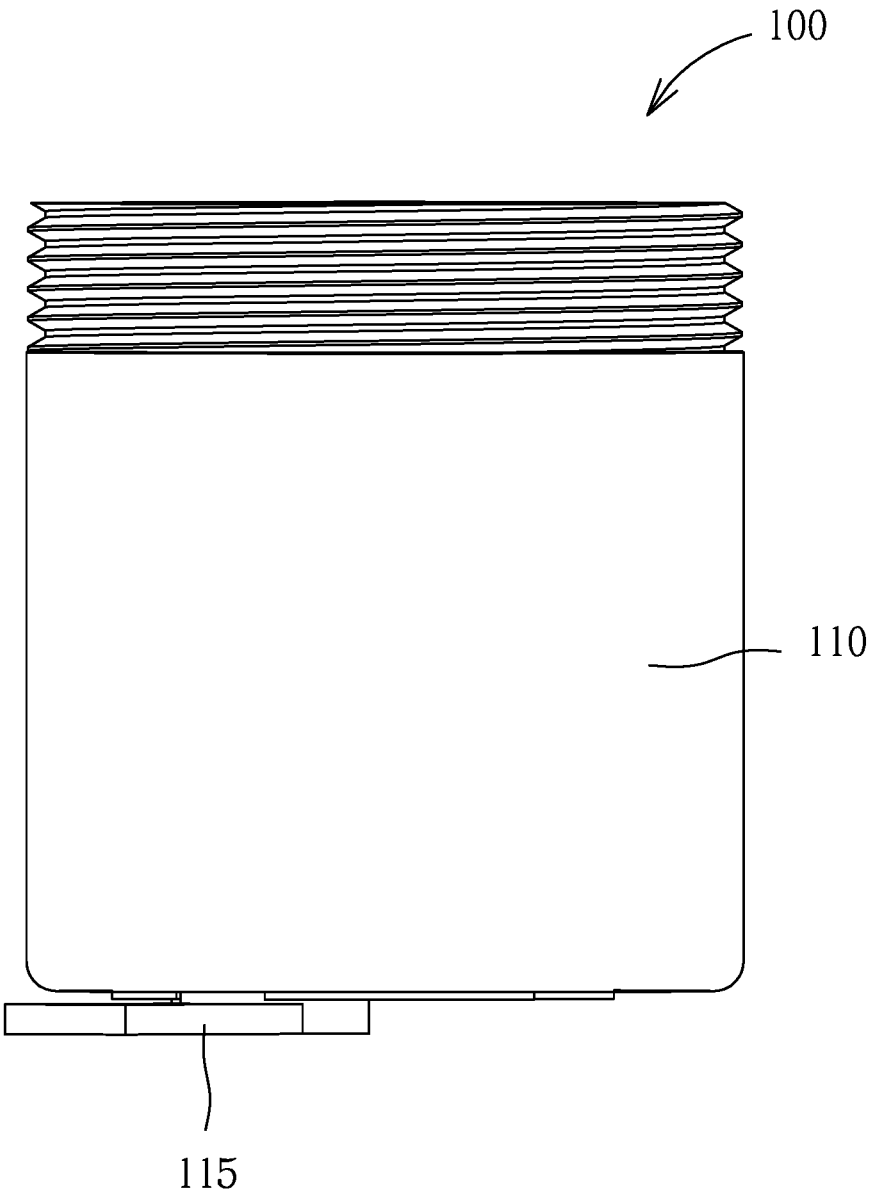

Based on FIG. 1, FIGS. 26-29 show different views of the liquid saving device 100 in an assembled manner according to some examples of the present disclosure. More particularly, FIG. 26 illustrates a top view of the liquid saving device with two section lines B-B and D-D. FIG. 27 illustrates a lateral view of the liquid saving device 100 along the section line B-B. FIG. 28 illustrates a lateral view of the liquid saving device 100 along the section line C-C. FIG. 27 and FIG. 28 shows different positions of the liquid saving device 100's various components, which are described in the previous paragraphs, in an assembled manner. FIG. 29 also illustrates another lateral view of the liquid saving device 100 in which the switch handle 115 is visible.

The switch 114 is primarily used for switching different liquid inlet patterns predetermined and prepared on the rubbery gasket 117. In this way, the flow rate of inlet liquids into the liquid guide 111 can be adjusted more efficiently.

FIGS. 30-36 illustrate one type of flow switching mechanism involving the switch 114 and the rubbery gasket 117 according to one example of the present disclosure. More specifically, FIGS. 30-36 illustrates relative positions of the liquid saving device 100's certain elements corresponding to different positions of the switch 114.

In one example, the cover piece 116 covers pores 127 and 137 which are located on the rubbery gasket 117. A separation gap 610 between the cover piece 116 and the rubbery gasket 117 controls how much flow goes through the pores 127 and 137. In another example, the flow through the center pores 136 and 126 are not affected. Only the flow through the two side pores 127 and 137 are affected by the switch 114.

Figure 30:
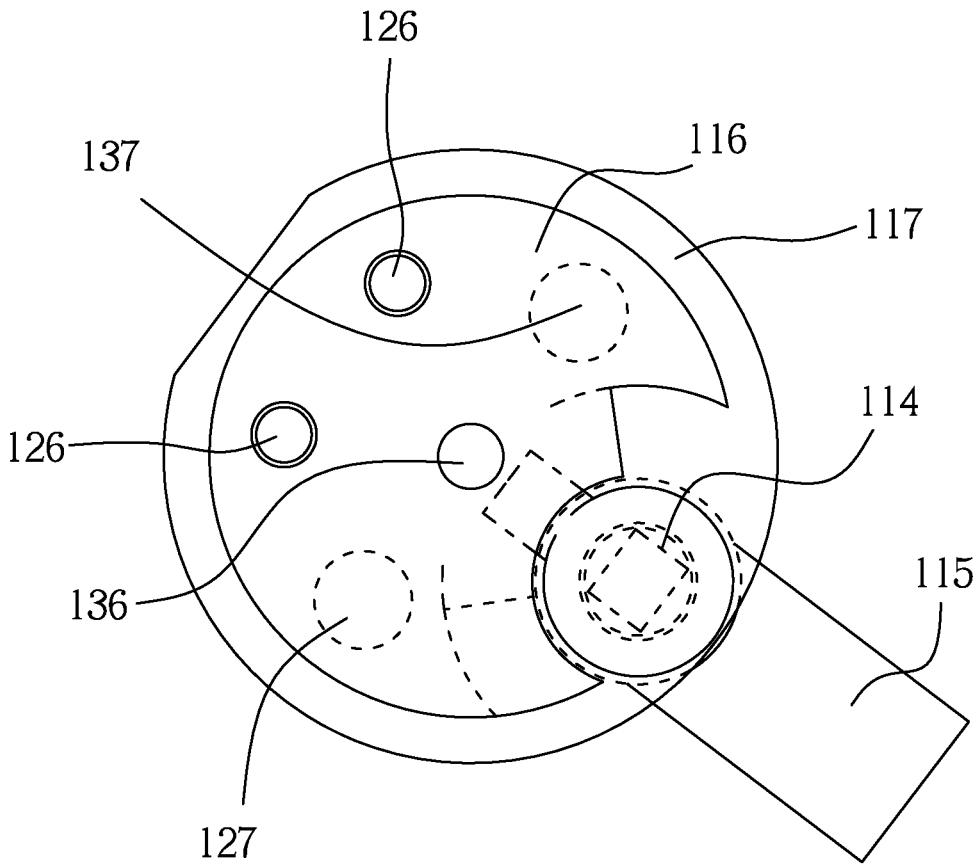
FIGS. 30-36 illustrates relative positions of the liquid saving device's certain elements corresponding to different positions of the switch according to one example of the present disclosure.
Figure 31:
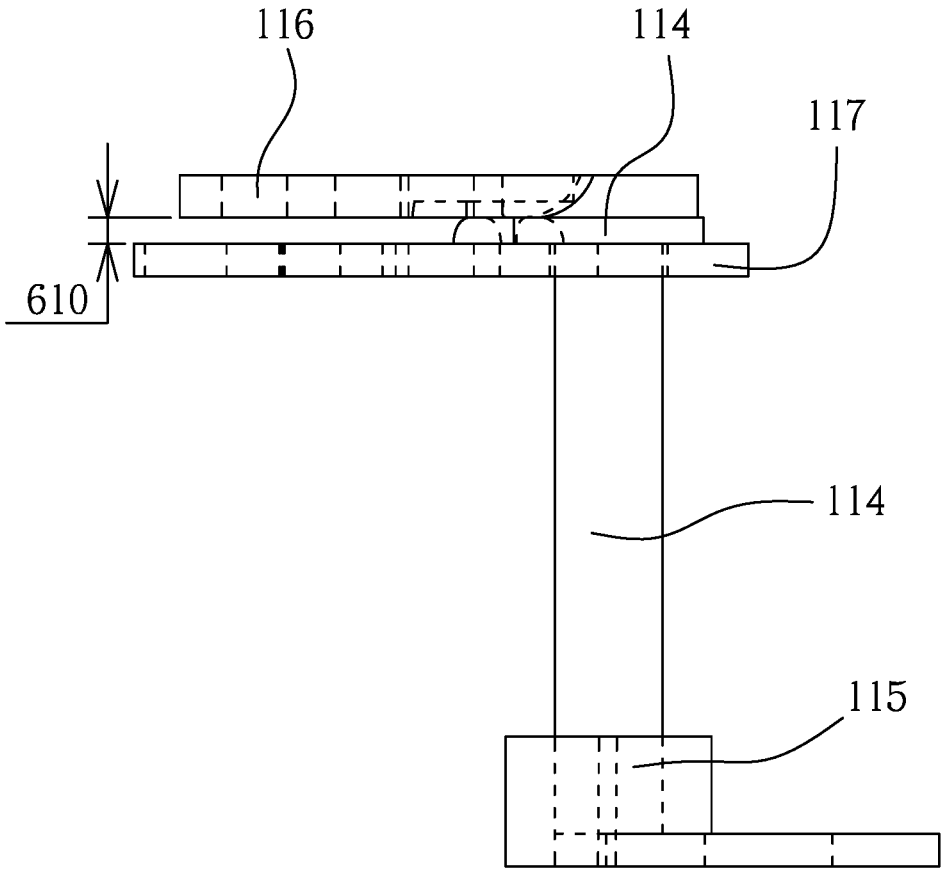

At a first position shown in FIGS. 30-31, the switch 114 is sandwiched between the cover piece 116 and the rubbery gasket 117. The thickness of the switch 114 lengthens the gap 610. The lengthened gap 610 creates a high flow rate setting.

Figure 32:
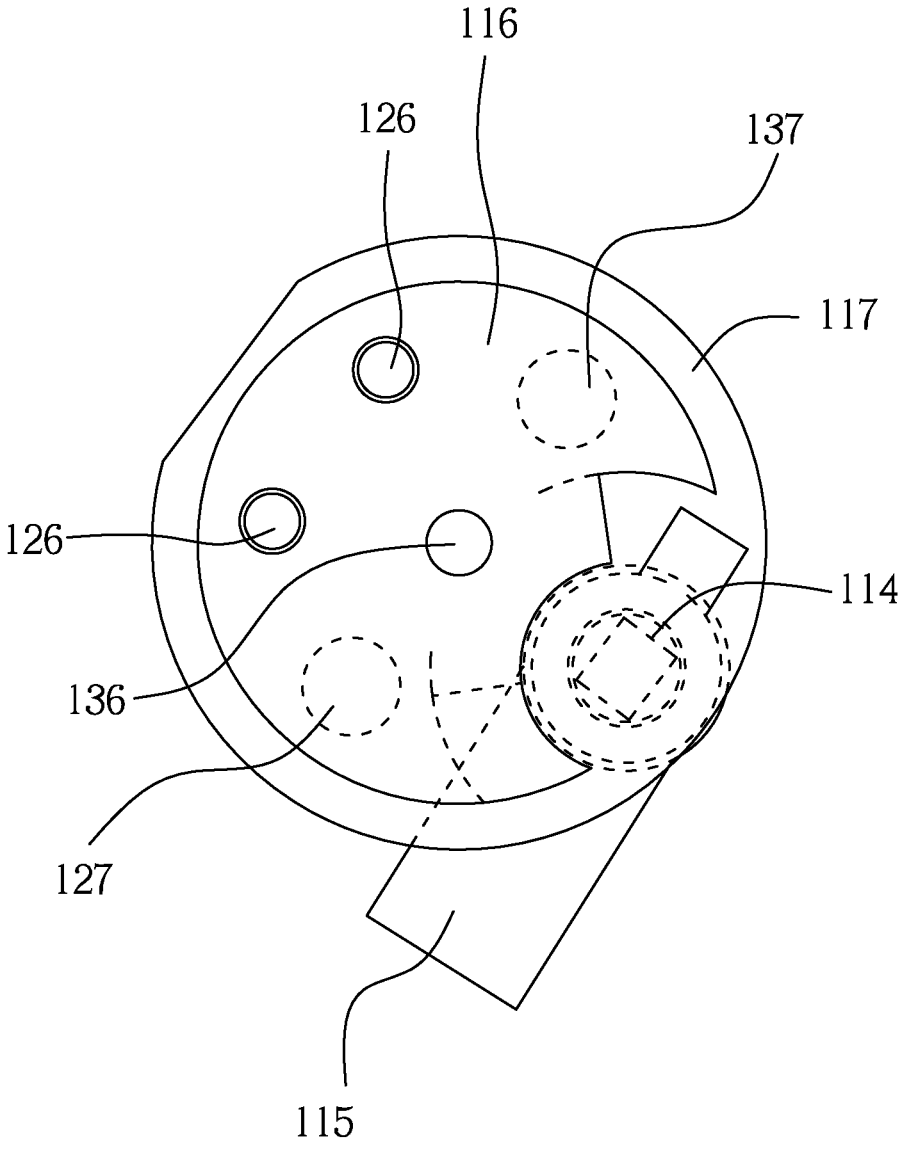
Figure 33:
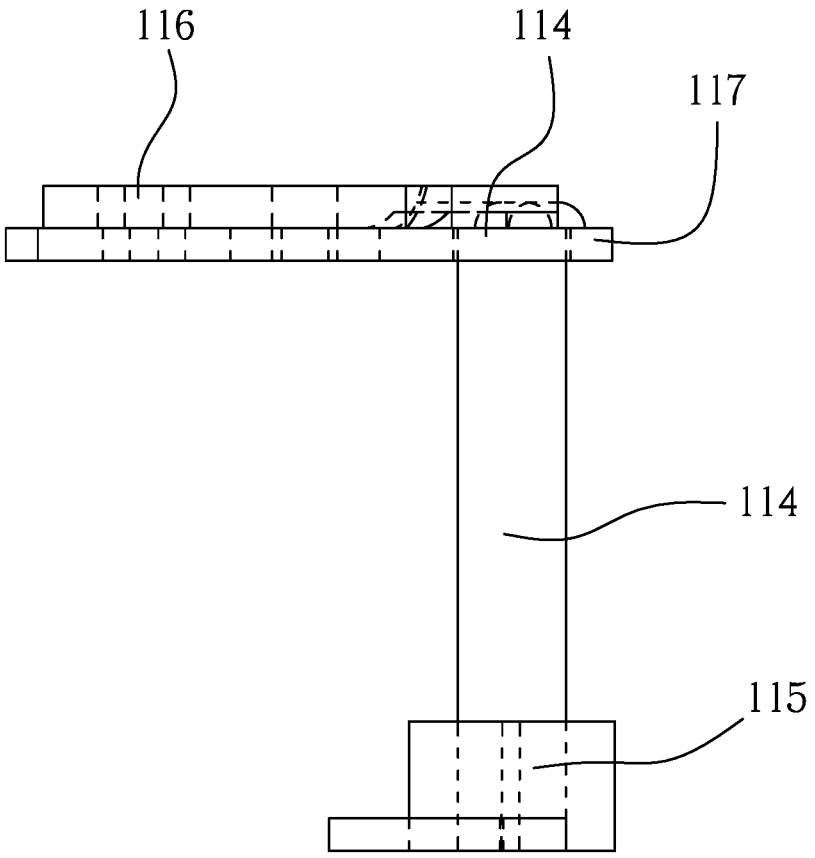

At a second position shown in FIGS. 32-33, the switch 114 is turned to a position that the tip of the switch 114 is no longer positioned between the cover piece 116 and the rubbery gasket 117. This allows the cover piece 116 to be positioned directly above the rubber gasket 117 and eliminates the gap 610, such that the cover piece 116 forms a seal that blocks the holes on the rubber gasket 117. The blockage prevents flow from going through the pores on the rubber gasket 117 and forming.

Figure 34:
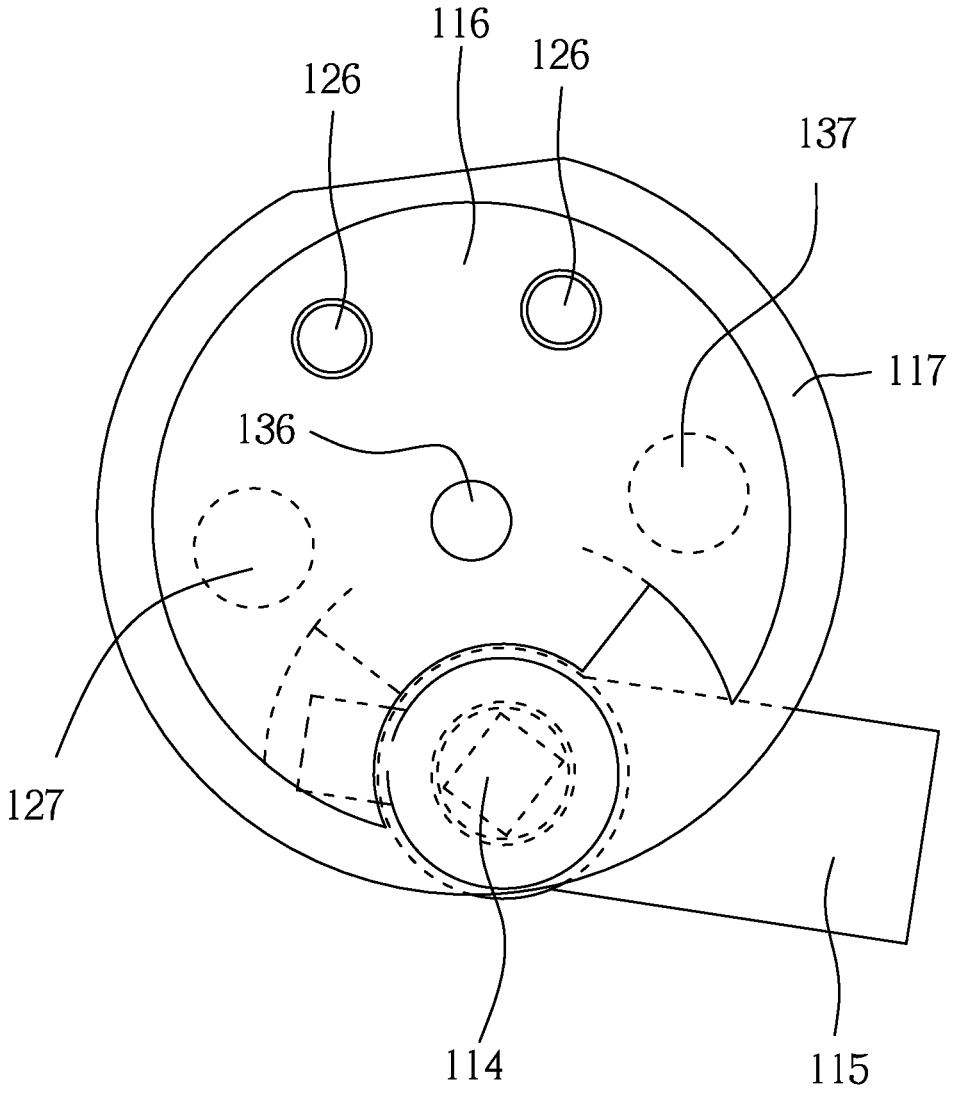
Figure 35:
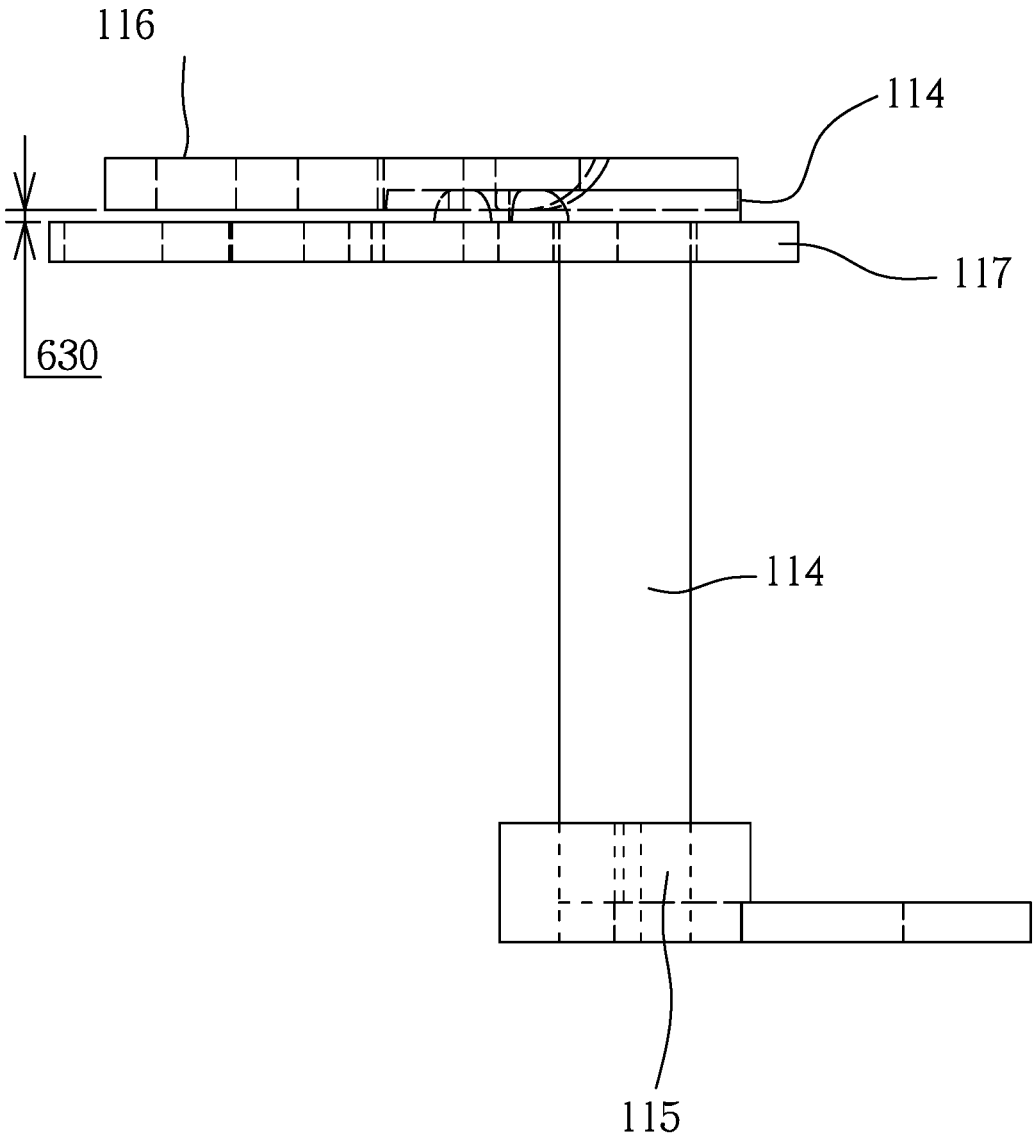
Figure 36:
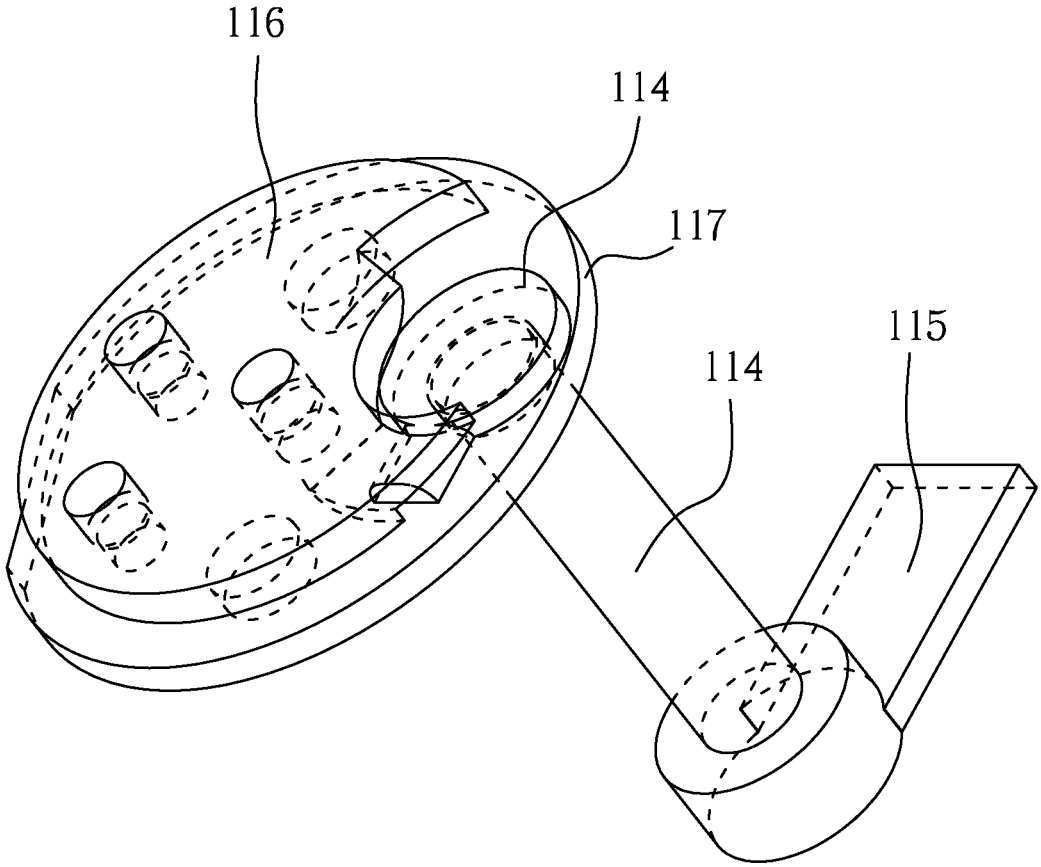

At a third position shown in FIGS. 34-36, the switch 114 is placed between the cover piece 116 and the rubber gasket 117 and also placed at an indentation 186 that is within the cover piece 116, where a gap 630 is kept between the cover piece 116 and the rubber gasket 117.

Figure 37:
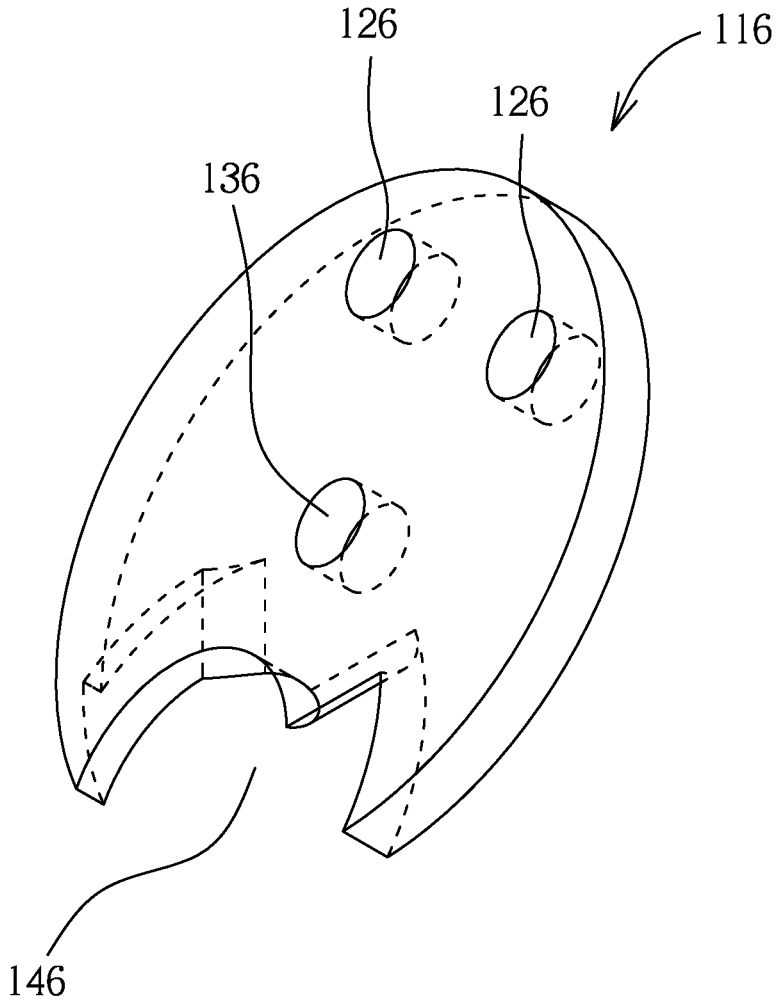
FIG. 37 shows a topside view of the cover piece.
Figure 38:
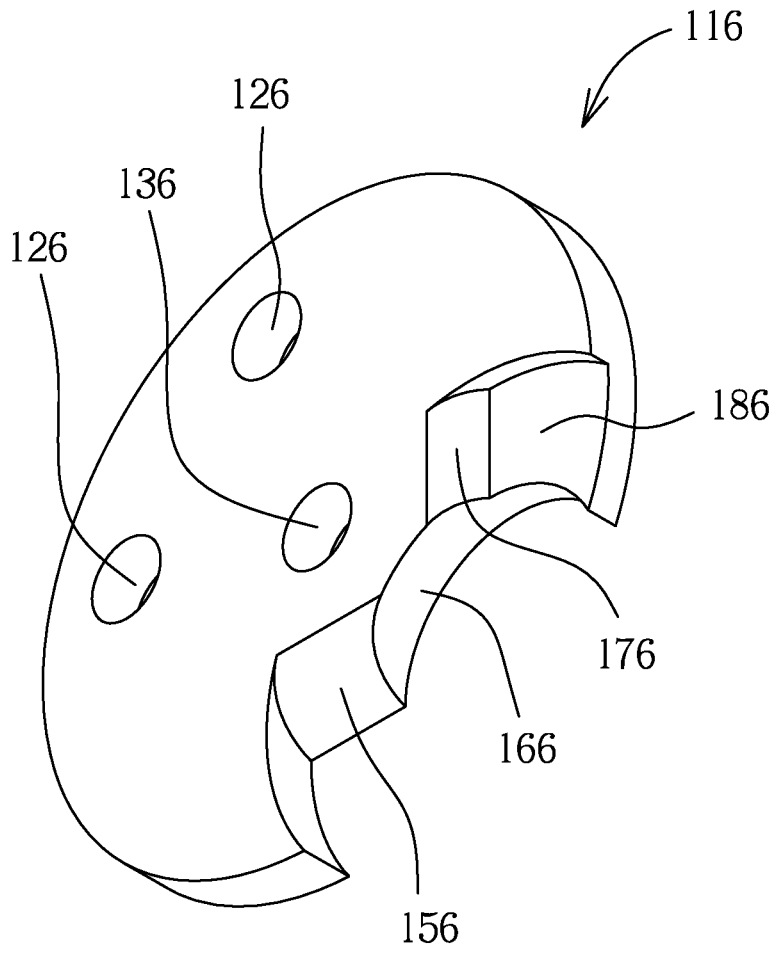
FIG. 38 shows a backside view of the cover piece.

FIGS. 37-38 shows the cover piece 116 with the indentation 186 according to one example of the present disclosure. More specifically, FIG. 37 shows a topside view of the cover piece 116. And FIG. 38 shows a backside view of the cover piece 116. Holes 126 on the cover piece 116 are used to stabilize the cover piece 116's movement. The center pore 136 allows a liquid flow to go through the set of pores in the middle of the liquid saving device 100. An adjusting space 146 allows room for the change of the cover piece 116's positions. Slopes 156 and 176 smoothen the transitional movement between the cover piece 116's different positions. A thickness 166 controls a maximum gap opening of the switch 114. A depth 186 controls the gap 630's length at the third position of the switch 114.

Figure 39:
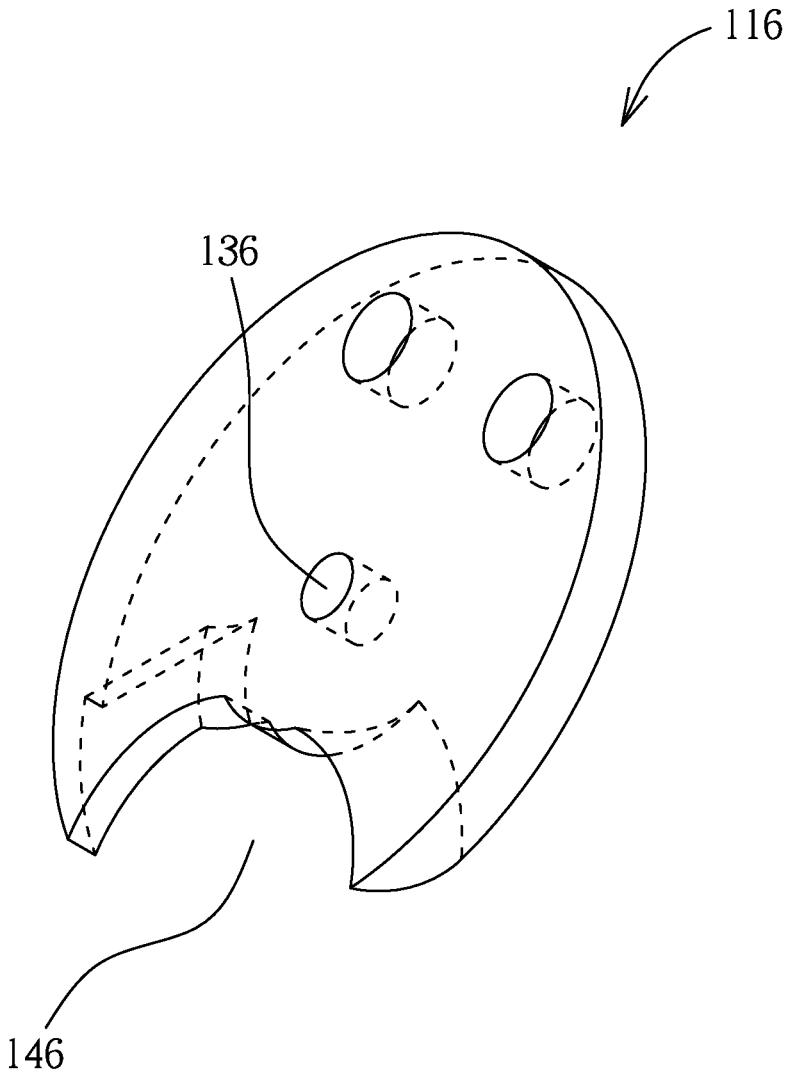
FIGS. 39-40 shows another example of the cover piece with modified geometries according to one example of the present disclosure.
Figure 40:
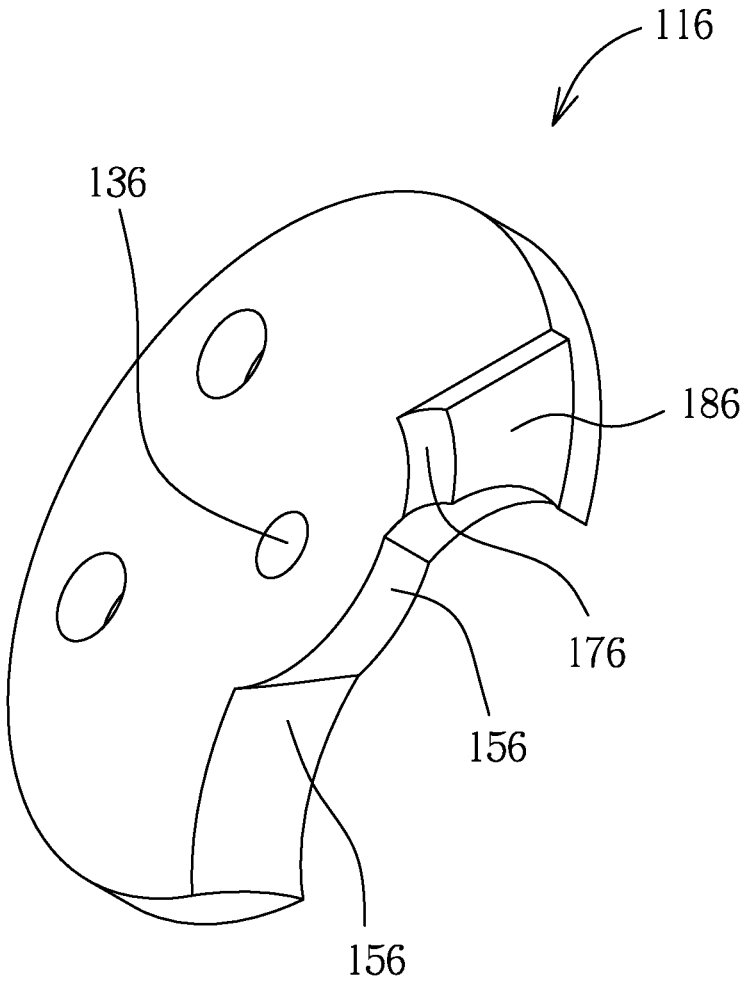

FIGS. 39-40 shows another example of the cover piece 116 with modified geometries according to one example of the present disclosure.

The example shown in FIGS. 39-40 demonstrated one type of setup. In other setups, the flow through the center hole 136 can also be adjusted by the gap 610 or 630's length. The switch 114 can accommodate many different flow rates by having as many steps of indentation on the cover piece 116 as there are a number of switchable flow rates.

Figure 41:
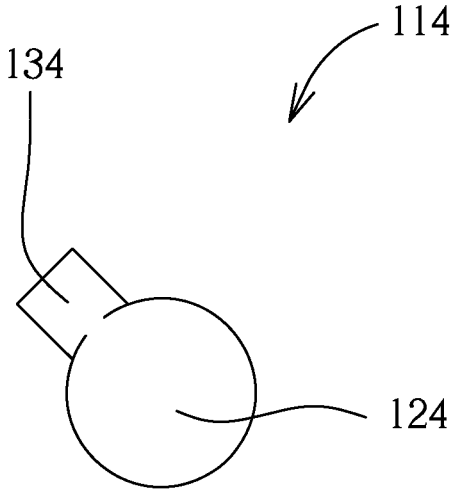
FIG. 41 illustrates a top view of the switch.
Figure 42:
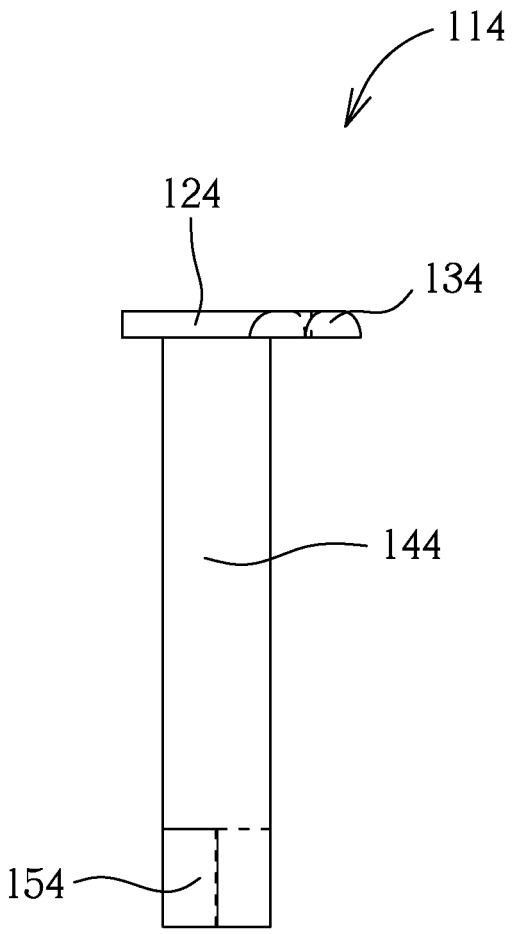
FIG. 42 illustrates a lateral view of the switch.
Figure 43:
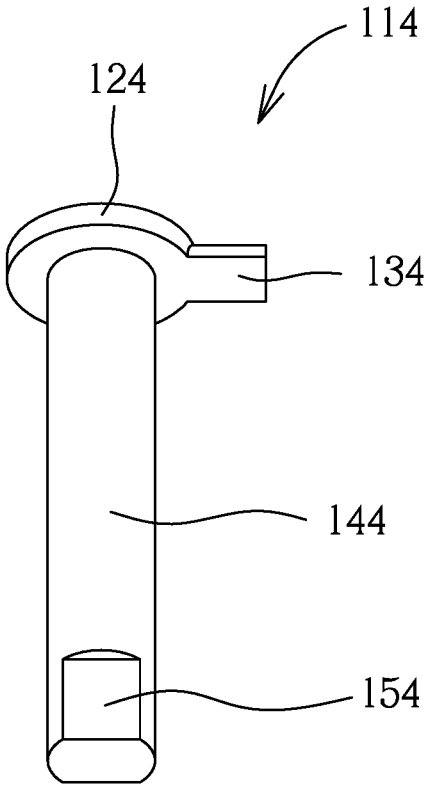
FIG. 43 illustrates a backside view of the switch.

FIGS. 41-43 illustrates the switch 114's structure in detail according to one example of the present disclosure. In particular, FIG. 41 illustrates a top view of the switch 114, FIG. 42 illustrates a lateral view of the switch 114, and FIG. 43 illustrates a backside view of the switch 114. The switch 114 has a round base 124 and an extended piece 134. The round base 124 has a larger area at the top such that it is able to fully cover the hole 1 shown in FIGS. 3-4 where the rest of the switch 14's body is positioned. A height of the extended piece 134 determines the abovementioned switched flow rate. A flat alignment structure 154 matches the shape of an engaging hole of the switch handle 115. The flat alignment structure 154's sidewalls allow the switch handle 115's change in direction so as to change the direction of the extended piece 134 and the abovementioned switched flow rate accordingly.

Figure 44:
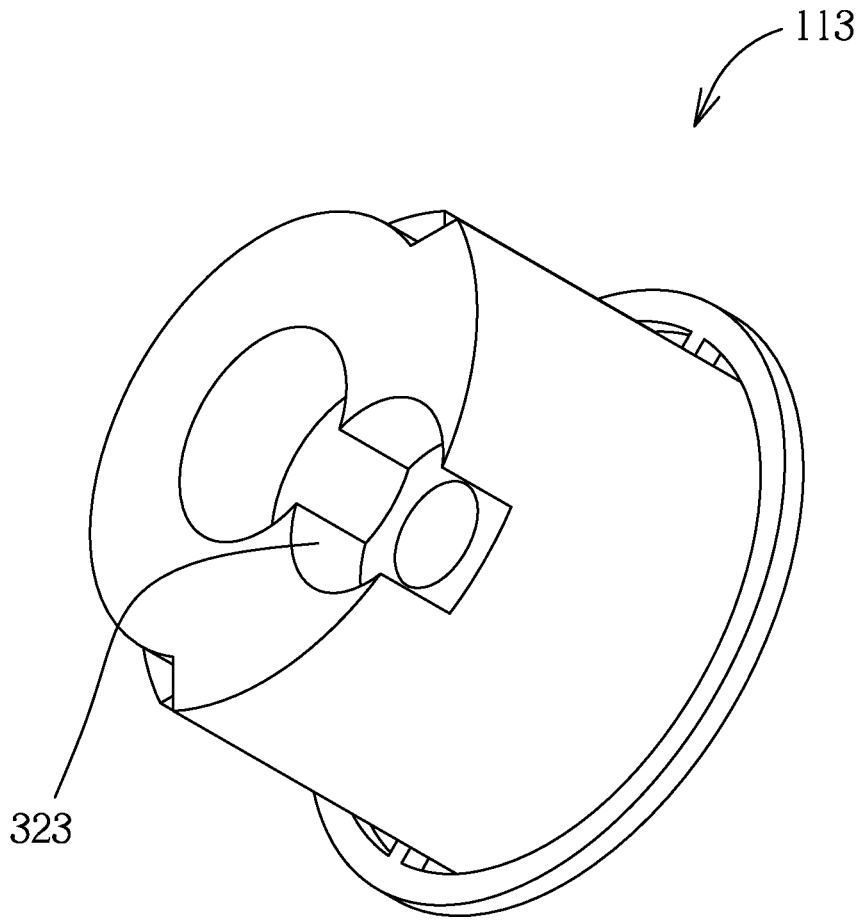
FIG. 44 shows another type of the vortex adaptor's design according to one example of the present disclosure.
Figure 45:
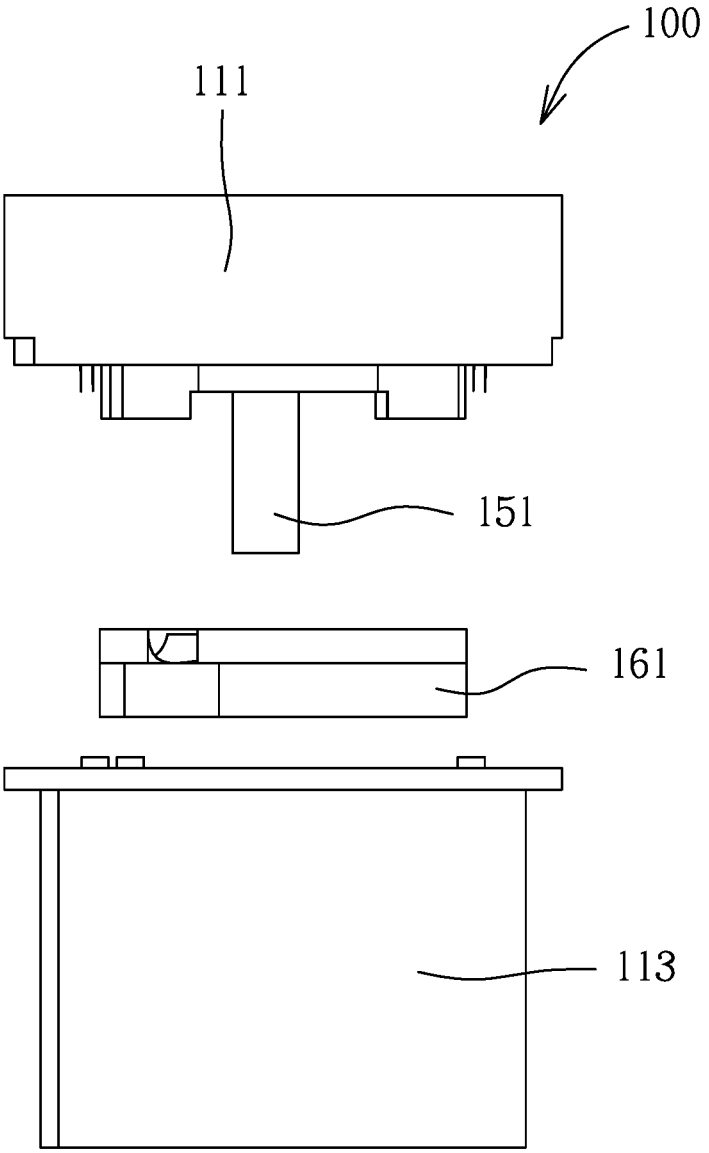
FIG. 45 shows a variation of the liquid saving device that additionally includes a middle structure which seals to the bottom of the vortex chamber to generate an additional cavity that provided the flow path to generate additional spray pattern around the center output hole.
Figure 46:
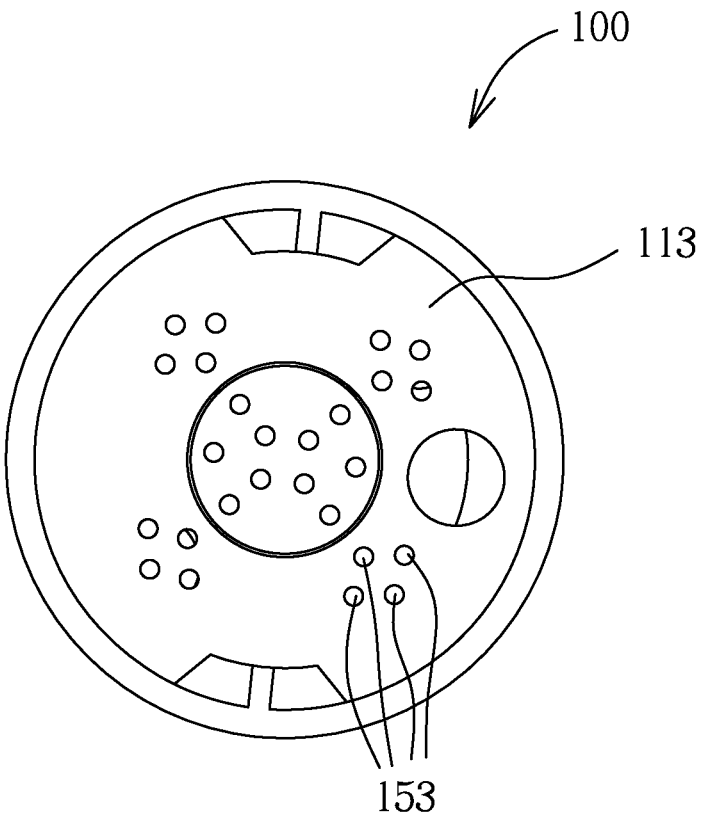
FIG. 46 illustrates a bottom view of the vortex adaptor from FIG. 45 that has an exemplary number of four pores for each additional spray set.

FIG. 44 shows another type of the vortex adaptor 113's design according to one example of the present disclosure. Specifically, the switch 114 may include a cavity 323 that can fit the switch handle 115. FIG. 45 shows a variation of the liquid saving device 100 that additionally includes a middle structure 161. FIG. 46 illustrates a top view of the vortex adaptor 113 has an exemplary number of four pores 153 for each set. The liquid guide 111 has a long tube 151 that allow liquid to travel through the middle structure 161 and to the base of the vortex adaptor 113. The middle structure 161 separates the vortex adaptor 113 and seals the enclosing edge against liquid leakage. This creates a separate chamber at the bottom of 113 and this chamber is connected to the tube 151. The switchable flow mechanism will allow the flow to switch between the flow traveling through the tube 151, or into the mid pores, or to the set of side pores as shown in the previously. When the liquid flow goes through the tube 151, the output stream is determined by the set pores 153.

Note that the number of pores and pore distribution shown in FIG. 46 can be varied to generate different style of sprays.

Figure 47:
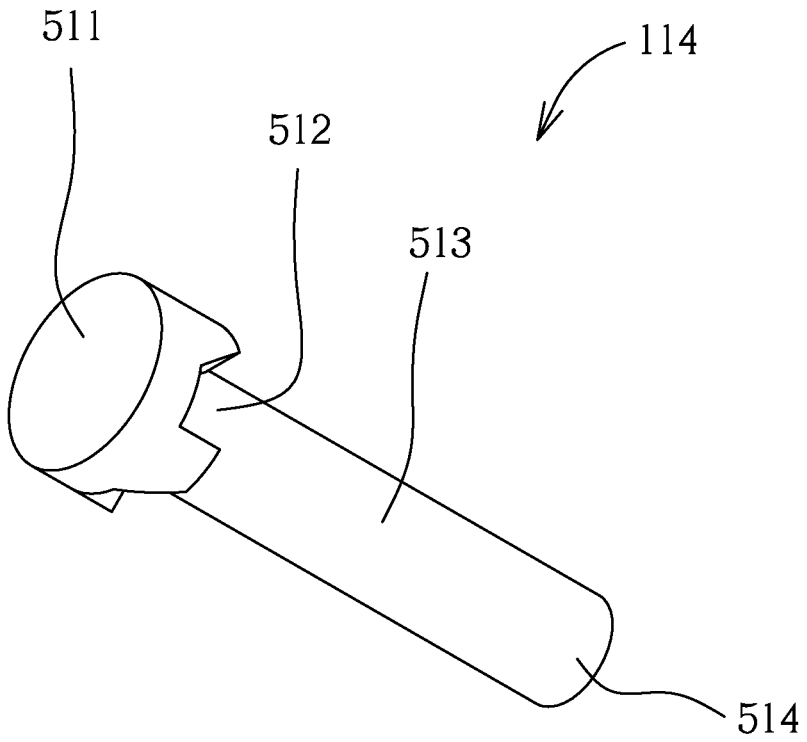
FIG. 47 shows another variation of the switch that can be used with the current liquid saving device according to one example of the present disclosure.

FIG. 47 shows another variation of the switch 114 that can be used with the current liquid saving device 100 according to one example of the present disclosure. The switch 114 shown in FIG. 47 is a push up switching mechanism, which allows the switch 114 to turn when it's pushed up and allows the switch 114 to turn again when it's pushed down. The force for pushing up the switch 114 is usually created by a user. The force for pushing down the switch 114 can be caused by liquid pressure from the liquid source or by the action of springs. The switch 114 includes a head 511, a series of tapered tooth 512, a body 513 and a bottom 514. The series of tapered tooth 512 is disposed around the head 511. The head 511 can have different depth of patterns such that when a rod of the switch 114 is rotated, different height is inserted between liquid holes and respective portions on the cover pieces 116. When the cover piece 116 seals against corresponding holes, no flow can go through; however, when the head 511 is inserted in-between, a gap is created between the holes and the corresponding portions on the cover piece 116, and such gap allows liquid to flow through the pores. It follows that the larger the gap, the higher the flow rate and vice versa. In some examples, the bottom 514 may have another set of tapered tooth.

Figure 48:
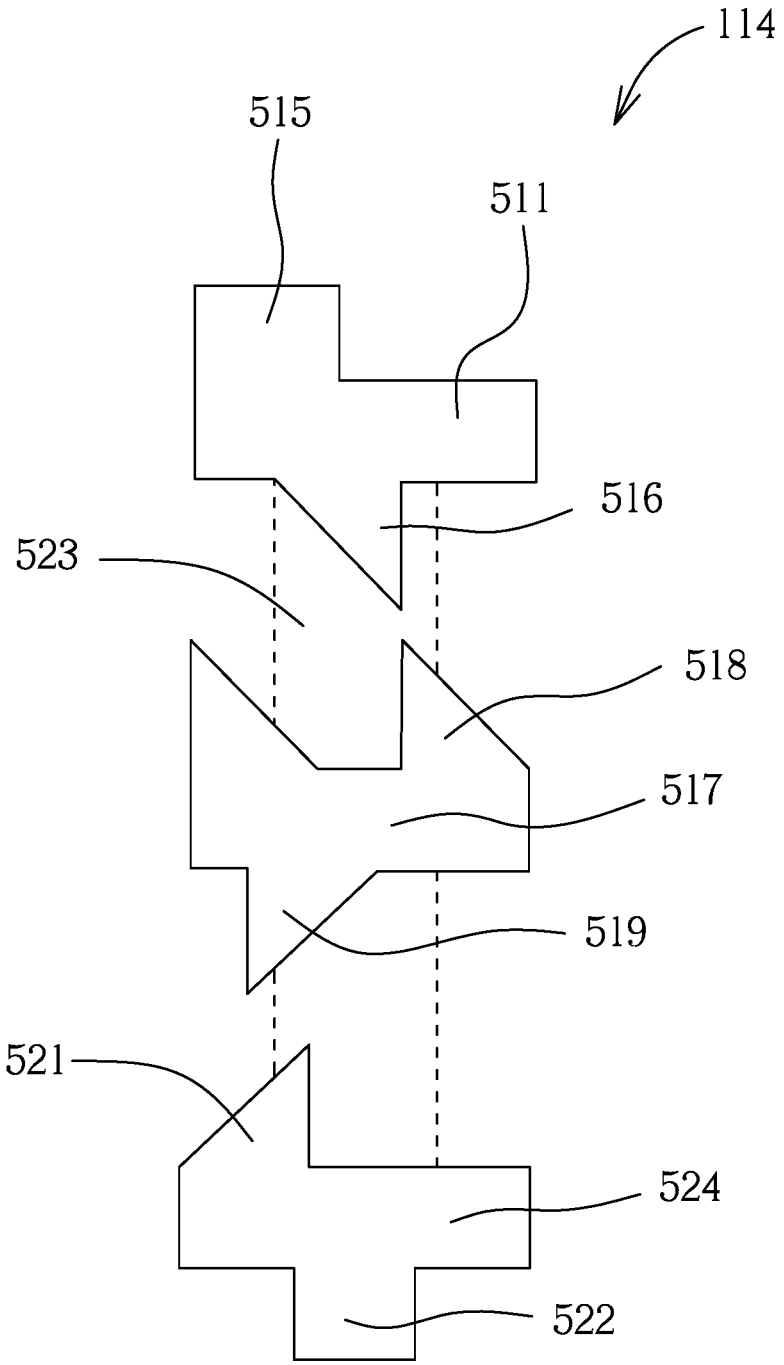
FIG. 48 shows components of a push-switch assembly of the switch according to one example of the present disclosure.

FIG. 48 shows components of a push-switch assembly of the switch 114 according to one example of the present disclosure. The switch 114 further includes a switch rod 523. The head 511 acts as the body of a top part of the rod 523. Also, the switch 524 includes a body of a bottom part of the switch rod 523. A top depth variation 515 contributes to the variation in flow rate when the switch rod 523 is turned. A gear 516 is associated with the top part of the switch rod 523, and a gear 521 is the gear associated with the bottom part of the switch rod 523. The gears 516 and 521 have tapered tooth that turns when pressed against counter tooth located on a middle part 517. The middle part 517 has two pairs of counter teeth 518 and 519. The tooth 518 interacts with the gear 516, and the tooth 519 interacts with the gear 521. When the gear 521 is pushed up, the switch rod 523 is slightly turned, such that a slope of the gear 521 matches a slope of the tooth 519, but this same body motion turned the gear 516 to be in an intermediate position between the teeth 518. This intermediate position can be any position that is not in a fully complimentary position to match the tapering slopes of the gear 516 and the counter tooth 518. This intermediate position makes it possible that when the head 511 moves down, the gear 516 moves in the direction of the slope on the tooth 518 and turns the switch rod 523 again. The rotation caused by moving the switch rod 523 up and down changes the position of the pattern that is inserted between the gap of the cover piece 116 and the pores on the rubber gasket 117. Change in the gap 610 or 630's height creates a flow rate difference or a flow pattern to change a flow output. The middle part 517 can be a ring, a cavity or patterns on a surface in some examples.

Figure 49:
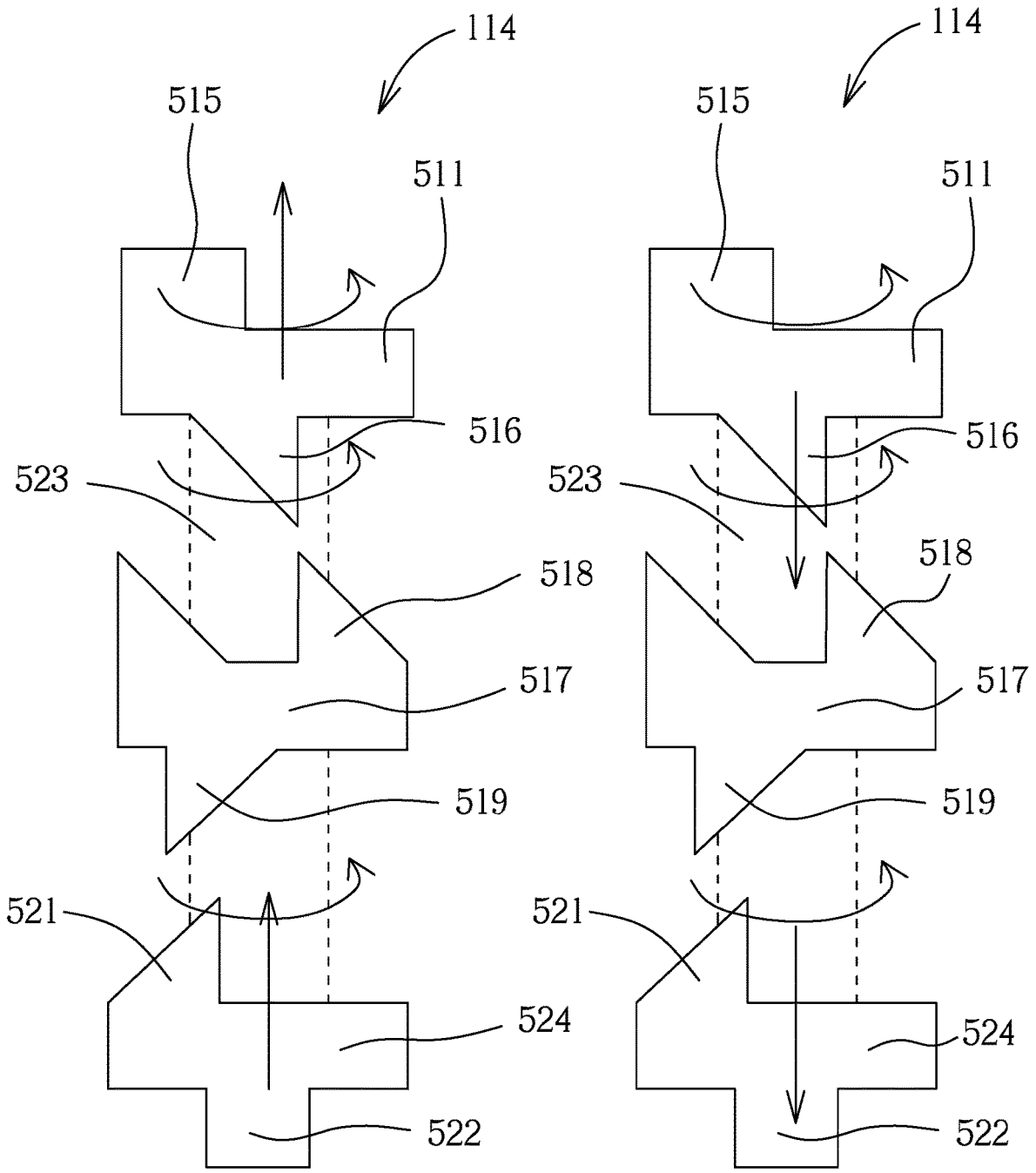
FIG. 49 shows the direction of rotation of the switch caused by the upward and downward movements of the switch rod based on FIG. 48 according to one example of the present disclosure.

FIG. 49 shows the direction of rotation of the switch 114 caused by the upward and downward movements of the switch rod 523 based on FIG. 48 according to one example of the present disclosure.

Figure 50:
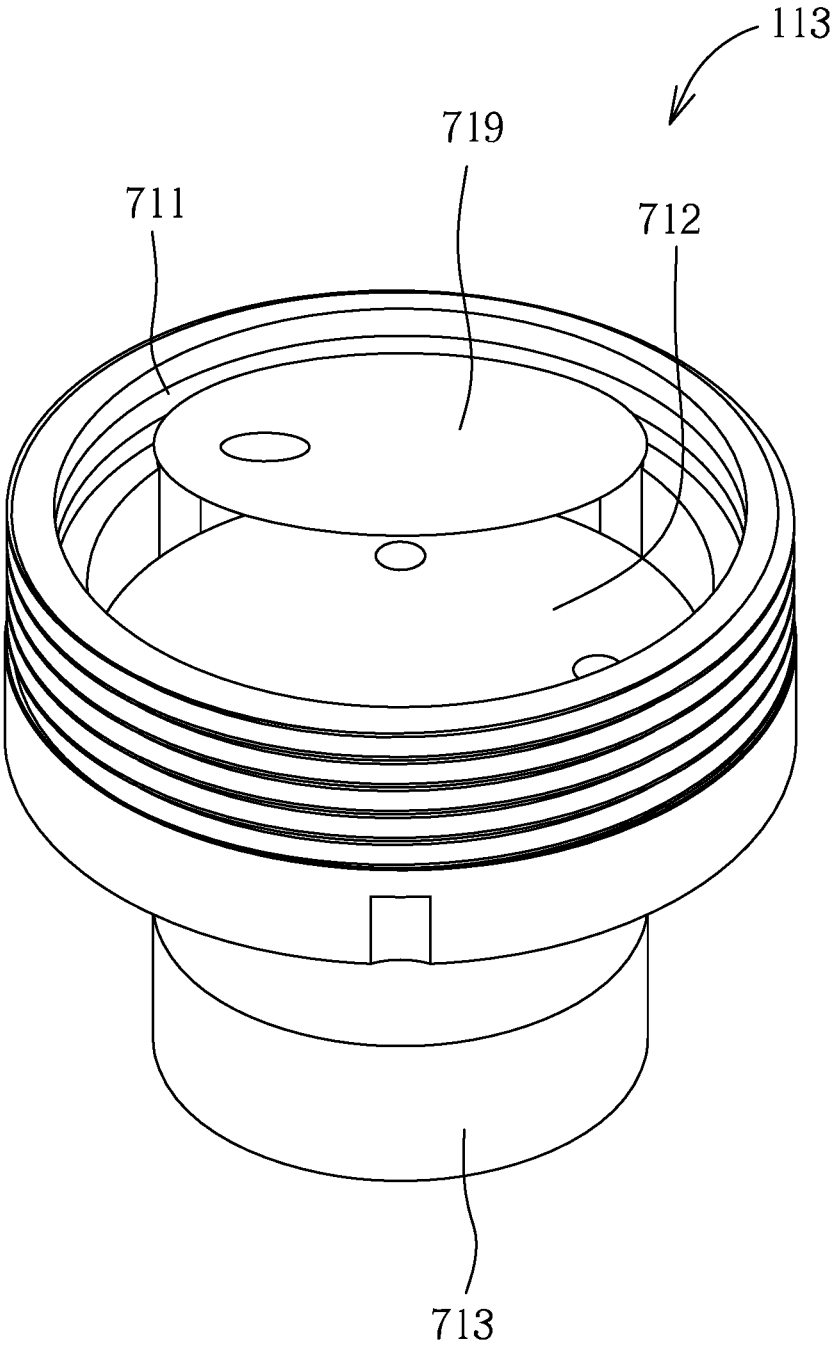
FIG. 50 illustrates a topside view of another example of the liquid saving device. That can switch flow by rotating part 713.
Figure 51:
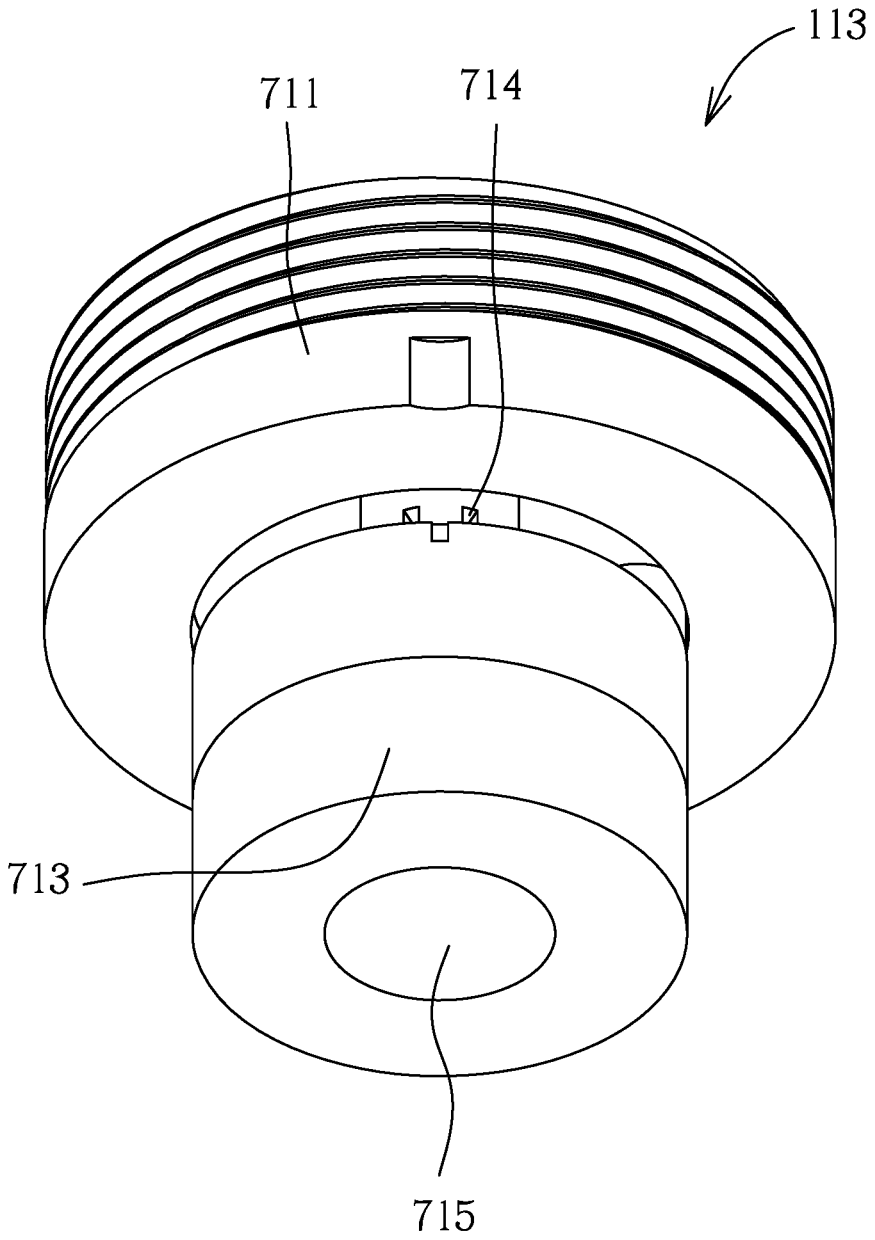
FIG. 51 illustrates a backside view of the device shown in FIG. 50.
Figure 52:
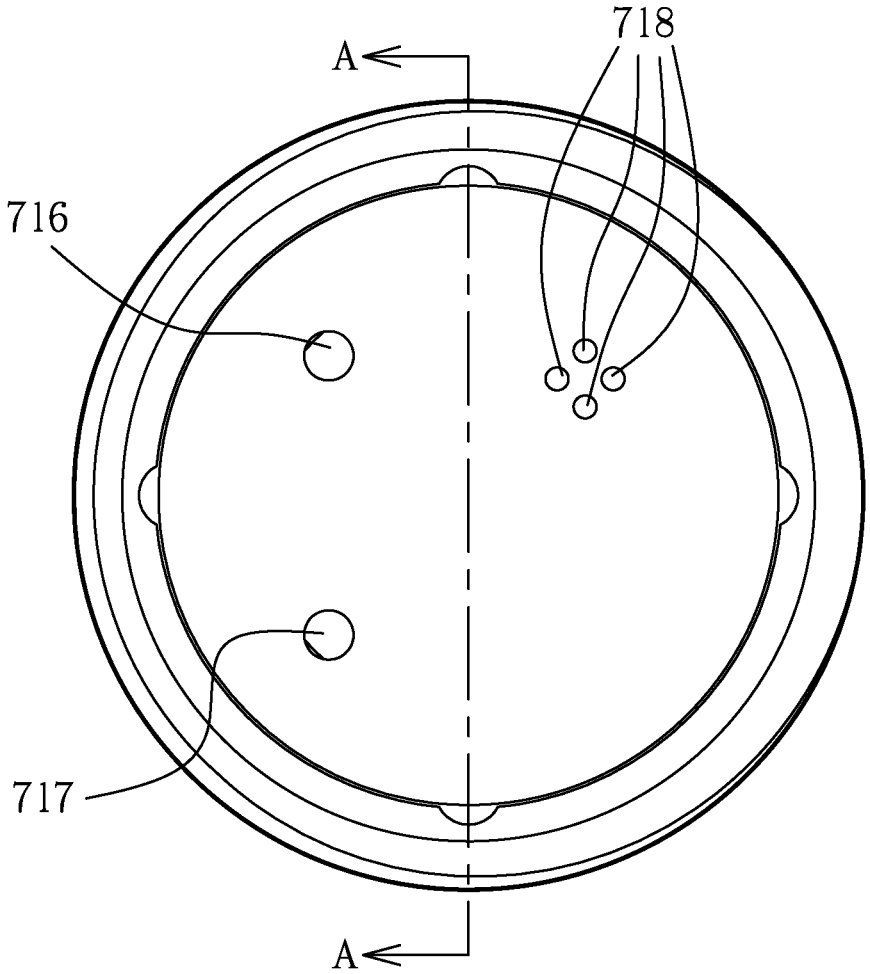
FIG. 52 illustrates a top view of the device shown in FIG. 50. The rotatable cover piece is attached to 713 and turns when 713 is turned. The different holes on the cover piece controls the plurality of pores forming the primary streams.
Figure 53:
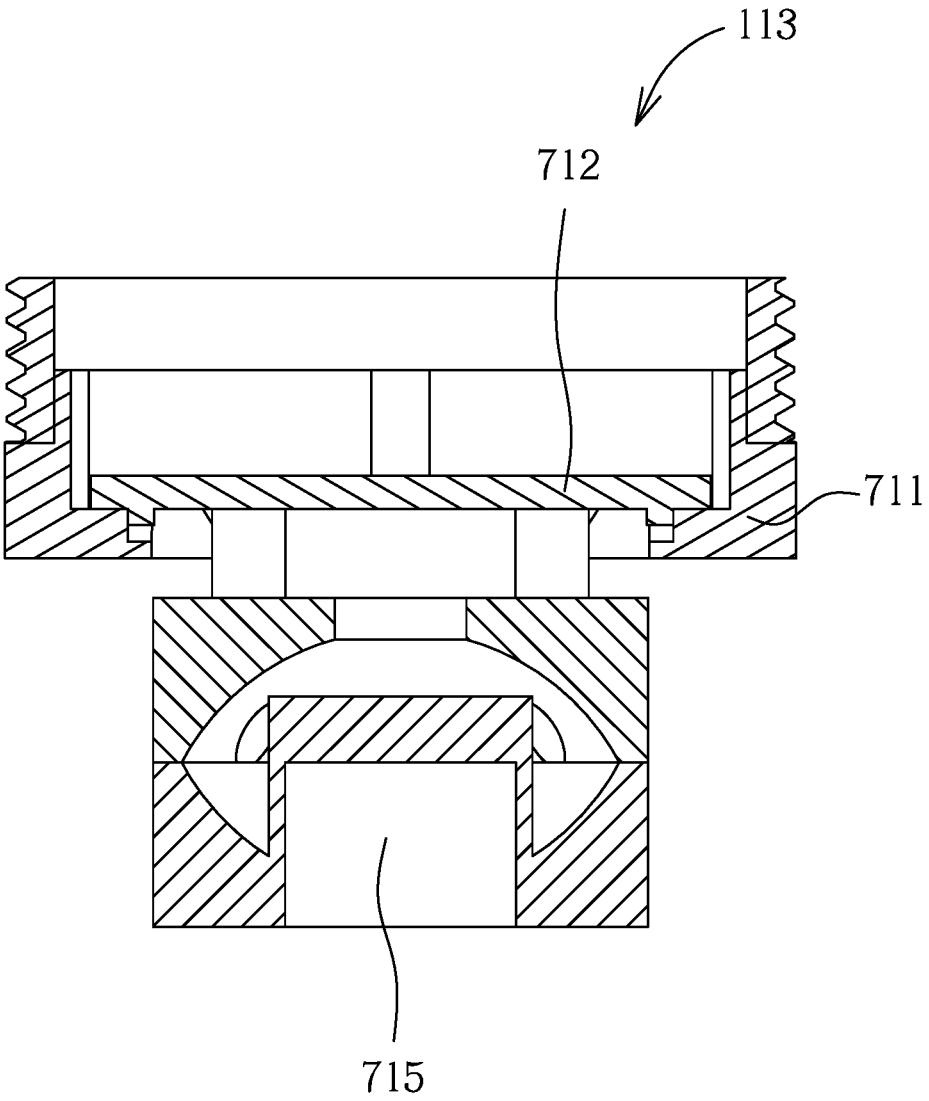
FIG. 53 illustrates a lateral and perspective view of the vortex adaptor.

FIGS. 50-53 show another design of the vortex adaptor 113 according to one example of the present disclosure. Particularly, FIG. 50 illustrates a topside view of the vortex adaptor 113, FIG. 51 illustrates a backside view of the vortex adaptor 113, FIG. 52 illustrates a top view of the vortex adaptor 113, and FIG. 53 illustrates a lateral and perspective view of the vortex adaptor 113.

The vortex adaptor 113 includes an upper holder piece 711, an inner rotatable piece 712, and a bottom flow chamber 713. The inner rotatable piece 712 hangs inside the upper holder piece 711, which has an overhang that supports the inner rotatable piece 712. The vortex adaptor 113 includes air holes 714 that draws air to mix with liquid stream inside the bottom chamber 713, similar as the flow and vortex mechanism shown in FIG. 25. The vortex adaptor 113 also includes an output hole 715. In addition, the vortex adaptor 113 includes a gasket cover piece 719 that contains a single inlet hole. The inner rotatable piece 712 contains several different sets of pores 718. Rotation of the inner rotatable piece 712 around its center changes the location of the sets of pores 718. When the inner rotatable piece 712 rotates to a position where the holes in the inner rotatable piece 712 matches the hole on the gasket cover piece 719, liquid flows through holes 716 and 717. Because there are multiple set of holes on the inner rotatable piece 712, each hole represents a different flow setting. The inner rotatable piece 712 hangs inside the upper holder piece 711.

Figure 54:
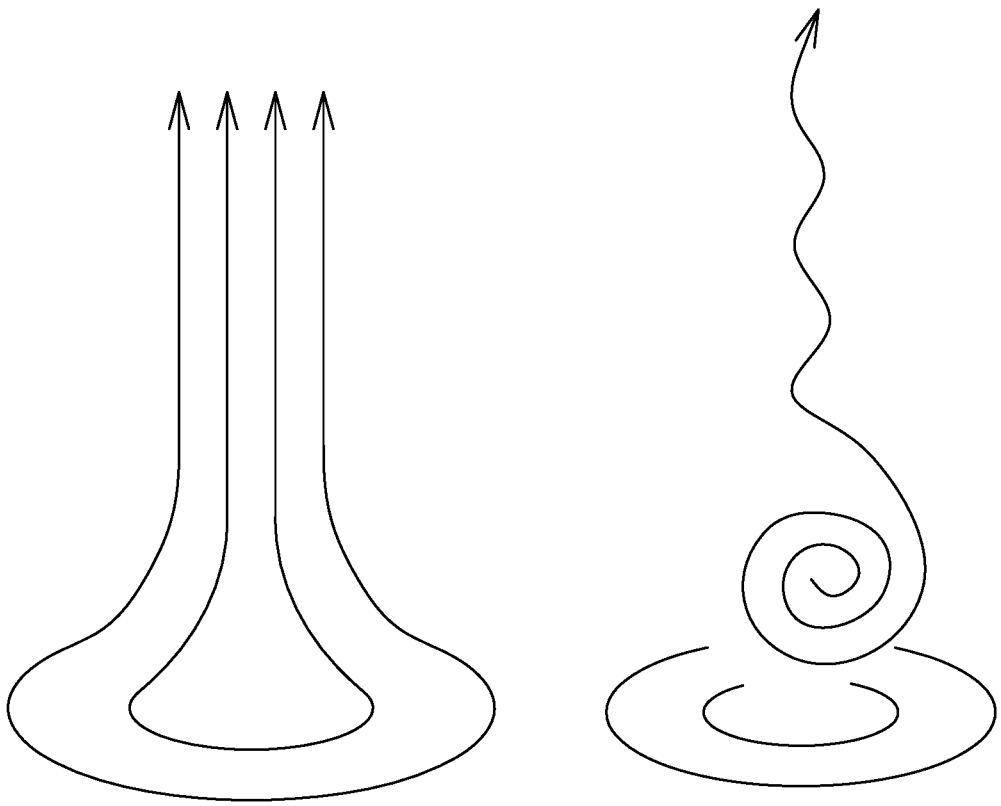
FIG. 54 shows an example of a spinning output generated from the liquid saving device, as referenced in FIG. 25, according to one example of the present disclosure.
Figure 55:
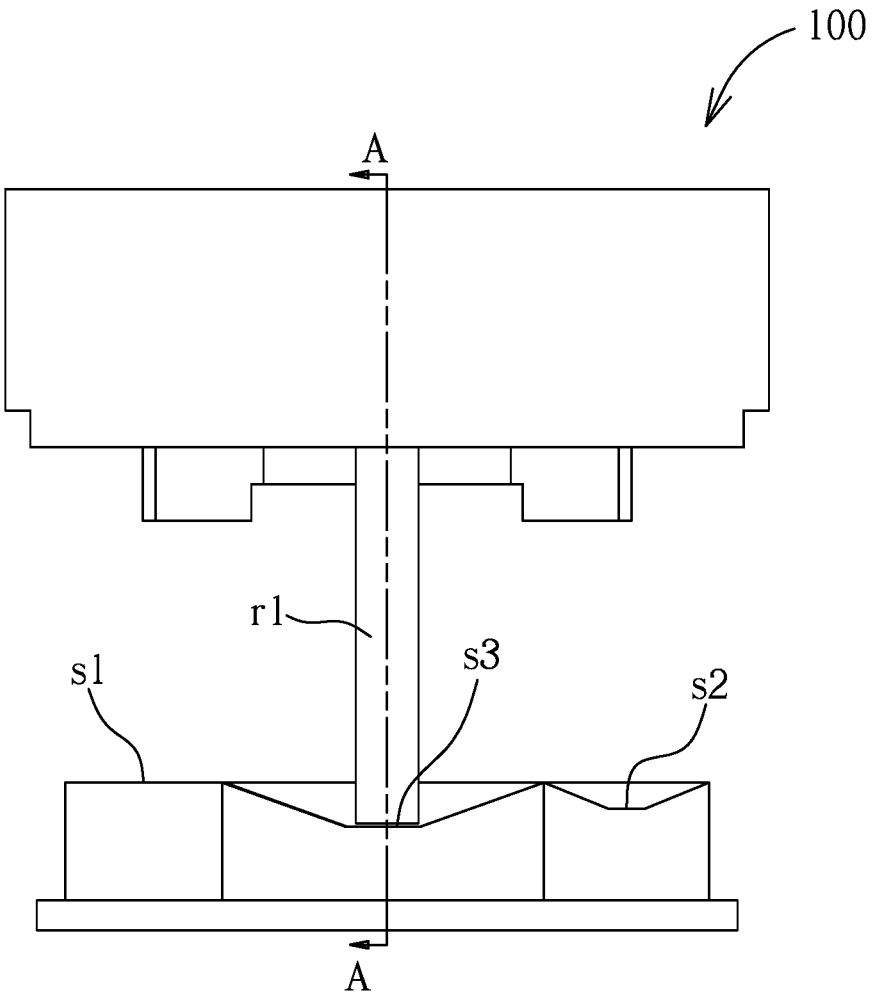
FIGS. 55-58 illustrates an example of switch assembly of the liquid saving device based on an embodiment of the present disclosure. The switch is in a position that only allows spray to be generated.
Figure 56:
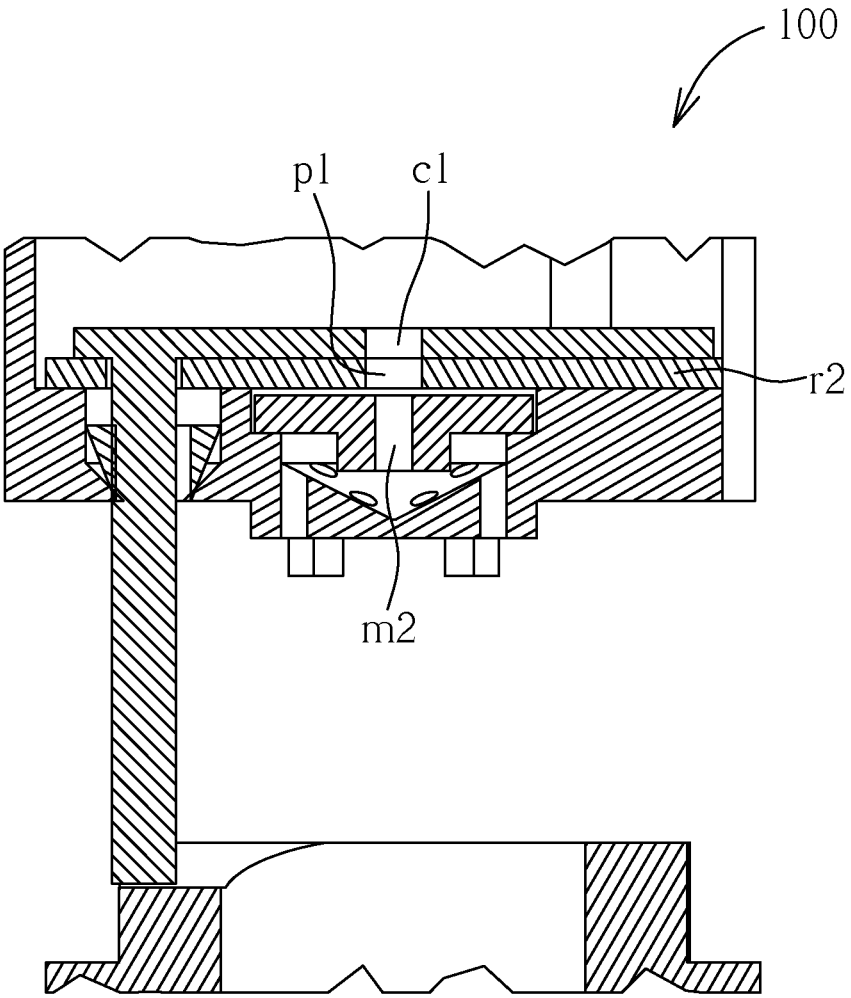
Figure 57:
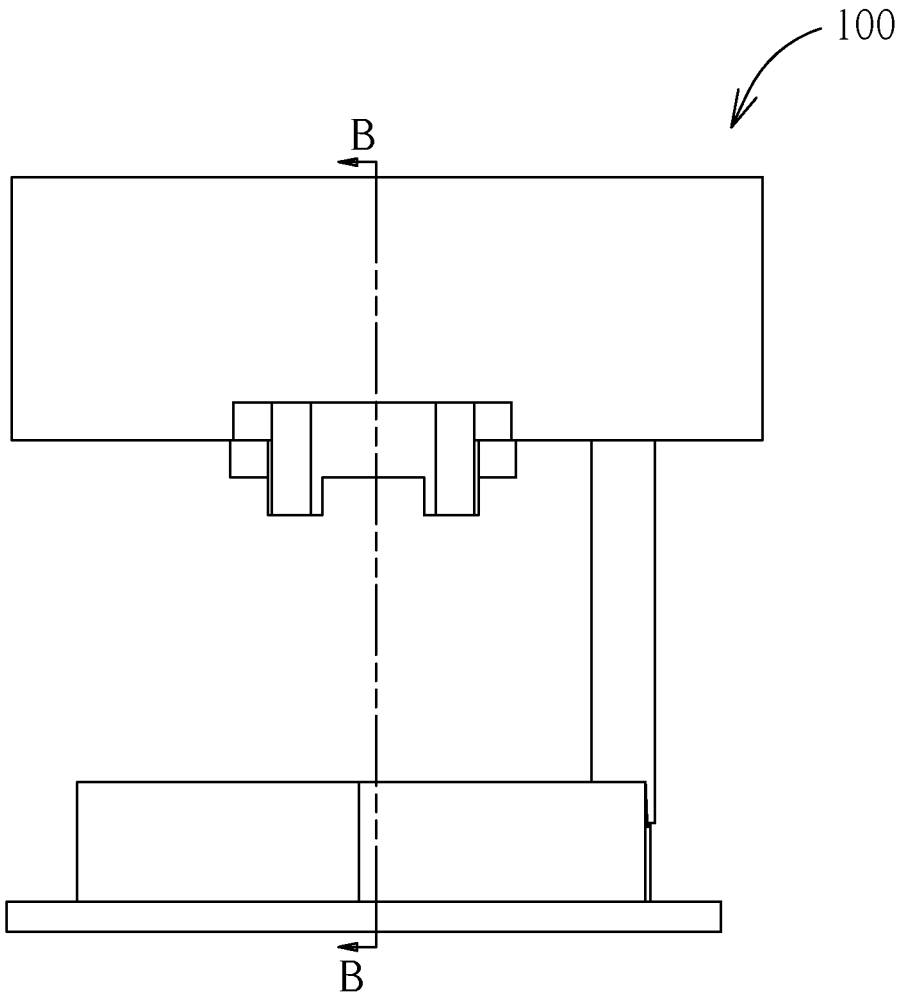
Figure 58:
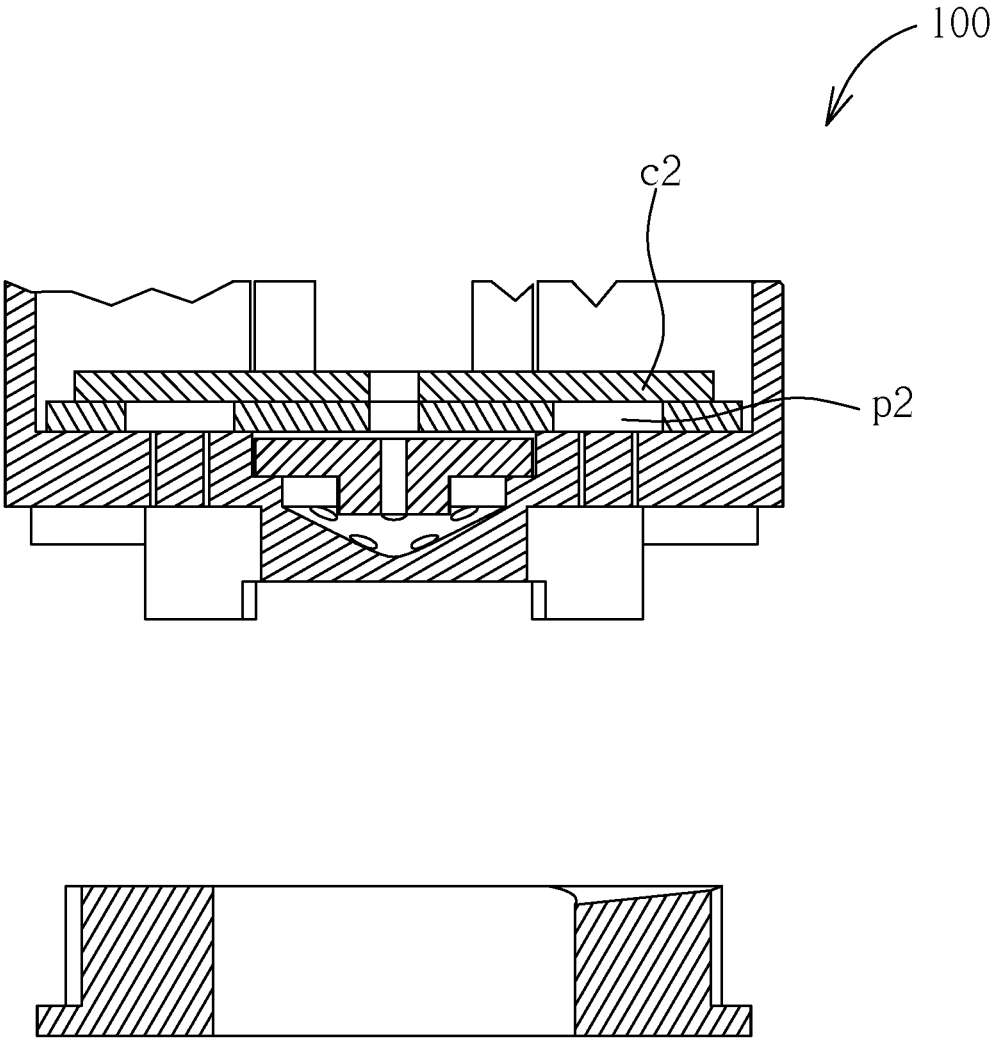
Figure 59:
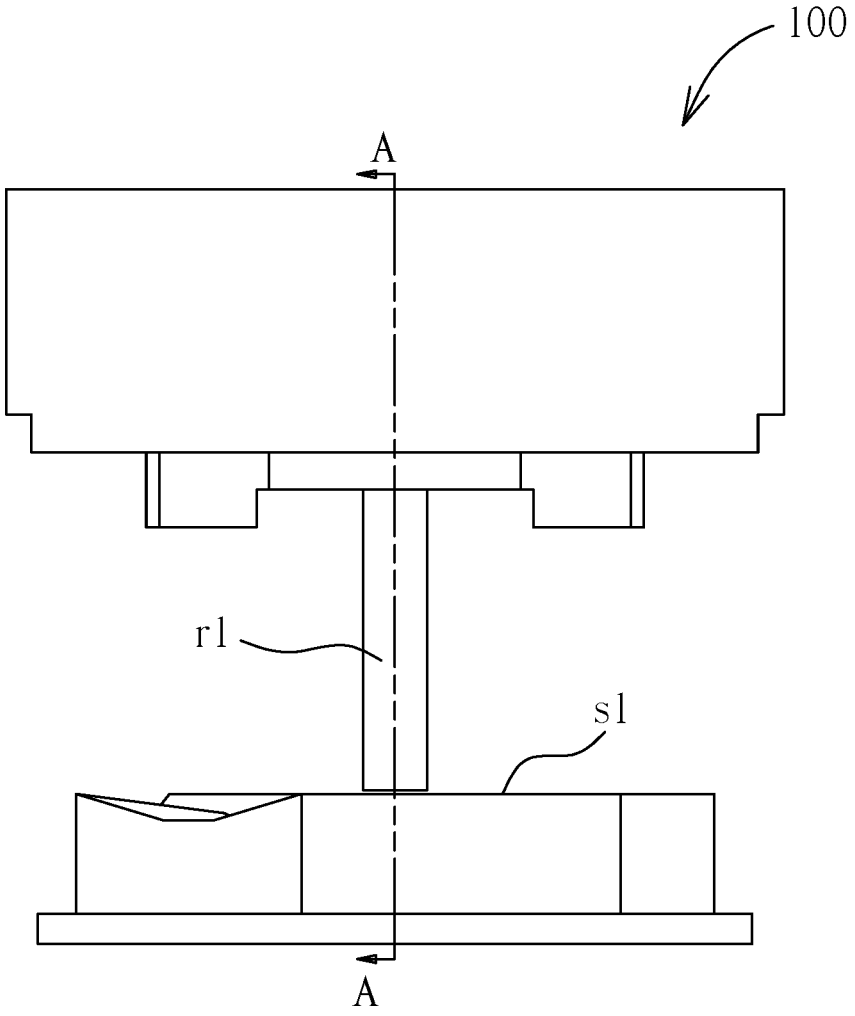
FIGS. 59-62 illustrate an example of switch assembly of the liquid saving device based on an embodiment of the present disclosure. The switch is in a position that allows vortex to be generated.
Figure 60:
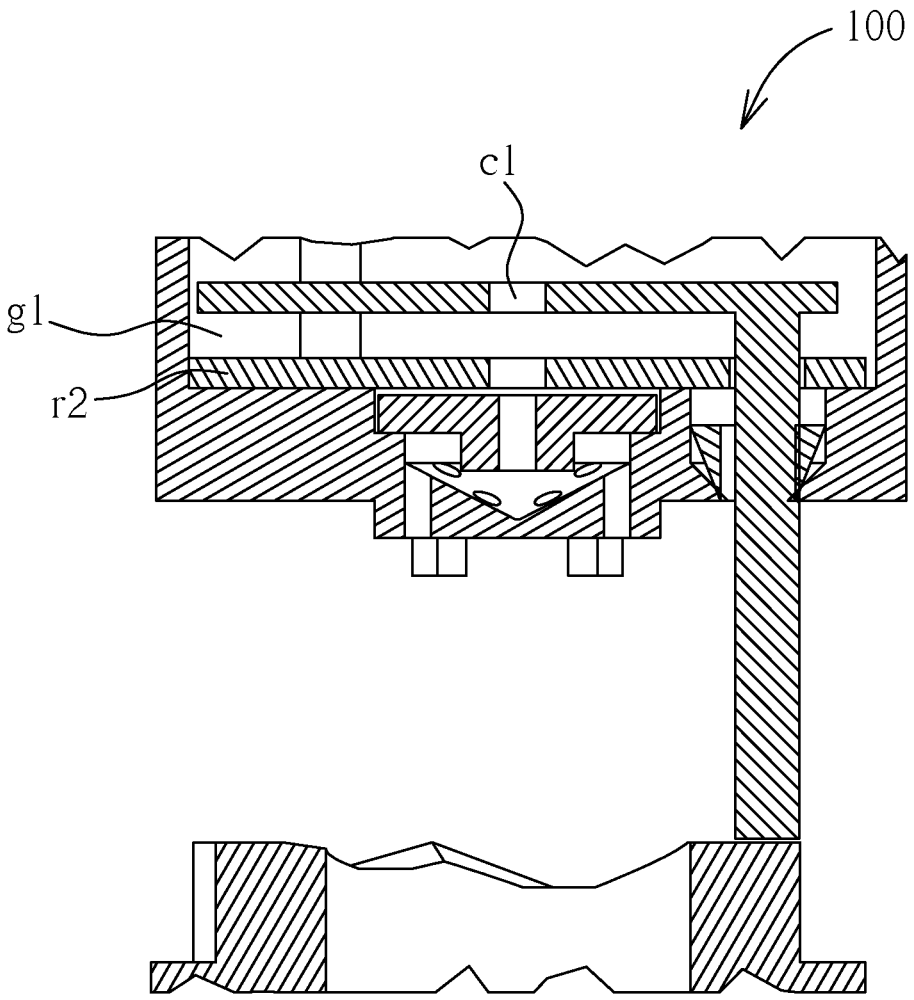
Figure 61:
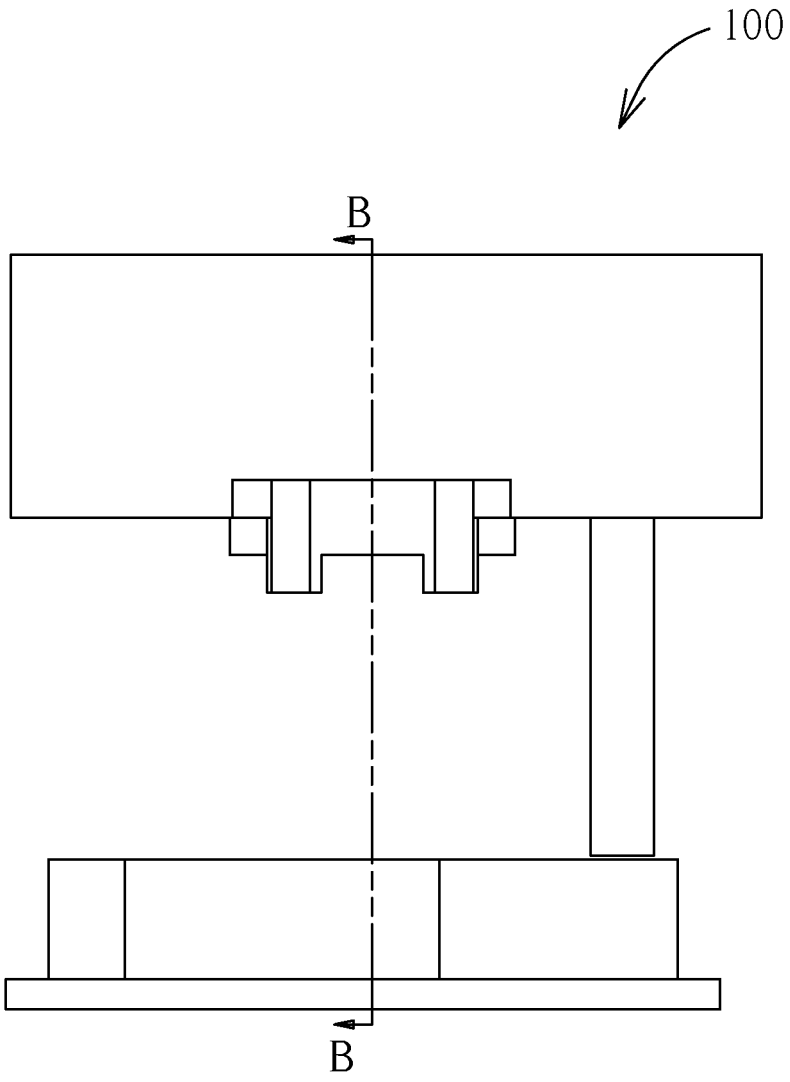
Figure 62:
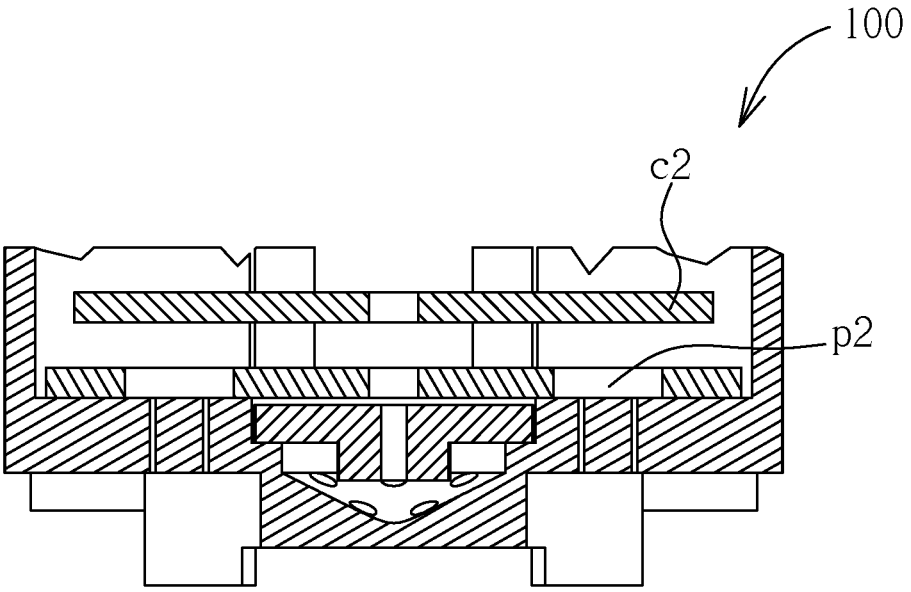
Figure 62:
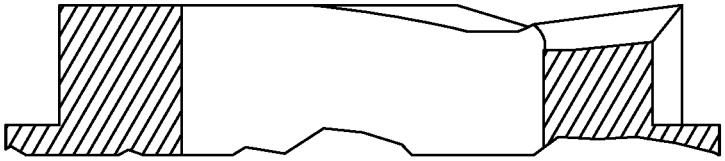

FIG. 54 shows an example of a spinning output generated from the liquid saving device 100, as referenced in FIG. 25 according to one example of the present disclosure. The output streams appear to be a single stream under naked eye, but when examined in slow motion, the stream was actually rotating.

Although the present disclosure and its advantages have been described in detail, it should be understood that various changes, substitutions and alterations can be made herein without departing from the spirit and scope of the disclosure as defined by the appended claims. For example, many of the processes discussed above can be implemented in different methodologies and replaced by other processes, or a combination thereof.

Moreover, the scope of the present application is not intended to be limited to the particular embodiments of the process, machine, manufacture, composition of matter, means, methods and steps described in the specification. As one of ordinary skill in the art will readily appreciate from the disclosure of the present disclosure, processes, machines, manufacture, compositions of matter, means, methods, or steps, presently existing or later to be developed, that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

Additional Embodiments

The present disclosure further discloses a few alternative designs of the liquid saving device 100, in which a bottom height varies to cause change in gap opening.

In some example, height variation controls opening of side pore (pores for generating vortex) and does not affect the mid pores (pores for generating stream output) and leaving it open at all times.

FIGS. 55-58 illustrates an example of switch assembly of the liquid saving device 100 based on an embodiment of the present disclosure. The system is configured in a closed position that generates only spray.

S1 is the highest point on the hex plate. S2 is the lowest point of the cavity on the hex plate. S3 is an intermediate height positioned between S1 and S2.

C1 is the mid opening pore of the covering element. P1 is the mid opening pore of a rubber gasket r2 that seals between the covering element and the top plate. M2 is pore of the insert that is used to reduce flow rate. The switch can function without the insert.

In the closed position, a rod r1 is fully extended to allow a covering plate c2 to fully touch the rubber gasket r2. The end of the rod r1 does not have to touch position s2 if c1 touches r2 before the end of r1 reaches s2.

FIGS. 59-62 illustrate an example of switch assembly of the liquid saving device 100 based on an embodiment of the present disclosure. The system is configured in an open position that generates vortex.

In the open position, the pressure of flow pushes the covering piece c2 toward r2 and is stopped when the end of r1 reaches position s1. The end of r1 reaches position s1 before c2 can touch r2. This creates a gap g1 that allow liquid to flow between c2 and r2 and through p2 to generate vortex output. Turning the hex plate containing features s1 and s2 is used to switch between the different positions.

In another embodiment, height variation controls opening of side pores and mid pores. This design allows adjustment of flow rate for both the spray output and the vortex output.

Figure 63:
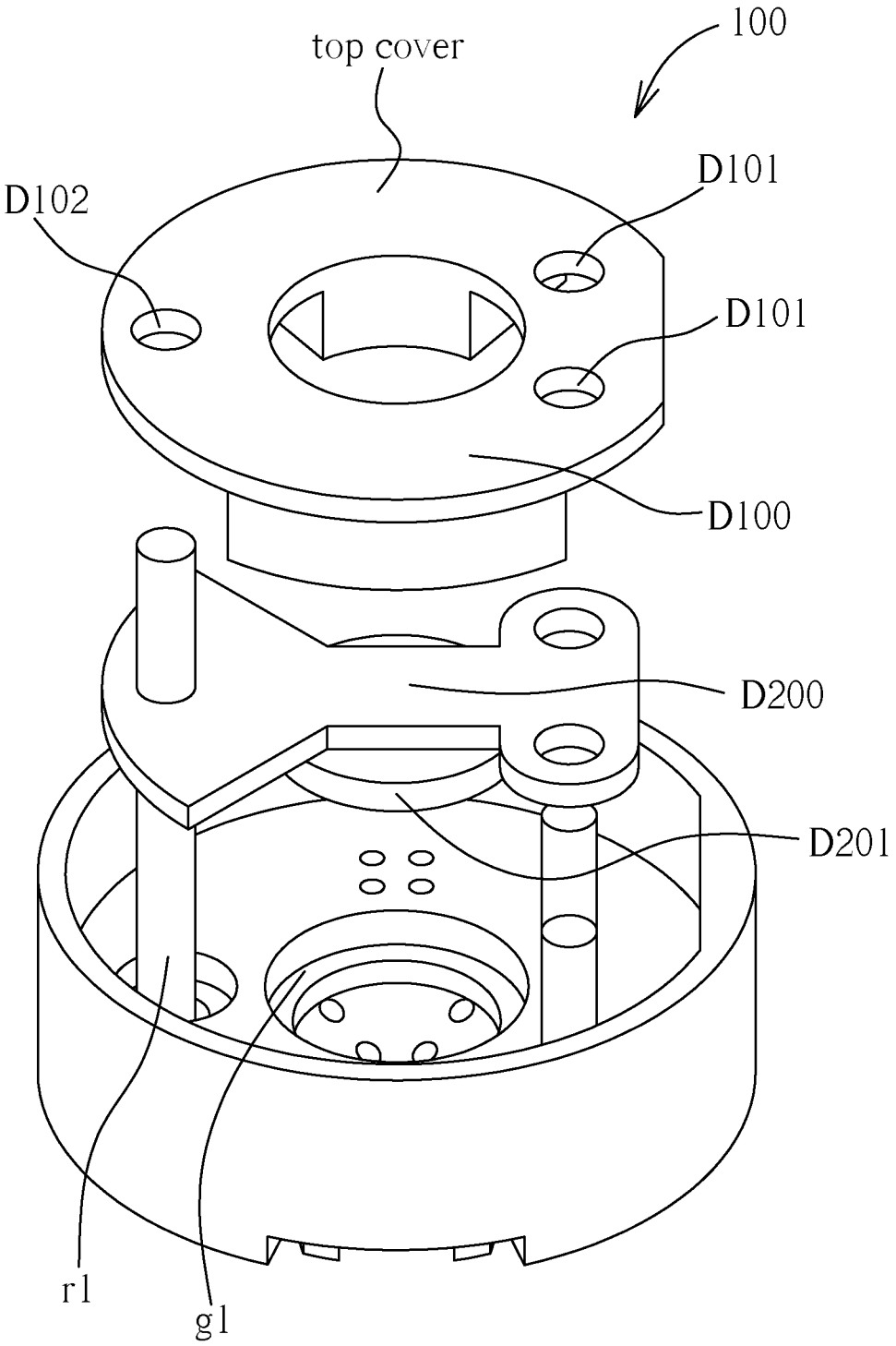
FIGS. 63-64 illustrate an example of switch flow component of the liquid saving device based on an embodiment of the present disclosure.
Figure 64:
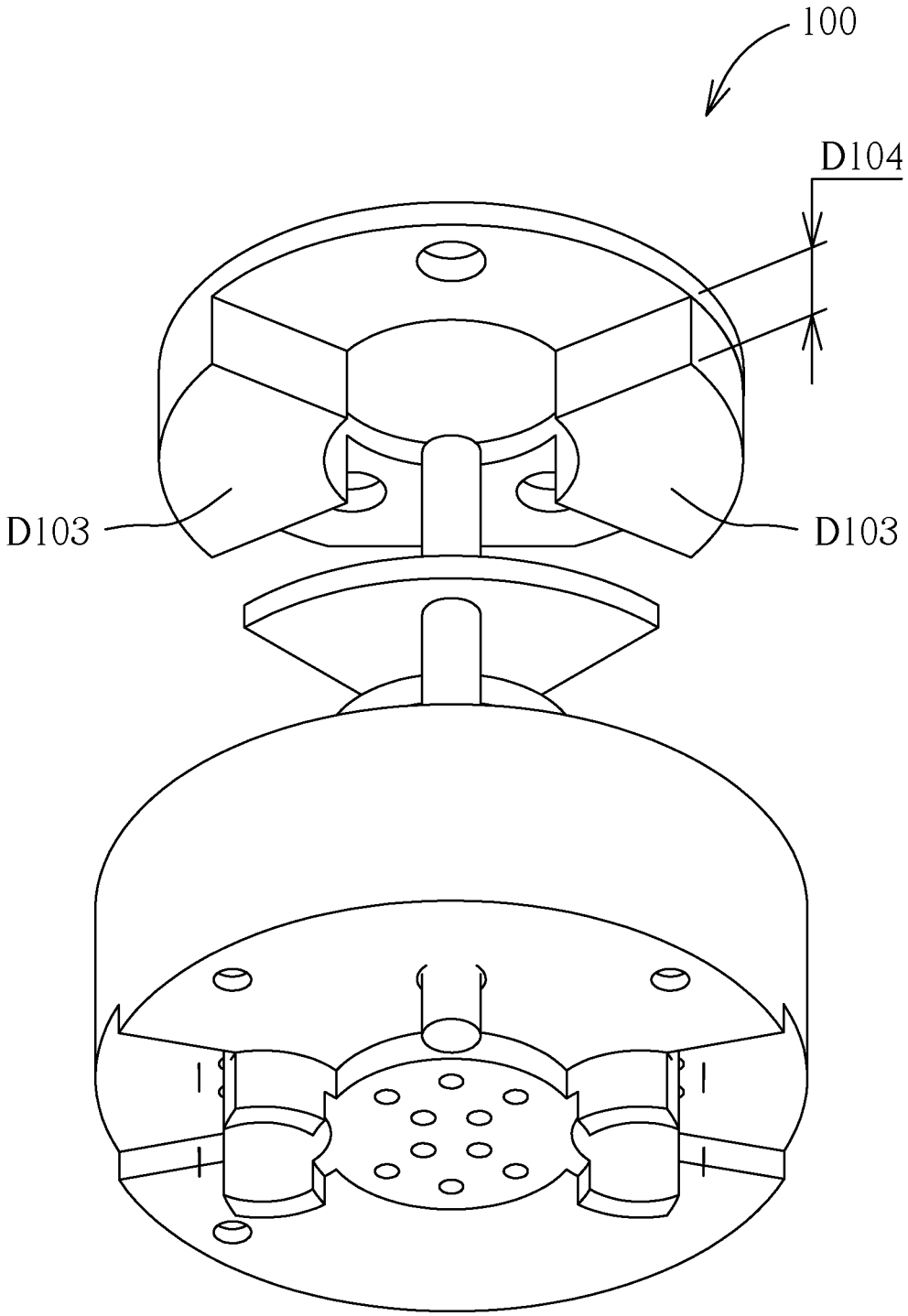
Figure 65:
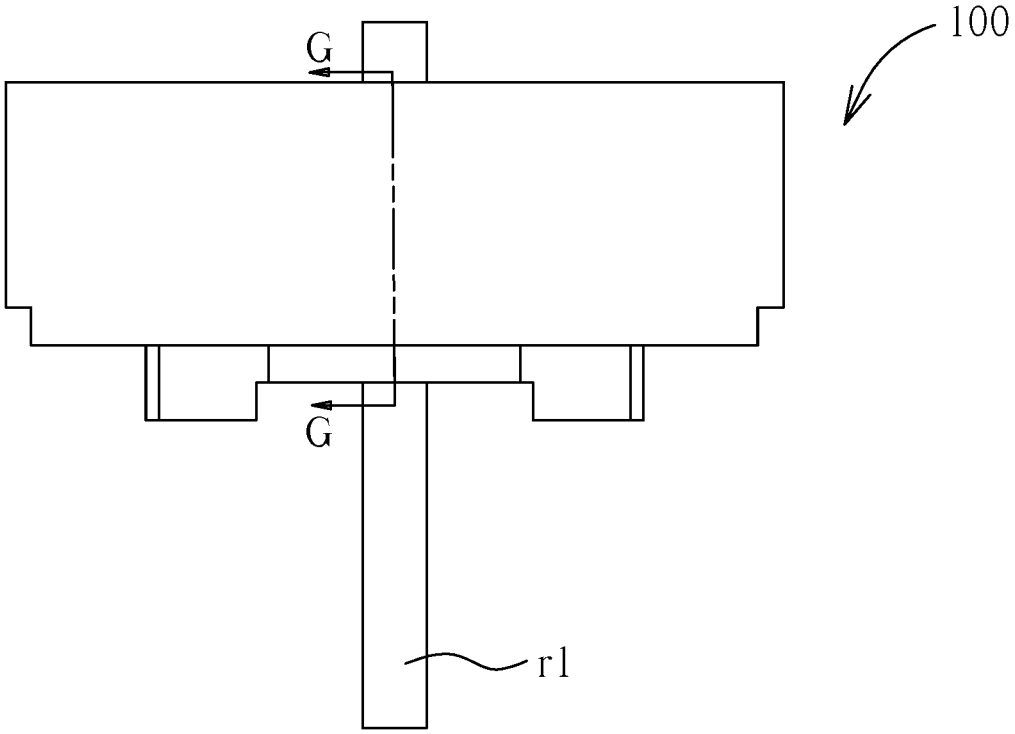
FIGS. 65-70 illustrates an example of an adjustable flow switch of the liquid saving device based on an embodiment of the present disclosure.
Figure 66:
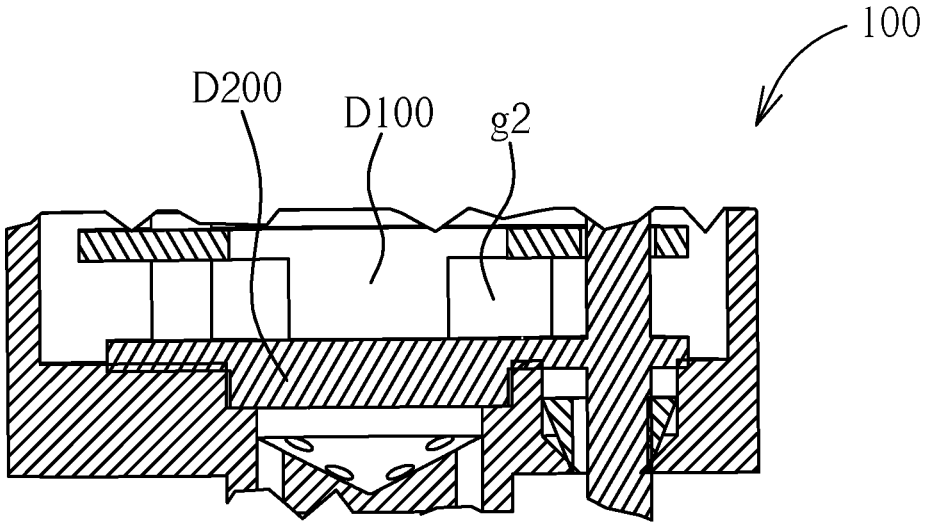
Figure 67:
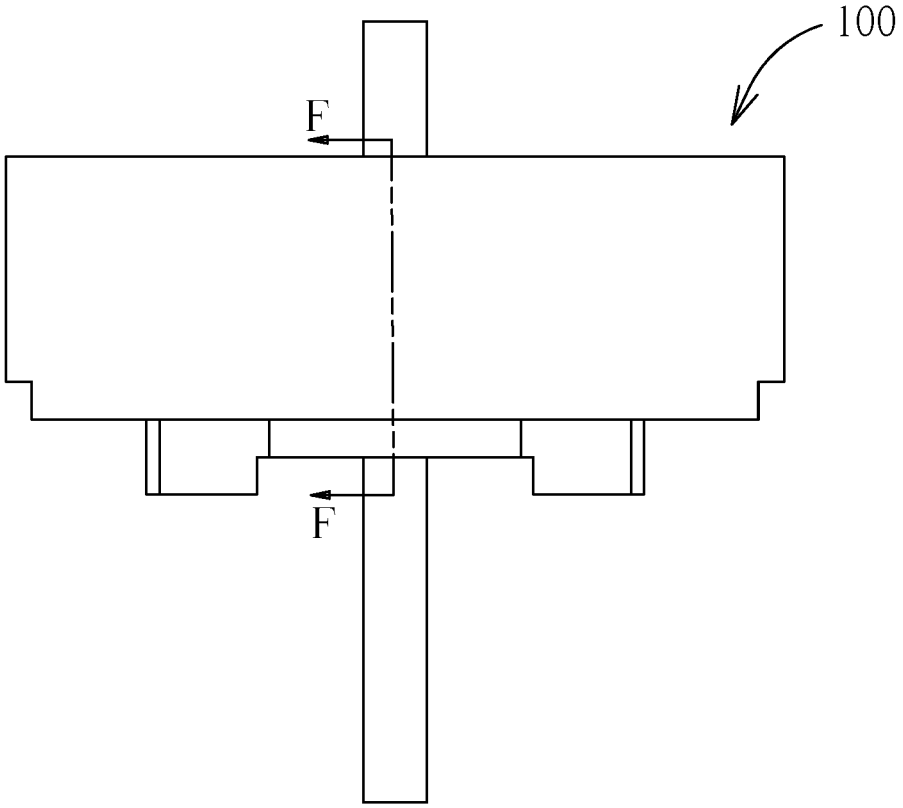
Figure 68:
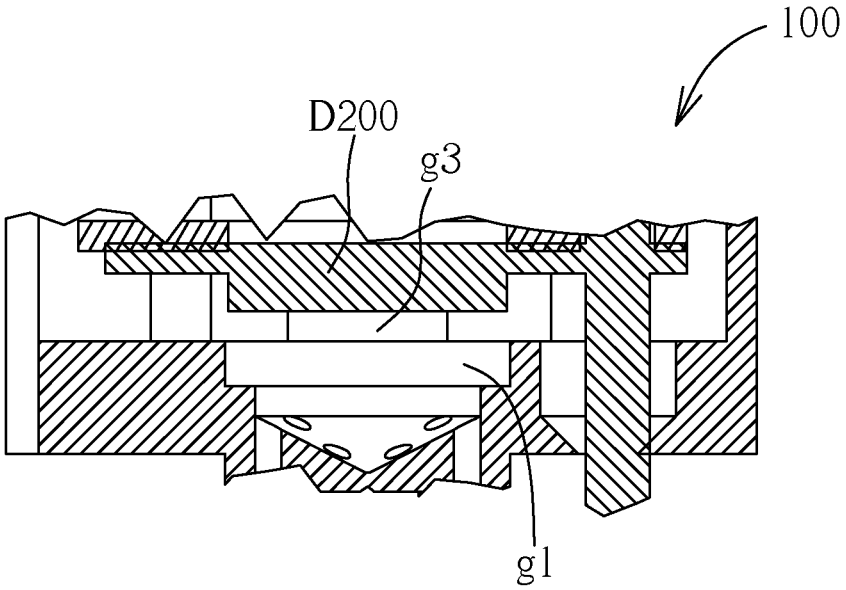

FIGS. 63-64 illustrate an example of switch flow component of the liquid saving device 100 based on an embodiment of the present disclosure.

FIGS. 63-64 show the various components of a switch capable of controlling the flow of spray and the flow of vortex. D100 is the top portion of the switch, and D200 is the bottom portion. D101 and D102 are alignment holes that fit to the alignment features of D100 and the alignment features of the top plate. A gap or cavity g1 allows the bottom feature 201 of D200 to fit into it when D200 is pushed downward. During operation, the flow pressure will push both D100 and D200 downward, but this downward motion is stopped when r1 reaches a position limited by the hex plate. D103 are the covers that when pushed downward will seal to the gasket to prevent flow going through the side pores. D104 is the spacing such that D200 has to be completely pushed through before it can lift up D100. Once D100 is lifted, the side pores will be opened up and allow vortex to be created. Before D100 is lifted, the side pores will remain closed and the change in the height position of r1 will only affect the opening of mid pores and controls the flow rate of the spray.

FIGS. 65-70 illustrates an example of an adjustable flow switch of the liquid saving device 100 based on an embodiment of the present disclosure.

In the embodiment, the cover plate can consist of two portions and the top portion has spacing that allows the bottom portion to move up without lifting the top portion, and this allows the flow rate of the spray to be adjusted while the pores for generating vortex flow to remain sealed. The top portion is D100, and the bottom portion is D200. The opening and closing of the side pores and the mid pores are controlled by the height position of r1. The position of r1 can be controlled by methods mentioned before.

In FIGS. 65-68, when r1 is fully extended downward, D200 fills gap g1 and because D200 can have no pores, D200 completely prevents flow going through mid-pores and side pores. The gap g2 is located between D200 and D100. When r1 is pushed upward but the change of position of r1 is less than the gap spacing g2, D200 is moved upward while D100 remains still. This opens up the mid pores but leaves the side pores covered. It also creates gap g1 and gap g3. The shape of D201 and the gap distance g3 controls how much flow goes through the mid-pores. When g3 is small, D201 will be very close to blocking g1 and thus minimize the flow through the mid-pores. When g3 is large, more flow is allowed to go through the mid-pores to create a stronger spray.

Figure 69:
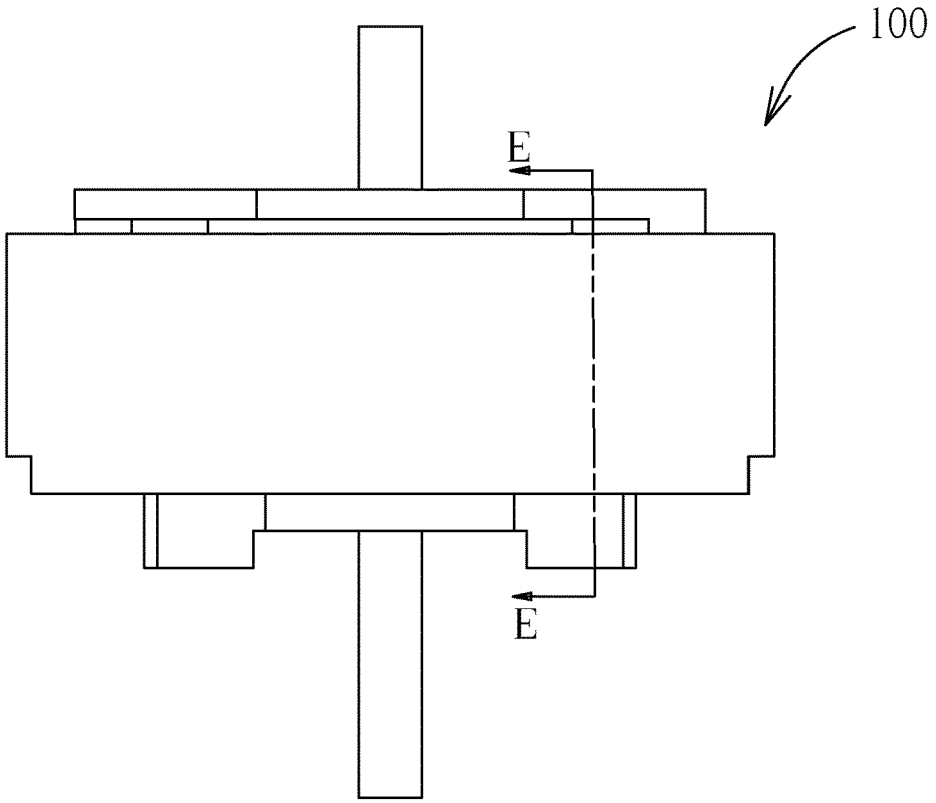
Figure 70:
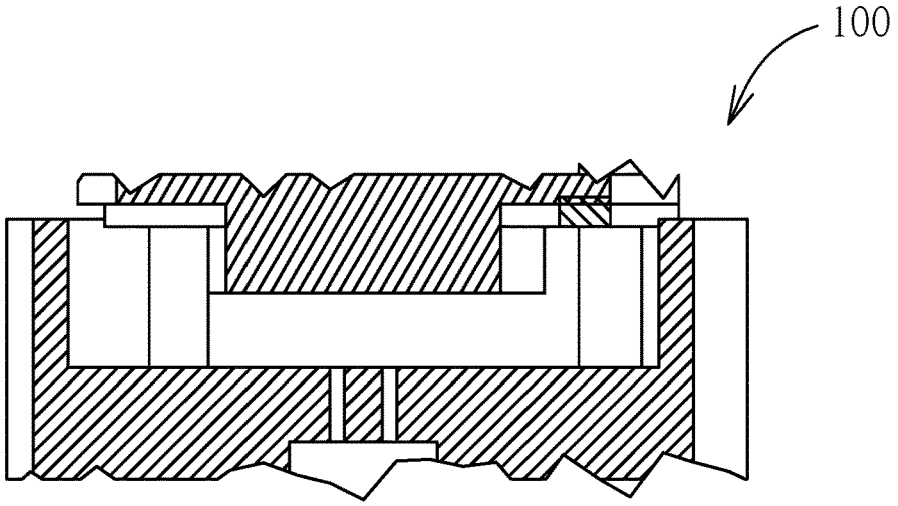

In FIGS. 69-70, when r1 moves through a distance that exceeds g2, D200 is pushed against D100 and moves both D200 and D100 upward. This opens up the flow that goes through the side pores and mid pores creating a vortex flow.

FIGS. 71-76 illustrate a flow switch mechanism of the liquid saving device 100 based on an embodiment of the present disclosure.

Figure 71:
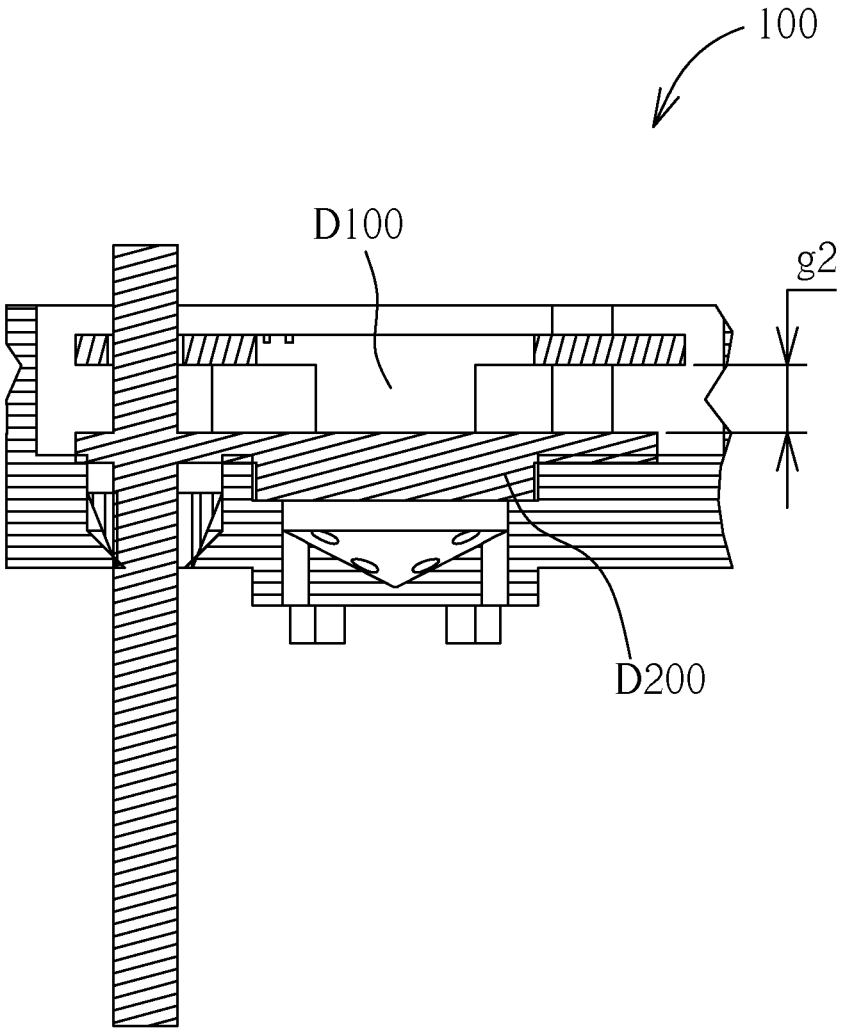
FIGS. 71-76 illustrate a flow switch mechanism of the liquid saving device based on an embodiment of the present disclosure.
Figure 72:
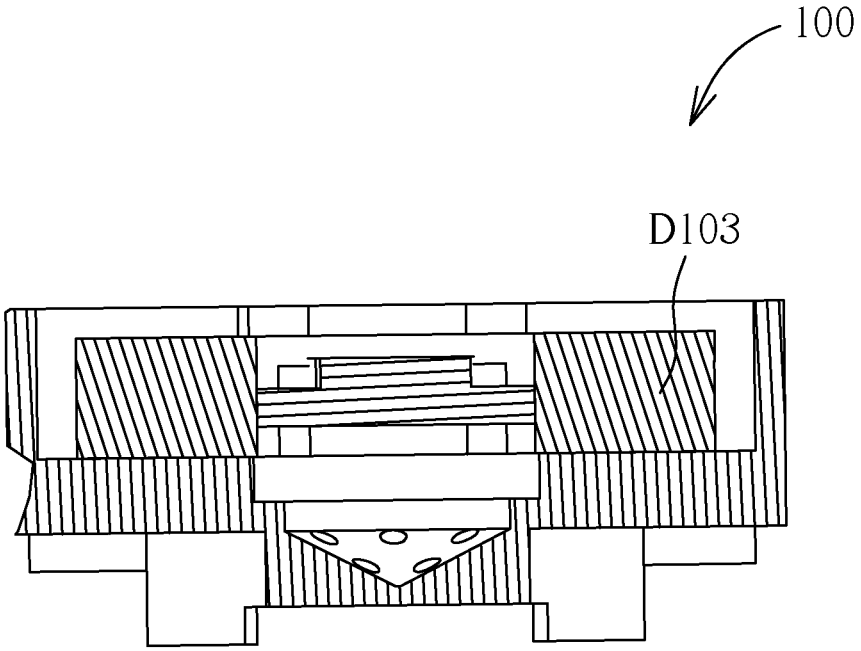

FIGS. 71-72 show two different cross-sections of the switch in relationship to the pores that they cover. D200 closed mid pore and side pores and prevents any flow going through the pores.

Figure 73:
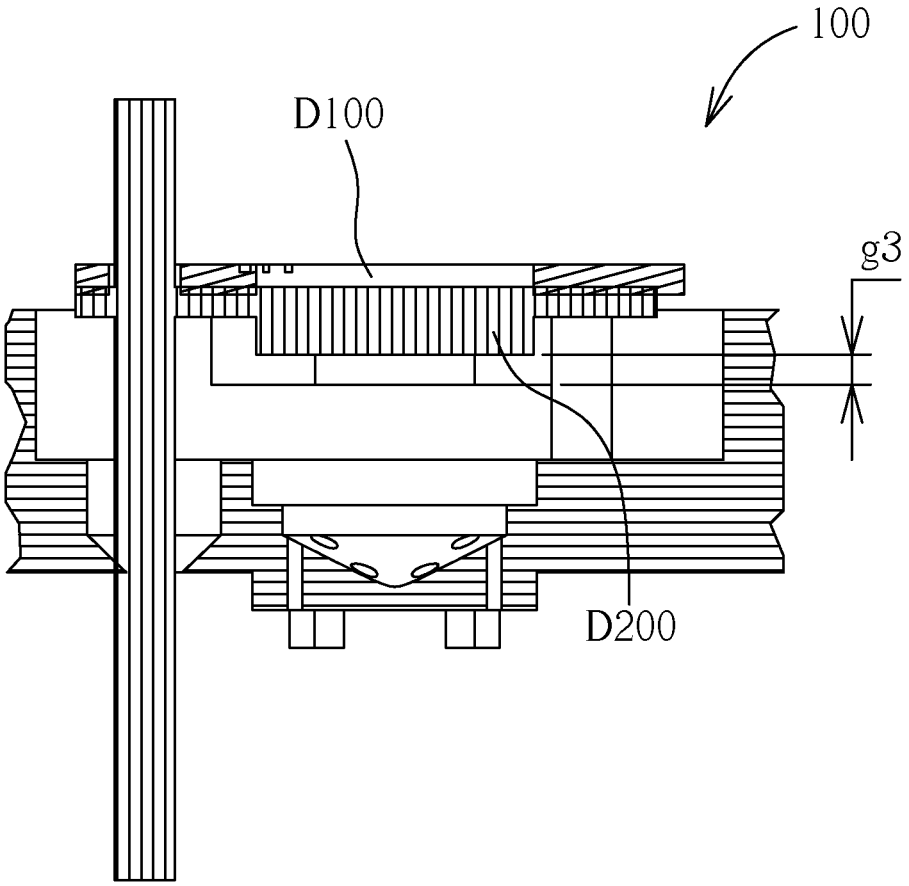
Figure 74:
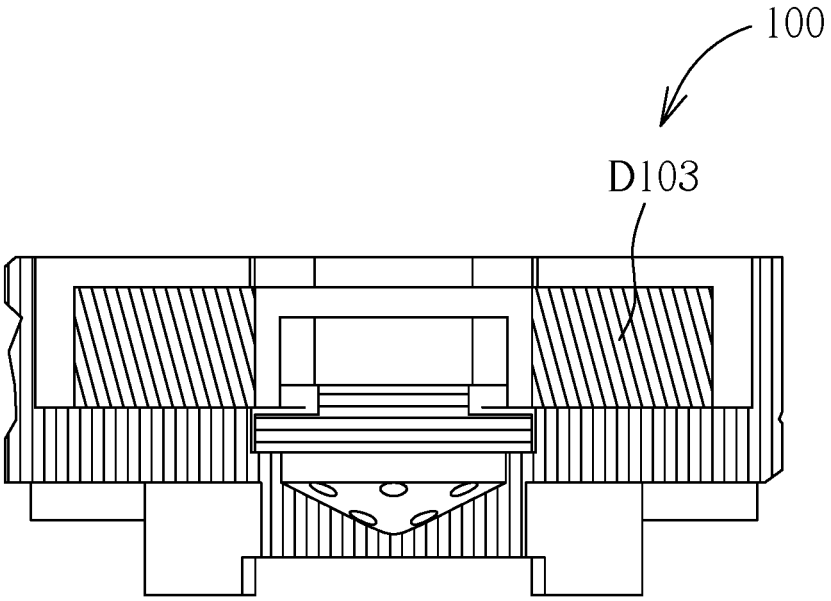

In FIGS. 73-74, D200 moves upward but the traveled distance is less than g2. D200 opens up gap g3 but D103 remained to cover side pores. Flow allowed to travel through mid-pores to generate spray.

Figure 75:
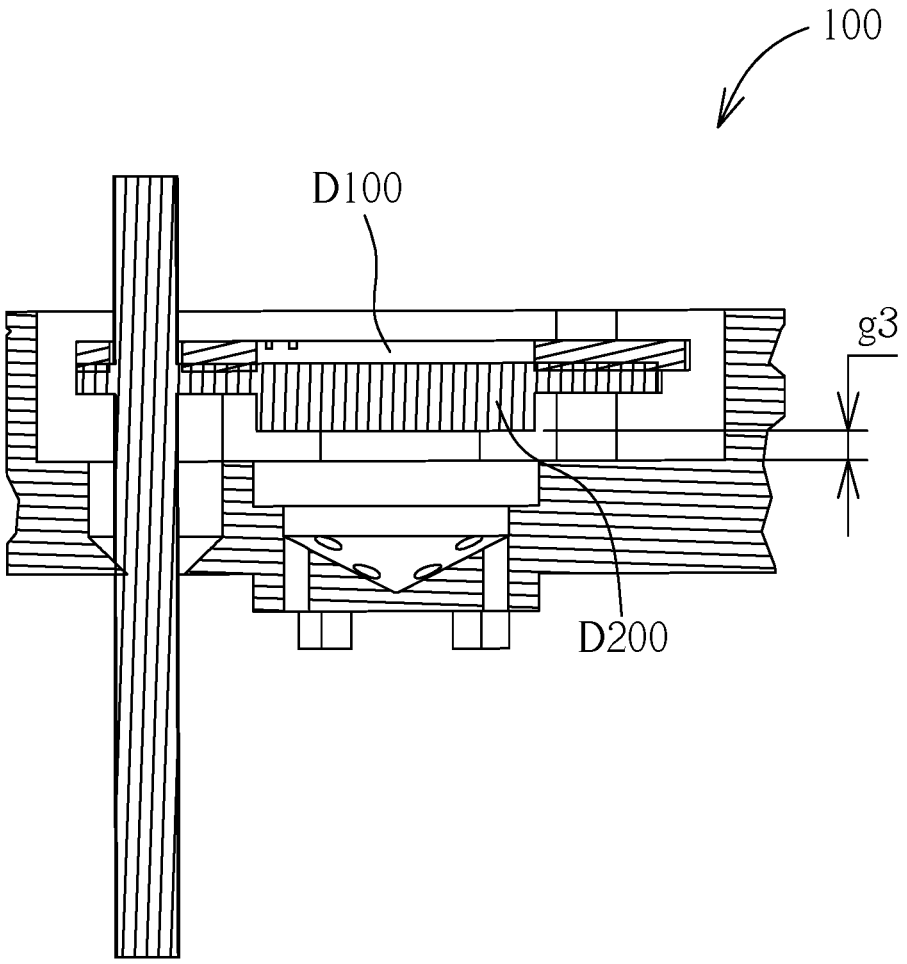
Figure 76:
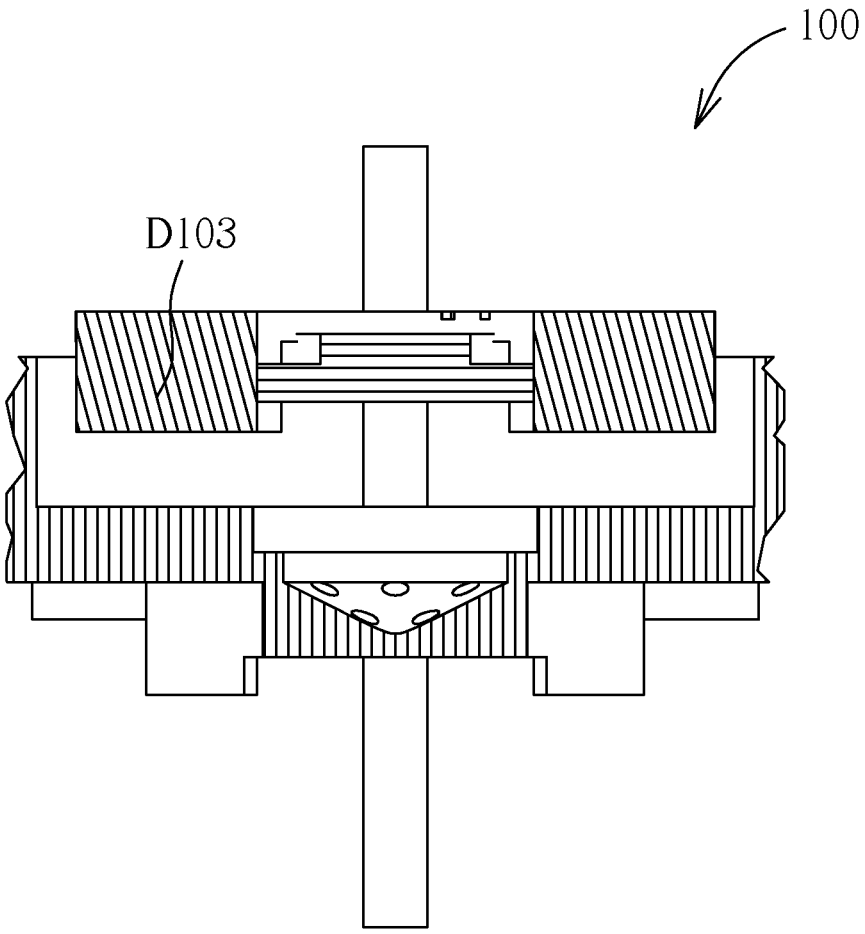

In FIGS. 75-76, D200 moves more than g2. D103 gets lifted away from covering the side pores. Both side pores and mid pores are unblocked allowing vortex to be generated at the output.

A gasket with pores can be used to create better seal between D200 and the pores located within the top plate.

LISTING OF ELEMENTS

1 hole
10 guiding structure
100 liquid saving device
11 depth
111 liquid guide
113 vortex adaptor
114 switch
115 switch handle
116 cover piece
117 rubber gasket
118 rubber gasket
119 filter
12 mid-extended structure
121 plug
122 resistive plate
123 inlet through hole
124 extended portion
125 pore
126 block
127 pore
128 block
129 pore
130 pore
13 pore
134 extended piece
136 center pore
137 pore
14 secondary liquid inlet hole
146 adjusting space
secondary liquid inlet hole
151 tube
153 pore
154 alignment structure
156 slope
16 internal recess
161 middle structure
17 sloped structure
176 slope
2 restrictor
210 liquid guide

211 upper piece
212 bottom piece
213 cavity
214 output pore
215 output pore
216 center ring block
217 output pore
218 output pore
219 inlet pore
220 depth
231 output stream
232 output stream
233 output stream
234 output stream
235 droplet stream
236 droplet stream
3 outer sidewall
311 air inlet hole
312 trench
313 switch receiving hole
314 center through hole
315 outer ring
316 gap
317 alignment structure
318 spacing
319 thickness
321 liquid jet streams
322 primary vortex
323 secondary vortex
324 depth
325 width
326 diameter
327 length
330 output vortex
4 ring
5 recess
511 head
512 tapered tooth
513 body
514 bottom
515 top depth variation
516 gear
517 middle part
518 counter tooth
519 counter tooth
520 upper body
523 switch rod
524 switch
530 lower body
550 extended width
6 indentation
610 gap
630 gap
7 alignment surface
711 upper holder piece
712 inner rotatable piece
713 bottom flow chamber
714 air holes
715 output hole
716 liquid flows through hole
717 liquid flows through hole
718 pore
719 gasket cover piece
8 air inlet hole
9 pit

What is claimed is:

1. A liquid saving device, comprising:

a liquid guide, comprising:

a primary recess, configured to receive a first liquid stream;

an indentation, disposed within the primary recess;

a plurality of primary pores, coupled to the indentation for receiving the first liquid stream to generate a same plurality of second liquid streams, which is spray-form, at respective ends, and each of the plurality of primary pores ends at a bottom of the liquid guide;

a secondary recess, disposed above the primary recess for receiving the first liquid stream; and a plurality of straight pores, disposed on the bottom of the secondary recess, and configured to inlet the first liquid stream to output a same plurality of third liquid streams at the bottom of the liquid guide;

wherein at least part of the plurality of primary pores have different lengths;

wherein when a first primary pore among the plurality of primary pores has a shorter length if the first primary pore is designed to output its corresponding second liquid stream with a larger deflection; and wherein when a second primary pore among the plurality of primary pores has a longer length if the second primary pore is designed to output its corresponding second liquid stream with a smaller deflection; and a vortex adaptor, having a top coupled to the bottom of the liquid guide, the vortex adaptor comprising:

at least one air inlet structure, disposed at a lateral intersection between the bottom of the liquid guide and the top of the vortex adaptor, and configured to draw air at a lateral side of the liquid saving device;

a trench, disposed inside the vortex adaptor, coupled to the at least one air inlet structure and the plurality of straight pores at an intersection between the liquid guide and the vortex adaptor, and configured to receive both the plurality of secondary liquid streams and the air drawn by the at least one air inlet structure to generate a first aerated vortex;

a gap, disposed at the top of the vortex adaptor for receiving the plurality of second liquid streams, coupled to the trench for receiving an elevated flow of the first aerated vortex, and configured to mix the elevated flow of the first aerated vortex with the plurality of second liquid streams to generate a second aerated vortex; and a center through hole, coupled to the gap, and configured to output an aerated stream out of the second aerated vortex.

2. The liquid saving device of claim 1, further comprising:

a switch, configured to pivot through both the liquid guide and the vortex adaptor, and configured to substantially switch a plurality flow rate patterns provided by the liquid guide for determining a flow rate of the first liquid stream.

3. The liquid saving device of claim 2, further comprising:

a cover piece, disposed above the switch, and rotatably coupled to the switch; and a first flexible gasket, comprising a first through hole, through which the switch pivots, and comprising a plurality of bore sets, each of which corresponds to a unique flow rare patterns and a unique set of straight bores among the plurality of straight bores, wherein each the bore set is configured to allow the first liquid stream to flow through and configured to determine a corresponding flow rate of the first liquid stream;

wherein the switch is rod-shaped, and the switch comprises:

a head, sandwiched between the cover piece and the first flexible gasket engaged with the cover piece in a fixed manner, and rotatably engaged with the first flexible gasket;

a body, coupled to the head, and configured to synchronously rotate both the head and the cover piece to block at least one of the plurality of bore sets on the first flexible gasket for utilizing flow rate patterns that correspond to unblocked bore sets; and a handle, coupled to the body, and configured to exert a rotational force on the body to synchronously rotate both the head and the cover piece.

4. The liquid saving device of claim 3, further comprising:

wherein the liquid guide further comprises a first switch receiving hole, and the vortex adapter further comprises a second switch receiving hole;

wherein the body of the switch pivots through both the liquid guide and the vortex adaptor respectively via the first switch receiving hole and the second switch receiving hole; and wherein the handle is disposed under the vortex adaptor.

5. The liquid saving device of claim 3, further comprising:

a second flexible gasket, comprising a liquid through hole; and a filter, disposed under the liquid through hole for generating the first liquid stream when a liquid source pools above the second flexible gasket, and disposed above the cover piece.

6. The liquid saving device of claim 1, wherein a third primary pore among the plurality of primary pores is disposed closer to a center of the indentation than a fourth primary pore among the plurality of primary pores when the third primary pore is shorter than the fourth primary pore in length.

7. The liquid saving device of claim 1, further comprising:

at least one guiding structure, disposed at the bottom of the liquid guide, and configured to guide the air drawn by the at least one air inlet structure to mix with the plurality of third liquid streams at the bottom of the liquid guide.

8. The liquid saving device of claim 6, further comprising:

at least one restrictor, disposed on the bottom of the secondary recess, and configured to limit the cover piece.

9. The liquid saving device of claim 1, further comprising:

a plug, disposed at the primary recess and above the indentation, the plug comprises an inlet through hole for guiding the first liquid stream to pass through and be received by the at least one primary pore; and wherein the plug fits the primary recess.

10. The liquid saving device of claim 1, further comprising:

a cap, disposed above the primary recess, and configured to form an interior space that occupies at least the primary recess;

wherein the cap comprises an inlet bore configured to guide the first liquid stream to pass through and to reach the interior space and then the plurality of primary pores.

11. The liquid saving device of claim 1, further comprising:

at least one alignment structure, disposed at the top of the vortex adaptor, and configured to align the vortex adaptor with the liquid guide.

12. The liquid saving device of claim 1, wherein the trench is a closed circumferential-shaped ring.

13. The liquid saving device of claim 1, wherein the trench is a circumferential-shaped ring that has a disconnected segment between a first end and a second end of the trench.

14. The liquid saving device of claim 2, further comprising:

a cover piece, disposed above the switch, and rotatably coupled to the switch, and a first flexible gasket, comprising a first through hole, through which the switch pivots;

wherein the switch is configured to pivot and raise the cover piece to form a gap between the cover piece and the first flexible gasket, through which liquid flows via the plurality of straight pores to form the plurality of second liquid streams, which then flow into the trench of the vortex adaptor.

* * * * *